US010427828B2

(12) United States Patent
Yamada et al.

(10) Patent No.: US 10,427,828 B2
(45) Date of Patent: Oct. 1, 2019

(54) CORRUGATED PAPERBOARD BOX, PERFORATION FORMING METHOD FOR PERFORATING CORRUGATED PAPERBOARD SHEET, AND PERFORATION FORMING DEVICE AND PERFORATION FORMING UNIT FOR PERFORATING CORRUGATED PAPERBOARD SHEET

(71) Applicant: RENGO CO., LTD., Osaka (JP)

(72) Inventors: Taishi Yamada, Osaka (JP); Takashi Kajizuka, Osaka (JP); Hidetoshi Tonooka, Osaka (JP); Eiji Yamahara, Osaka (JP); Hiromu Ikeda, Osaka (JP); Taku Furuta, Osaka (JP); Atsuo Ishikawa, Saitama (JP); Katsuhiko Yasumoto, Osaka (JP); Satoshi Mochizuki, Osaka (JP); Yoichi Nishikawa, Saitama (JP); Masayoshi Ootani, Saitama (JP)

(73) Assignee: RENGO CO., LTD., Osaka (JP)

( * ) Notice: Subject to any disclaimer, the term of this patent is extended or adjusted under 35 U.S.C. 154(b) by 127 days.

(21) Appl. No.: 15/524,860

(22) PCT Filed: May 17, 2016

(86) PCT No.: PCT/JP2016/064591

§ 371 (c)(1),
(2) Date: May 5, 2017

(87) PCT Pub. No.: WO2016/194602

PCT Pub. Date: Dec. 8, 2016

(65) Prior Publication Data

US 2017/0349323 A1 Dec. 7, 2017

(30) Foreign Application Priority Data

Jun. 3, 2015 (JP) ..... 2015-113283
Dec. 1, 2015 (JP) ..... 2015-234482
Jan. 19, 2016 (JP) ..... 2016-008010

(51) Int. Cl.
*B65D 5/54* (2006.01)
*B31B 50/14* (2017.01)
(Continued)

(52) U.S. Cl.
CPC ..... *B65D 5/5445* (2013.01); *B31B 50/14* (2017.08); *B31B 50/146* (2017.08); *B31B 50/25* (2017.08);
(Continued)

(58) Field of Classification Search
CPC .. B65D 5/5445; B65D 5/0227; B65D 5/0236; B65D 5/4266; B65D 5/541; B31B 50/25; B31B 50/14
See application file for complete search history.

(56) References Cited

U.S. PATENT DOCUMENTS 1,288,132 A * 12/1918 Nagle ..... B65D 5/4266 15/41.1
1,758,230 A * 5/1930 Lange ..... B65D 5/4266 229/930
(Continued)

FOREIGN PATENT DOCUMENTS

JP 54-7930 1/1979
JP 58-104739 6/1983
(Continued)

OTHER PUBLICATIONS

International Search Report dated Aug. 2, 2016 in corresponding International (PCT) Application No. PCT/JP2016/064591.
(Continued)

*Primary Examiner* — Derek J Battisti
(74) *Attorney, Agent, or Firm* — Wenderoth, Lind & Ponack, L.L.P.

(57) ABSTRACT

A corrugated paperboard box is provided in which when flaps are bent, a perforated line along which the flaps can be
(Continued)

separated from the box is less likely to break. Such a corrugated paperboard box includes a peripheral wall and top flaps, and is formed, at the boundary area between the peripheral wall and the top flaps, with a groove-shaped reverse scoreline recessed on the side of an outer linerboard, and a pair of groove-shaped recesses recessed on the side of an inner linerboard, and extending in parallel to each other so as to sandwich the area in which the reverse scoreline extends. The corrugated paperboard box is further formed, in one of the groove-shaped recesses, with a perforated line along which the top flaps can be separated from the peripheral wall. The top flaps can be bent along the perforated line toward the inner surface of the peripheral wall.

8 Claims, 45 Drawing Sheets

(51) Int. Cl.

| | |
|---|---|
| ***B31B 50/25*** | (2017.01) |
| ***B65D 5/02*** | (2006.01) |
| ***B65D 5/42*** | (2006.01) |
| ***B65D 65/40*** | (2006.01) |
| *B31B 110/35* | (2017.01) |
| *B31B 120/70* | (2017.01) |
| *B31B 110/30* | (2017.01) |
| *B31B 100/00* | (2017.01) |

(52) U.S. Cl.

CPC ..... *B31B 50/256* (2017.08); *B65D 5/0227* (2013.01); *B65D 5/0236* (2013.01); *B65D 5/4266* (2013.01); *B65D 5/541* (2013.01); *B65D 65/403* (2013.01); *B31B 2100/0022* (2017.08); *B31B 2110/30* (2017.08); *B31B 2110/35* (2017.08); *B31B 2120/70* (2017.08)

(56) References Cited

U.S. PATENT DOCUMENTS

| | | | | |
|---|---|---|---|---|
| 2,173,927 | A * | 9/1939 | Allen | B31B 50/00 229/931 |
| 3,526,566 | A * | 9/1970 | McIlvain, Jr. | B31F 1/08 229/930 |
| 4,623,072 | A * | 11/1986 | Lorenz | B65D 5/4266 229/122.32 |
| 4,905,864 | A * | 3/1990 | Balin | B31F 1/2813 229/122.32 |
| 6,189,780 | B1 * | 2/2001 | Kanter | B65D 5/542 229/164 |
| 9,573,722 | B1 * | 2/2017 | Capogrosso | B65D 5/50 |
| 2002/0166887 | A1 * | 11/2002 | Matsuoka | B65D 5/0227 229/117 |

FOREIGN PATENT DOCUMENTS

| | | |
|---|---|---|
| JP | 60-123317 | 8/1985 |
| JP | 3-11626 | 2/1991 |
| JP | 4-113927 | 10/1992 |
| JP | 3036775 | 5/1997 |
| JP | 2003-26153 | 1/2003 |
| JP | 2014-151582 | 8/2014 |

OTHER PUBLICATIONS

Extended European Search Report dated Mar. 21, 2018 in European Application No. 16803037.7.

International Preliminary Report on Patentability dated Dec. 5, 2017 in International (PCT) Application No. PCT/JP2016/064591.

* cited by examiner

CORRUGATED PAPERBOARD BOX, PERFORATION FORMING METHOD FOR PERFORATING CORRUGATED PAPERBOARD SHEET, AND PERFORATION FORMING DEVICE AND PERFORATION FORMING UNIT FOR PERFORATING CORRUGATED PAPERBOARD SHEET

TECHNICAL FIELD

The present invention relates to a corrugated paperboard box, a perforation forming method for perforating a corrugated paperboard sheet, and a perforation forming device and a perforation forming unit for perforating a corrugated paperboard sheet

BACKGROUND ART

Generally, corrugated paperboard boxes include a peripheral wall formed by bending the corrugated paperboard into a tubular shape, and a plurality of flaps integrally connected to one end of the peripheral wall, and are formed with a normal scoreline at the boundary area between the flaps and the peripheral wall so that the flaps can be smoothly bent along the normal scoreline toward the inner surface of the peripheral wall. The corrugated paperboard, of which such a corrugated paperboard box is made, includes an outer linerboard, an inner linerboard, and a corrugated medium provided between the outer linerboard and the inner linerboard. The normal scoreline at the boundary area between the flaps and the peripheral wall is recessed on the side of the inner linerboard (i.e., on the inner side of the box).

When products are packed in such a corrugated paperboard box, in order to enable the products to be easily placed into the box, the flaps are bent toward the outer surface of the peripheral wall (i.e., bent outwardly) in some cases. Since the normal scoreline at the boundary area between the flaps and the peripheral wall is a groove-shaped scoreline recessed on the side of the inner linerboard, the flaps can be smoothly bent inwardly along the normal scoreline. However, the flaps are less likely to be bent outwardly. Therefore, when products are packed in such a corrugated paperboard box, it is necessary to hold the flaps by hand with the flaps bent outwardly such that the flaps do not elastically return.

In order to overcome such a problem, Japanese Unexamined Utility Model Application Publication No. S60-123317 proposes a corrugated paperboard box including a flap 201 and a peripheral wall 202, and formed, as illustrated in FIG. 57, at the boundary area between the flap 201 and the peripheral wall 202 with a normal scoreline 203 along which the flap 201 can be bent toward the inner surface of the peripheral wall 202, and a reverse scoreline 204 along which the flap 201 can be bent toward the outer surface of the peripheral wall 202.

In order to make it possible to easily open the corrugated paperboard box formed at the boundary area between the flap 201 and the peripheral wall 202 with the normal scoreline 203, along which the flap 201 can be bent toward the inner surface of the peripheral wall 202, and the reverse scoreline 204, along which the flap 201 can be bent toward the outer surface of the peripheral wall 202, as illustrated by the dashed line in FIG. 57, the inventors of the present application considered forming, at the position of the normal scoreline 203 of the corrugated paperboard box, a perforated line 205 along which the flap 201 can be separated from the peripheral wall 202.

If the perforated line 205 is formed at the position of the normal scoreline 203, it is possible to easily open the corrugated paperboard box by separating the flap 201 along the perforated line 205 from the peripheral wall 202 with the box closed by the flap 201. Also, after separating the flap 201 along the perforated line 205 from the peripheral wall 202, it is possible to display products at a storefront with the products received in the corrugated paperboard box, namely, without taking the products out of the box.

However, when the inventors of the present application experimentally prepared in their company a corrugated paperboard box which is formed at the boundary area between the flap 201 and the peripheral wall 202 with the normal scoreline 203, along which the flap 201 can be bent toward the inner surface of the peripheral wall 202, and the reverse scoreline 204, along which the flap 201 can be bent toward the outer surface of the peripheral wall 202, and wall 202, and which is further formed at the position of the normal scoreline 203 with the perforated line 205, along witch the flap 201 can be separated from the peripheral wall 202, it turned out that when the flap 201 is bent along the normal scoreline 203 toward the inner surface of the peripheral wall 202, the perforated line 205 tends to break.

Therefore, the inventors of the present application investigated what causes the perforated line 205 to break when bending the flap 201 along the normal scoreline 203 in the above corrugated paperboard box, experimentally prepared in their company, and noticed the following point.

When the boundary area between the flap 201 and the peripheral wall 202 is sandwiched from the side of an outer linerboard 206 and the side of an inner linerboard 207, the normal scoreline 203 is formed. Similarly, when the boundary area between the flap 201 and the peripheral wall 202 is sandwiched from the side of the outer linerboard 206 and the side of the inner linerboard 207, the reverse scoreline 204 is formed. Namely, if both the normal scoreline 203 and the reverse scoreline 204 are formed, the boundary area between the flap 201 and the peripheral wall 202 is sandwiched twice, specifically, when the normal scoreline 203 is formed, and when the reverse scoreline 204 is formed, thereby receiving a large tensile load. This decreases, to a large degree, the tensile strengths of the portions of the linerboards 206 and 207 located at the boundary area between the flap 202 and the peripheral wall 202.

Therefore, it turned out that if both the normal scoreline 203 and the reverse scoreline 204 are formed, and further the perforated line 205 is formed at the position of the normal scoreline 203, the perforated line 205 tends to break. Namely, when the flap 201 is bent along the normal scoreline 203 toward the inner surface of the peripheral wall 202, the perforated line 205 tends to break due to the tension applied to the outer linerboard 206.

In order to make it possible to easily open the corrugated paperboard box, as illustrated in FIG. 36(A), the inventors of the present application considered forming, on a normal scoreline 208 along which the flap can be bent and which are recessed on the side of an inner linerboard 2, a perforated line 17 along which the flap can be separated. With this arrangement, it is possible to easily separate the flap along the perforated line 17, located within the normal scoreline 208, namely, to easily open the corrugated paperboard box.

However, when the inventors of the present application experimentally prepared a plurality of corrugated paperboard boxes in which the perforated line 17 is formed within the normal scoreline 208, along which the flap can be bent, and evaluated these boxes, it turned out that when the flap is bent along the normal scoreline 208 toward an outer linerboard 1 (i.e., bent in the reverse direction), the perforated line 17 tends to break.

Thereafter, when the inventors of the present application experimentally prepared a corrugated paperboard box so as to consider why the perforated line 17 tends to break, instead of forming the normal scoreline 208, recessed on the side of the inner linerboard 2 (i.e., on the inner side of the box) as illustrated in FIG. 36(A), they tried forming a reverse scoreline 16 recessed on the side of the outer linerboard 1 (i.e., on the outer side of the box) as illustrated in FIG. 36(B).

As illustrated in FIG. 36(B), this experimentally prepared corrugated paperboard box is formed at the boundary area between the flap and the peripheral wall with a groove-shaped reverse scoreline 16 recessed on the side of the outer linerboard 1, and a perforated line 17 located within the reverse scoreline 16, and comprising a plurality of cuts formed by cutting the box from the side of the inner linerboard 2 toward the side of the outer linerboard 1 with a perforation forming knife 89.

After bending the flap of this corrugated paperboard box along the perforated line 17, the inventors noticed that the perforated line 17 does not break both when the flap is bent along the perforated line 17 toward the outer linerboard 1, and when the flap is bent along the perforated line 17 toward the inner linerboard 2.

Moreover, the inventors considered why the perforated line 17 does not break in the above corrugated paperboard box, experimentally prepared in their company, and noticed the following point: If, as illustrated in FIG. 36(A), the normal scoreline 208, recessed on the side of the inner linerboard 2, and the perforated line 17, cut from the side of the inner linerboard 2, are formed in the box such that the perforated line 17 is located within the normal scoreline 208, when the normal scoreline 208 is formed, the inner linerboard 2 is pulled and receives a large load, and when the perforated line 17 is formed too, the inner linerboard 2 receives a larger load than the load which the outer linerboard 1 receives. Namely, loads concentrate on the inner linerboard 2, so that the perforated line 17 tends to break very easily on the side of the inner linerboard 2. In contrast thereto, if, as illustrated in FIG. 36(B), the reverse scoreline 16, recessed on the side of the outer linerboard 1, and the perforated line 17, cut from the side of the inner linerboard 2, are formed in the box such that the perforated line 17 is located within the reverse scoreline 16, when the reverse scoreline 16 is formed, the outer linerboard 1 receives a large load, and when the perforated line 17 is formed, the inner linerboard 2 on the opposite side of the outer linerboard 1 receives a large load. Namely, loads do not concentrate on one of the outer and inner linerboards 1 and 2, so that the perforated line 17 is relatively less likely to break.

When the inventors of the present application experimentally prepared a plurality of corrugated paperboard boxes in which the perforated line is formed within the normal scoreline between the flap and the peripheral wall, and evaluated these boxes, it turned out that when products are packed in the boxes, the boundary area between the flap and the peripheral wall might break along the perforated line.

Namely, when products are packed in such a corrugated paperboard box, in order to enable the products to be easily placed into the box, the flaps are bent toward the outer surface of the peripheral wall (i.e., bent in the reverse direction) in some cases. Since the normal scoreline between the flap and the peripheral wall is a groove-shaped scoreline recessed on the side of the inner linerboard, when the flap is bent toward the inner surface of the peripheral wall, the flap can be bent naturally and accurately along the normal scoreline. However, a relatively large force is required to bend the flap toward the outer surface of the peripheral wall, namely, when the flap is bent outwardly, a large tension is applied to the inner linerboard. If the perforated line is formed within the normal scoreline between the flap and the peripheral wall, when the flap is bent along the normal scoreline toward the outer surface of the peripheral wall, the boundary area between the flap and the peripheral wall might break along the perforated line due to the tension applied to the inner linerboard.

It is an object of the present invention to provide a corrugated paperboard box in which when a flap is bent, a perforated line along which the flap can be separated from the box is less likely to break.

SUMMARY OF THE INVENTION

In order to achieve the above object, the present invention provides a corrugated paperboard box made of corrugated paperboard comprising an outer linerboard, an inner linerboard, and a corrugated medium provided between the outer linerboard and the inner linerboard, the corrugated paperboard box comprising: a peripheral wall formed by bending the corrugated paperboard into a tubular shape such that the inner linerboard constitutes an inner surface of the corrugated paperboard box; and flaps integrally connected to one of two ends of the peripheral wall. The corrugated paperboard box is formed, at a boundary area between the peripheral wall and the flaps, with a groove-shaped reverse scoreline recessed on a side of the outer linerboard, and a pair of groove-shaped recesses recessed on a side of the inner linerboard, and extending in parallel to each other so as to sandwich an area in which the reverse scoreline extends. The corrugated paperboard box is formed, in one of the groove-shaped recesses, with a perforated line along which the flaps can be separated from the peripheral wall, and which comprises a plurality of cuts extending to penetrate through the inner linerboard, the corrugated medium, and the outer linerboard, and wherein the corrugated paperboard is configured such that the flaps can be bent along the perforated line toward an inner surface of the peripheral wall.

In this corrugated paperboard box, the pair of groove-shaped recesses at the boundary area between the peripheral wall and the flaps are formed on the side of the inner linerboard at the same time as the corrugated paperboard sheet is sandwiched from the side of the outer linerboard and the side of the inner linerboard to form the reverse scoreline which is recessed on the side of the outer linerboard, and at the boundary area between the peripheral wall and the flaps, there is no normal scoreline which is formed independently of the reverse scoreline in conventional corrugated paperboard boxes. In the corrugated paperboard box, no such normal scoreline is necessary, because one of the groove-shaped recesses and the perforated line, along which the flaps can be separated from the peripheral wall, function as such a normal scoreline. Therefore, in this corrugated paperboard box, the tensile strengths of the portions of the outer and inner linerboards located at the boundary area between the peripheral wall and the flaps are less likely to decrease due to the tensile load applied when the reverse scoreline is formed, so that when the flaps are bent along the perforated line toward the inner surface of the peripheral wall, it is possible to prevent the breakage of the perforated line due to the tension applied to the outer linerboard.

It is preferable that each of the cuts of the perforated line comprises a first cut portion formed in the outer linerboard, and a second cut portion formed in the inner linerboard, and the perforated line is formed such that widths of the first cut portions in an orthogonal direction to a direction in which the perforated line extends are smaller than widths of the second cut portions in the orthogonal direction.

With this arrangement, when the perforated line is formed, the load applied to the joint portions between the adjacent pairs of first cut portions on the side of the outer linerboard is smaller than the load applied to the joint portions between the adjacent pairs of second cut portions on the side of the inner linerboard. Therefore, when the flaps are bent along the perforated line toward the inner surface of the peripheral wall, it is possible to effectively prevent the breakage of the perforated line due to the tension applied to the outer linerboard.

Preferably, the perforated line is formed such that each of the first cut portions on the side of the outer linerboard includes a peripheral edge portion having a protruding shape, and each of the second cut portions on the side of the inner linerboard includes a peripheral edge portion having a recessed shape.

With this arrangement, when the flaps are bent along the perforated line toward the inner surface of the peripheral wall, it is possible to effectively prevent the breakage of the perforated line due to the tension applied to the outer linerboard.

As a perforation forming method for perforating a corrugated paperboard sheet suitable for manufacturing the above corrugated paperboard box, the present invention provides a perforation forming method for perforating a corrugated paperboard sheet comprising an outer linerboard, an inner linerboard, and a corrugated medium provided between the outer linerboard and the inner linerboard. The perforation forming method includes providing: a first reverse scoreline ring formed on an outer periphery of the first reverse scoreline ring with a groove, and a pair of groove shoulders arranged on two axial sides of the groove, respectively; and a second reverse scoreline ring formed on an outer periphery of the second reverse scoreline ring with a protrusion opposed to the groove of the first reverse scoreline ring and continuously extending in a circumferential direction, and a pair of recesses arranged on two axial sides of the protrusion, respectively. The first and second reverse scoreline rings are arranged on a side of the inner linerboard and on a side of the outer linerboard, respectively; and the first and second reverse scoreline rings sandwich the corrugated paperboard sheet, while the corrugated paperboard sheet is being fed, from the side of the inner linerboard and the side of the outer linerboard, respectively, such that a groove-shaped reverse scoreline recessed on the side of the outer linerboard is formed in the corrugated paperboard sheet by being sandwiched between the groove of the first reverse scoreline ring and the protrusion of the second reverse scoreline ring. A pair of groove-shaped recesses recessed on the side of the inner linerboard, and extending in parallel to each other so as to sandwich an area in which the reverse scoreline extends are formed in the corrugated paperboard sheet by being sandwiched between the groove shoulders of the first reverse scoreline ring and the recesses of the second reverse scoreline ring; and a perforated line is formed in one of the groove-shaped recesses with a perforation forming knife arranged on a downstream side of the first and second reverse scoreline rings, the perforated line comprising a plurality of cuts extending to penetrate through the inner linerboard, the corrugated medium, and the outer linerboard.

If such a perforation forming method is used, by sandwiching the corrugated paperboard sheet from the side of the outer linear board and the side of the inner linerboard, the first and second reverse scoreline rings can simultaneously form the reverse scoreline on the side of the outer linerboard, and the groove-shaped recesses on the side of the inner linerboard. Since the reverse scoreline and the groove-shaped recesses are first formed by the first and second reverse scoreline rings, and then the perforated line is formed by the perforation forming knife, arranged on the downstream side of the first and second reverse scoreline rings, it is possible to prevent the breakage of the perforated line due to the pressing force of the first and second reverse scoreline rings. Namely, if the perforated line is formed before the reverse scoreline is formed, the perforated line might break due to the pressing force of the first and second reverse scoreline rings. In contrast thereto, by forming the perforated line after the reverse scoreline is formed, it is possible to prevent the breakage of the perforated line due to the pressing force of the first and second reverse scoreline rings.

It is preferable that the perforation forming knife is configured to cut the corrugated paperboard sheet from the side of the inner linerboard toward the side of the outer linerboard.

By use of such a perforation forming knife, it is possible to form the perforated line such that the widths of the first cut portions of the perforated line on the side of the outer linerboard are smaller than those of the second cut portions thereof on the side of the inner linerboard, and also such that the peripheral edge portions of the first cut portions on the side of the outer linerboard have a protruding shape, and the peripheral edge portions of the second cut portions on the side of the inner linerboard have a recessed shape.

It is preferable that if the perforation forming knife comprises a disk-shaped knife formed on an outer periphery of the disk-shaped knife with a plurality of cutting portions protruding radially outwardly, and equidistantly spaced apart from each other, each of the cutting portions comprises a radially outer cutting edge, a front cutting edge in a rotation direction of the perforation forming knife, and a rear cutting edge in the rotation direction.

With this arrangement, it is possible to prevent the occurrence of cracks in the outer linerboard or in the inner linerboard due to the resistance generated when the cutting portions cut the corrugated paperboard sheet. As a result thereof, it is possible to effectively prevent the breakage of the perforated line.

A perforation forming device for perforating a corrugated paperboard sheet suitable for manufacturing the above corrugated paperboard box comprising an outer linerboard, an inner linerboard, and a corrugated medium provided between the outer linerboard and the inner linerboard. The perforation forming device includes a first reverse scoreline ring arranged on a side of the inner linerboard, and formed on an outer periphery of the first reverse scoreline ring with a groove, and a pair of groove shoulders arranged on two axial sides of the groove, respectively; a second reverse scoreline ring arranged on a side of the outer linerboard, and formed on an outer periphery of the second reverse scoreline ring with a protrusion opposed to the groove of the first reverse scoreline ring, and continuously extending in a circumferential direction, and a pair of recesses arranged on two axial sides of the protrusion, respectively. The pair of first and second reverse scoreline rings are configured to sandwich the corrugated paperboard sheet, while the corrugated paperboard sheet is being fed, from the side of the inner linerboard and the side of the outer linerboard, respectively, such that a groove-shaped reverse scoreline recessed on the side of the outer linerboard is formed in the corrugated paperboard sheet by being sandwiched between the groove of the first reverse scoreline ring and the protrusion of the second reverse scoreline ring, and such that a pair of groove-shaped recesses recessed on the side of the inner linerboard, and extending in parallel to each other so as to sandwich an area in which the reverse scoreline extends are formed in the corrugated paperboard sheet by being sandwiched between the groove shoulders of the first reverse scoreline ring and the recesses of the second reverse scoreline ring. A perforation forming knife is arranged on a downstream side of the first and second reverse scoreline rings, and is configured to form a perforated line in one of the groove-shaped recesses, the perforated line comprising a plurality of cuts extending to penetrate through the inner linerboard, the corrugated medium, and the outer linerboard.

If such a perforation forming device is used, by sandwiching the corrugated paperboard sheet from the side of the outer linear board and the side of the inner linerboard, the first and second reverse scoreline rings can simultaneously form the reverse scoreline on the side of the outer linerboard, and the groove-shaped recesses on the side of the inner linerboard. Since the reverse scoreline and the groove-shaped recesses are first formed by the first and second reverse scoreline rings, and then the perforated line is formed by the perforation forming knife, arranged on the downstream side of the first and second reverse scoreline rings, it is possible to prevent the breakage of the perforated line due to the pressing force of the first and second reverse scoreline rings. Namely, if the perforated line is formed before the reverse scoreline is formed, the perforated line might break due to the pressing force of the first and second reverse scoreline rings. In contrast thereto, by forming the perforated line after the reverse scoreline is formed, it is possible to prevent the breakage of the perforated line due to the pressing force of the first and second reverse scoreline rings.

It is preferable that the perforation forming knife is configured to cut the corrugated paperboard sheet from the side of the inner linerboard toward the side of the outer linerboard.

By use of such a perforation forming knife, it is possible to form the perforated line such that the widths of the first cut portions of the perforated line on the side of the outer linerboard are smaller than those of the second cut portions thereof on the side of the inner linerboard, and also such that the peripheral edge portions of the first cut portions on the side of the outer linerboard have a protruding shape, and the peripheral edge portions of the second cut portions on the side of the inner linerboard have a recessed shape.

It is preferable that if the perforation forming knife comprises a disk-shaped knife formed on an outer periphery of the disk-shaped knife with a plurality of cutting portions protruding radially outwardly, and equidistantly spaced apart from each other, each of the cutting portions comprises a radially outer cutting edge, a front cutting edge in a rotation direction of the perforation forming knife, and a rear cutting edge in the rotation direction thereof.

With this arrangement, it is possible to prevent the occurrence of cracks in the outer linerboard or in the inner linerboard due to the resistance generated when the cutting portions cut the corrugated paperboard sheet. As a result thereof, it is possible to effectively prevent the breakage of the perforated line.

In order to achieve the above object, the present invention provides a corrugated paperboard box made of corrugated paperboard comprising: an outer linerboard; an inner linerboard; a corrugated medium provided between the outer linerboard and the inner linerboard, the corrugated paperboard box comprising: a peripheral wall formed by bending the corrugated paperboard into a tubular shape such that the inner linerboard constitutes an inner surface of the corrugated paperboard box; and flaps integrally connected to one of two ends of the peripheral wall. The corrugated paperboard box is formed, at a boundary area between the peripheral wall and the flaps, with a groove-shaped reverse scoreline recessed on a side of the outer linerboard, and a perforated line along which the flaps can be separated from the peripheral wall, and which comprises a plurality of cuts extending to penetrate through the inner linerboard, the corrugated medium, and the outer linerboard, and the perforated line is formed within the reverse scoreline. Each of the cuts of the perforated line comprises a first cut portion formed in the outer linerboard, and a second cut portion formed in the inner linerboard, and the perforated line is formed such that widths of the first cut portions in an orthogonal direction to a direction in which the perforated line extends are smaller than widths of the second cut portions in the orthogonal direction.

With this arrangement, when the reverse scoreline is formed, a large load is applied to the outer linerboard, whereas when the perforated line is formed, a large load is applied to the inner linerboard on the opposite side of the outer linerboard. Namely loads do not concentrate on one of the outer and inner linerboards when the reverse scoreline and the perforated line are formed. Therefore, the perforated line is relatively less likely to break.

Preferably, the perforated line is formed such that each of the first cut portions on the side of the outer linerboard includes a peripheral edge portion having a protruding shape, and each of the second cut portions on a side of the inner linerboard includes a peripheral edge portion having a recessed shape.

With this arrangement, when the flaps are bent along the perforated line toward the inner surface of the peripheral wall, it is possible to effectively prevent the breakage of the perforated line due to the tension applied to the outer linerboard.

A perforation forming method is provided for perforating a corrugated paperboard sheet suitable for manufacturing the above corrugated paperboard box comprising an outer linerboard, an inner linerboard, and a corrugated medium provided between the outer linerboard and the inner linerboard. The perforation forming method comprises: a reverse scoreline forming step of forming in the corrugated paperboard sheet a groove-shaped reverse scoreline recessed on a side of the outer linerboard by sandwiching the corrugated paperboard sheet from the side of the outer linerboard and a side of the inner linerboard with a pair of reverse scoreline rings; and a perforation forming step of forming, after the reverse scoreline forming step, a perforated line in the reverse scoreline with a perforation forming knife, the perforated line comprising a plurality of cuts extending to penetrate through the inner linerboard, the corrugated medium, and the outer linerboard, wherein the perforation forming knife is configured to cut the corrugated paperboard sheet from the side of the inner linerboard toward the side of the outer linerboard.

If such a perforation forming method is used, since after the reverse scoreline rings form the reverse scoreline by sandwiching the corrugated paperboard sheet from the side of the outer linear board and the side of the inner linerboard, the perforation forming knife, arranged on the downstream side of the reverse scoreline rings, forms the perforated line, it is possible to prevent the breakage of the perforated line due to the pressing force of the reverse scoreline rings. Namely, if the perforated line is formed before the reverse scoreline is formed, the perforated line might break due to the pressing force of the reverse scoreline rings. In contrast thereto, if the perforated line is formed after the reverse scoreline is formed, it is possible to prevent the breakage of the perforated line due to the pressing force of the reverse scoreline rings. Since the perforation forming knife forms the perforated line by cutting the corrugated paperboard sheet from the side of the inner linerboard toward the side of the outer linerboard, it is possible to form the perforated line such that the widths of the first cut portions of the perforated line on the side of the outer linerboard are smaller than those of the second cut portions thereof on the side of the inner linerboard, and also such that the peripheral edge portions of the first cut portions on the side of the outer linerboard have a protruding shape, and the peripheral edge portions of the second cut portions on the side of the inner linerboard have a recessed shape.

It is preferable that if the perforation forming knife comprises a disk-shaped knife formed on an outer periphery of the disk-shaped knife with a plurality of cutting portions protruding radially outwardly, and spaced apart from each other at regular intervals, each of the cutting portions comprises a radially outer cutting edge, a front cutting edge in a rotation direction of the perforation forming knife, and a rear cutting edge in the rotation direction thereof.

With this arrangement, it is possible to prevent the occurrence of cracks in the outer linerboard or in the inner linerboard due to the resistance generated when the cutting portions cut the corrugated paperboard sheet. As a result thereof, it is possible to effectively prevent the breakage of the perforated line.

A perforation forming device for perforating a corrugated paperboard sheet suitable for manufacturing the above corrugated paperboard box comprises: an outer linerboard; an inner linerboard; and a corrugated medium provided between the outer linerboard and the inner linerboard. The perforation forming device comprising: a reverse scoreline forming device including a pair of reverse scoreline rings configured to sandwich the corrugated paperboard sheet from a side of the outer linerboard and a side of the inner linerboard, respectively so as to form in the corrugated paperboard sheet a groove-shaped reverse scoreline recessed on the side of the outer linerboard; and a perforation forming knife arranged on a downstream side of the reverse scoreline rings, and configured to form a perforated line in the reverse scoreline. The perforated line comprises a plurality of cuts extending to penetrate through the inner linerboard, the corrugated medium, and the outer linerboard, and the perforation forming knife is configured to cut the corrugated paperboard sheet from the side of the inner linerboard toward the side of the outer linerboard.

If such a perforation forming device is used, since after the reverse scoreline rings form the reverse scoreline by sandwiching the corrugated paperboard sheet from the side of the outer linear board and the side of the inner linerboard, the perforation forming knife, arranged on the downstream side of the reverse scoreline rings, forms the perforated line, it is possible to prevent the breakage of the perforated line due to the pressing force of the reverse scoreline rings. Namely, if the perforated line is formed before the reverse scoreline is formed, the perforated line might break due to the pressing force of the reverse scoreline rings. In contrast thereto, if the perforated line is formed after the reverse scoreline is formed, it is possible to prevent the breakage of the perforated line due to the pressing force of the reverse scoreline rings. Since the perforation forming knife forms the perforated line by cutting the corrugated paperboard sheet from the side of the inner linerboard toward the side of the outer linerboard, it is possible to form the perforated line such that the widths of the first cut portions of the perforated line on the side of the outer linerboard are smaller than those of the second cut portions thereof on the side of the inner linerboard, and also such that the peripheral edge portions of the first cut portions on the side of the outer linerboard have a protruding shape, and the peripheral edge portions of the second cut portions on the side of the inner linerboard have a recessed shape.

It is preferable that if the perforation forming knife comprises a disk-shaped knife formed on an outer periphery of the disk-shaped knife with a plurality of cutting portions protruding radially outwardly, and spaced apart from each other at regular intervals, each of the cutting portions comprises a radially outer cutting edge, a front cutting edge in a rotation direction of the perforation forming knife, and a rear cutting edge in the rotation direction thereof.

With this arrangement, it is possible to prevent the occurrence of cracks in the outer linerboard or in the inner linerboard due to the resistance generated when the cutting portions cut the corrugated paperboard sheet. As a result thereof, it is possible to effectively prevent the breakage of the perforated line.

In order to achieve the above object, the present invention provides a corrugated paperboard box made of corrugated paperboard comprising an outer linerboard, an inner linerboard, a corrugated medium provided between the outer linerboard and the inner linerboard. The corrugated paperboard box comprises a peripheral wall formed by bending the corrugated paperboard into a tubular shape such that the inner linerboard constitutes an inner surface of the corrugated paperboard box; and flaps integrally connected to one of two ends of the peripheral wall. The corrugated paperboard box is formed, between the peripheral wall and the flaps, with a groove-shaped normal scoreline recessed on a side of the inner linerboard so that the flaps can be bent along the normal scoreline toward an inner surface of the peripheral wall. The corrugated paperboard box is further formed with a perforated line which is located within the normal scoreline, and along which the flaps can be separated from the peripheral wall, and the corrugated paperboard box is further formed, at a position spaced apart from the normal scoreline toward the flaps, with a groove-shaped reverse scoreline extending in parallel to the normal scoreline, and recessed on a side of the outer linerboard so that the flaps can be bent along the reverse scoreline toward an outer surface of the peripheral wall.

With this arrangement, since the normal scoreline and the perforated line are formed between the peripheral wall and the flaps such that the perforated line is located within the normal scoreline, it is possible to smoothly separate the flaps along the normal scoreline and the perforated line from the peripheral wall. Since the reverse scoreline, formed at a position spaced apart from the normal scoreline toward the flaps, is a groove-shaped scoreline recessed on the side of the outer linerboard, when the flaps are bent toward the outer surface of the peripheral wall (i.e., bent in the reverse direction), the flaps are not bent along the normal scoreline, in which the perforated line is formed, but bent along the reverse scoreline, in which no perforated line is formed.

Therefore, when products are packed in the box, it is possible to prevent the box from breaking along the perforated line between the peripheral wall and the flaps.

It is preferable that a depth of the reverse scoreline is equal to or larger than a depth of the normal scoreline.

With this arrangement, when the flaps are bent toward the outer surface of the peripheral wall, the flaps are not bent along the normal scoreline, and can be more reliably bent along the reverse scoreline.

It is preferable that the reverse scoreline is arranged such that a distance between a center of the normal scoreline and a center of the reverse scoreline is set within 5 mm to 20 mm.

With this arrangement, since the distance between the center of the normal scoreline and the center of the reverse scoreline is set to be 5 mm or over, when the flaps are bent toward the outer surface of the peripheral wall, the flaps are not bent simultaneously along both the normal scoreline and the reverse scoreline. Since the distance therebetween is set to be 20 mm or less, it is possible to effectively prevent the flaps from being bent not along the reverse scoreline but along the normal scoreline when the flaps are bent toward the outer surface of the peripheral wall.

As a perforation forming method for perforating a corrugated paperboard sheet suitable for manufacturing the above corrugated paperboard box, the present invention provides a perforation forming method for perforating a corrugated paperboard sheet comprising an outer linerboard, an inner linerboard, a corrugated medium provided between the outer linerboard and the inner linerboard, the perforation forming method comprising: a scoreline forming step of forming in the corrugated paperboard sheet a groove-shaped normal scoreline recessed on a side of the inner linerboard, and a groove-shaped reverse scoreline recessed on a side of the outer linerboard such that the normal scoreline and the reverse scoreline extend in parallel to each other while spaced apart from each other; and a perforation forming step of forming a perforated line in the normal scoreline such that the perforated line extends in a same direction as the normal scoreline, while located within the normal scoreline. After the normal scoreline is formed in the scoreline forming step, the perforated line is formed in the perforation forming step.

If such a perforation forming device is used, since after the normal scoreline is formed, the perforated line is formed in the normal scoreline, it is possible to prevent the inner linerboard from breaking along the perforated line due to the pressing force applied when the normal scoreline is formed. Namely, if the perforated line were first formed, and then the normal scoreline were formed on the perforated line, the inner linerboard might break along the perforated line due to the pressing force applied when the normal scoreline is formed. In contrast thereto, by forming the normal scoreline first, and then forming the perforated line in the normal scoreline, since the corrugated paperboard is collapsed at the normal scoreline before the perforated line is formed, it is possible form the normal scoreline and the perforated line such that the inner linerboard does not break and such that the perforated line is located within the normal scoreline.

It is preferable that after the reverse scoreline is formed in the scoreline forming step, the perforated line is formed in the perforation forming step.

In this way, if the reverse scoreline is first formed in the scoreline forming step, and then the perforated line is formed in the perforation forming step, it is possible to prevent the outer linerboard from breaking along the perforated line due to the tension applied to the outer linerboard when the reverse scoreline is formed. Namely, if the perforated line were first formed, and then the reverse scoreline were formed, the outer linerboard might break along the perforated line due to the tension applied to the outer linerboard when the reverse scoreline is formed. In contrast thereto, if the reverse scoreline is first formed, and then the perforated line is formed, it is possible to form the reverse scoreline and the perforated line such that the outer linerboard does not break.

As a perforation forming unit suitable for manufacturing a corrugated paperboard sheet from which the above corrugated paperboard box is formed, the present invention provides a perforation forming unit for perforating a corrugated paperboard sheet comprising an outer linerboard, an inner linerboard, and a corrugated medium provided between the outer linerboard and the inner linerboard, the perforation forming unit comprising: a scoreline forming device including normal scoreline rings configured to form in the corrugated paperboard sheet a groove-shaped normal scoreline recessed on a side of the inner linerboard, and reverse scoreline rings configured to form in the corrugated paperboard sheet a groove-shaped reverse scoreline recessed on a side of the outer linerboard so as to extend in parallel to, while spaced apart from, the normal scoreline; and a perforation forming device configured to form a perforated line located within, and extending in a same direction as, the normal scoreline, wherein the perforation forming device includes a disk-shaped, perforation forming knife arranged on a downstream side of the normal scoreline rings so that after the normal scoreline is formed, the perforated line is formed.

Since this perforation forming unit is configured such that the normal scoreline rings first form the normal scoreline, and then the perforation forming knife, arranged on the downstream side of the normal scoreline rings, forms the perforated line, it is possible to prevent the inner linerboard from breaking along the perforated line due to the pressing force applied when the normal scoreline is formed. Namely, if the perforation forming knife were arranged on the upstream side of the normal scoreline rings, the perforation forming knife would first form the perforated line, and then the normal scoreline rings would form the normal scoreline on the perforated line, so that the inner linerboard might break along the perforated line due to the pressing force applied when the normal scoreline is formed. In contrast thereto, if the perforation forming knife is arranged on the downstream side of the normal scoreline rings, it is possible to form the normal scoreline and the perforated line such that the inner linerboard does not break.

It is preferable that the perforation forming knife is arranged on a downstream side of the reverse scoreline rings so that after the reverse scoreline is formed, the perforated line is formed.

With this arrangement, since the reverse scoreline rings first form the reverse scoreline, and then the perforation forming knife, arranged on the downstream side of the reverse scoreline rings, forms the perforated line, it is possible to prevent the outer linerboard from breaking along the perforated line due to the tension applied to the outer linerboard when the reverse scoreline is formed. Namely, if the perforation forming knife were arranged on the upstream side of the reverse scoreline rings, the perforation forming knife would first form the perforated line, and then the reverse scoreline rings would form the reverse scoreline, so that the outer linerboard might break along the perforated line due to the tension applied to the outer linerboard when the reverse scoreline is formed. In contrast thereto, if the perforation forming knife is arranged on the downstream side of the reverse scoreline rings, it is possible to form the reverse scoreline and the perforated line such that the outer linerboard does not break.

The above perforation forming unit may be provided at a midway portion of a corrugator configured to manufacture a corrugated paperboard sheet, or may be provided as a part of a cutting machine configured to cut sheets cut off from the corrugated paperboard sheet by the corrugator.

The perforation forming unit provided at a midway portion of a corrugator configured to manufacture a corrugated paperboard sheet may be configured such that the scoreline forming device is a scorer which is a portion of a corrugator, wherein the corrugated paperboard sheet is a continuously extending strip-shaped member, wherein the scorer is configured to form the normal scoreline in the corrugated paperboard sheet, wherein the scorer includes the normal scoreline rings and the reverse scoreline rings, and wherein the perforation forming device is mounted to the scorer.

The perforation forming unit provided as a part of a cutting machine configured to cut sheets cut off from the corrugated paperboard sheet by the corrugator may be configured such that the scoreline forming device is a cutting machine configured to cut a cut sheet cut off from the corrugated paperboard sheet to a predetermined width size, wherein the cutting machine includes the normal scoreline rings and the reverse scoreline rings, and wherein the perforation forming device is mounted to the cutting machine.

Effects of the Invention

The corrugated paperboard box according to the present invention is configured such that when the flaps are bent, the perforated line, along which the flaps can be separated from the box, is less likely to break.

DETAILED DESCRIPTION OF THE INVENTION

Figure 1:
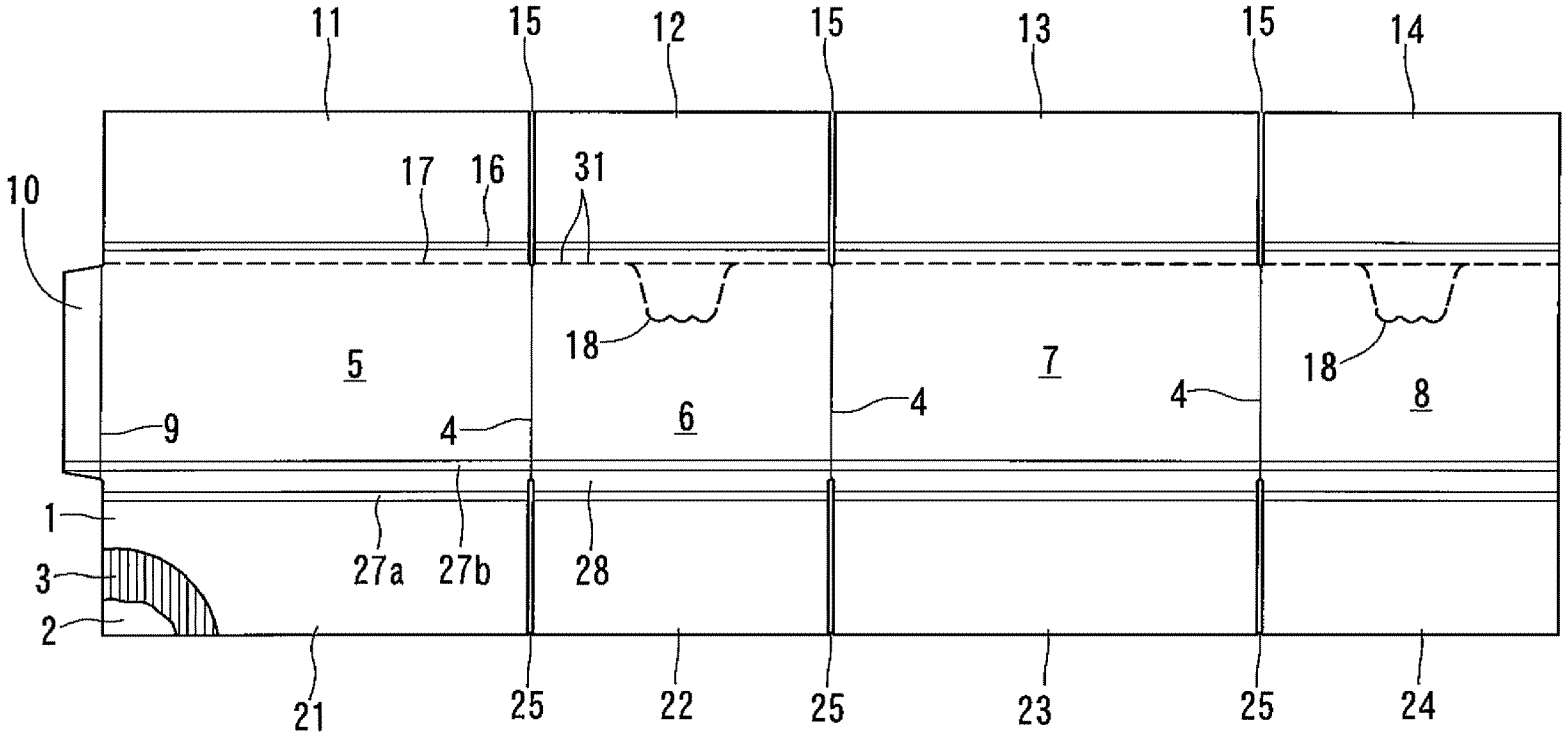
FIG. 1 is a view of the blank of a corrugated paperboard box according to a first embodiment of the present invention, when seen from the side of the outer linerboard (of the blank).
Figure 8:
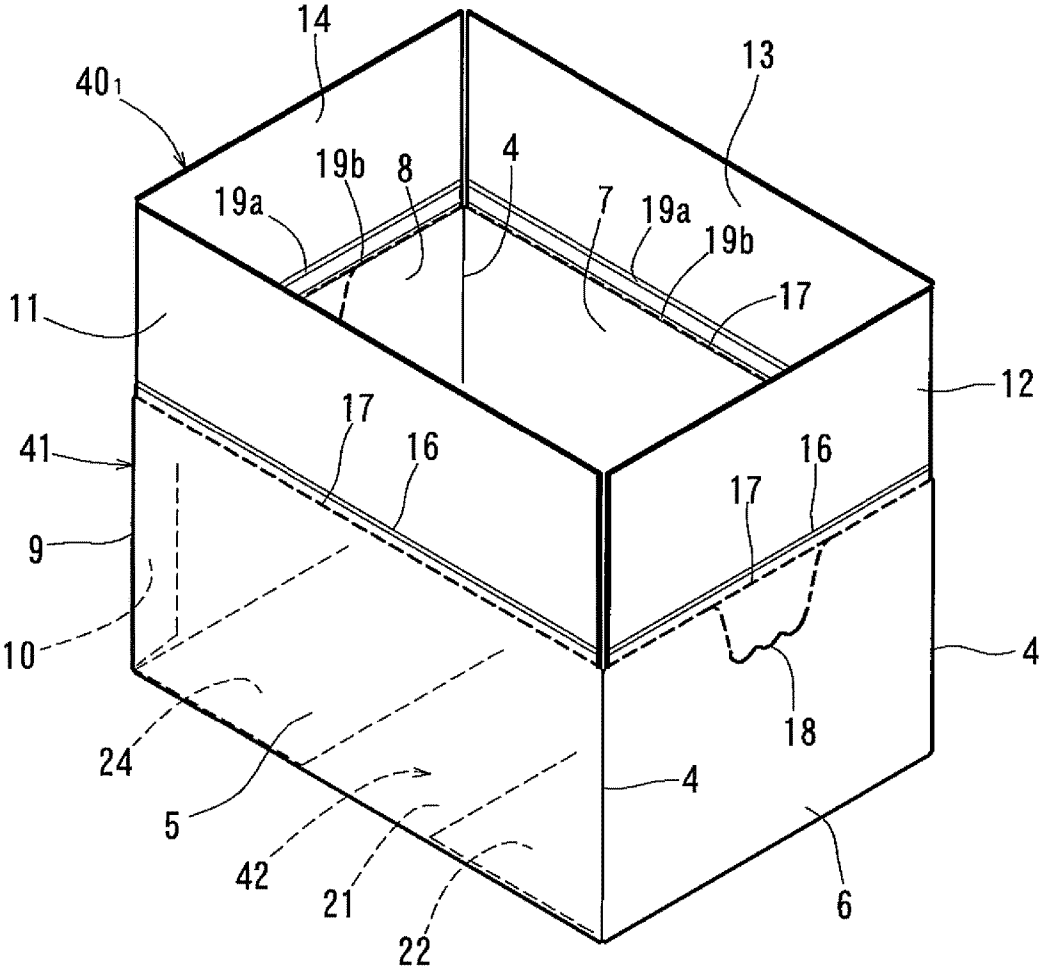
FIG. 8 is a perspective view of the corrugated paperboard box which has been partially constructed from the blank of FIG. 1, namely, of which the top flaps have not been bent yet.

FIG. 1 illustrates the blank of a corrugated paperboard box $\mathbf{40}_1$ (see FIG. 8) according to the first embodiment of the present invention. The blank is made of corrugated paperboard including an outer linerboard 1, an inner linerboard 2, and a corrugated medium 3 provided between the outer linerboard 1 and the inner linerboard 2. This blank includes quadrangular side panels 5, 6, 7 and 8 which are integrally connected one to another through respective scorelines 4 extending in the direction parallel to the corrugations of the corrugated paperboard, and a joint flap 10 integrally connected through a scoreline 9 to the side edge of the side panel 5, located at one end portion of the blank. As illustrated in FIG. 8, when the corrugated paperboard box $\mathbf{40}_1$ is constructed from the blank, the side panels 5, 6, 7 and 8 constitute the peripheral wall 41 of the corrugated paperboard box $\mathbf{40}_1$.

As illustrated in FIG. 1, the blank of the corrugated paperboard box $\mathbf{40}_1$ further includes top flaps 11, 12, 13 and 14 integrally connected to the respective upper edges of the side panels 5, 6, 7 and 8. The top flaps 11, 12, 13 and 14 are separated from each other by slits 15 formed between the respective adjacent pairs of top flaps 11, 12, 13 and 14 to extend in the direction parallel to the corrugations of the corrugated paperboard.

At the boundary area between the top flaps 11, 12, 13 and 14 and the side panels 5, 6, 7 and 8, the blank of the box $\mathbf{40}_1$ is formed with a groove-shaped reverse scoreline 16 recessed on the side of the outer linerboard 1 so that the top flaps 11, 12, 13 and 14 can be bent along the reverse scoreline 16 toward the outer linerboard 1 (i.e. toward the outer surface of the peripheral wall 41 illustrated in FIG. 8), and with a perforated line 17 along which the top flaps 11, 12, 13 and 14 can be separated from the peripheral wall 41. The reverse scoreline 16 and the perforated line 17 extend in the direction perpendicular to the corrugations of the corrugated paperboard.

The reverse scoreline 16 is formed at a position displaced from the proximal ends (roots) of the top flaps 11, 12, 13 and 14 (i.e., displaced from the straight line connecting the terminal ends of the slits 15) toward the distal ends of the top flaps 11, 12, 13 and 14.

The perforated line 17 coincides in position with the roots of the top flaps 11, 12, 13 and 14. As used herein, the word "coincides" does not require that the perforated line 17 completely and strictly coincide in position with the roots of the top flaps 11, 12, 13 and 14 in the mathematical sense, but should be understood to permit a manufacturing error of, for example, about 1 mm.

The side panels 6 and 8 are each formed with an opening assisting cut line 18 having a central portion located at a lower level than the perforated line 17, and connected at both ends thereof to the perforated line 17.

The blank of the box $\mathbf{40}_1$ further includes bottom flaps 21, 22, 23 and 24 integrally connected to the respective lower edges of the side panels 5, 6, 7 and 8. The bottom flaps 21, 22, 23 and 24 are separated from each other by slits 25 formed between the respective adjacent pairs of bottom flaps 21, 22, 23 and 24 to extend in the direction parallel to the corrugations of the corrugated paperboard.

As illustrated in FIGS. 3(A) and 3(B), at the boundary area between the top flaps 11, 12, 13 and 14 and the side panels 5, 6, 7 and 8, the blank of the box $\mathbf{40}_1$ is formed with a pair of groove-shaped recesses 19*a* and 19*b* recessed on the side of the inner linerboard 2, and extending in parallel to each other so as to sandwich the area in which the reverse scoreline 16 extends. Between the pair of groove-shaped recesses 19*a* and 19*b*, a protrusion 20 having a circular arc section is formed on the side of the inner linerboard 2 at the boundary area between the top flaps 11, 12, 13 and 14 and the side panels 5, 6, 7 and 8 so as to correspond in position to, and extend in the same direction as, the reverse scoreline 16 on the side of the outer linerboard 1

The second groove-shaped recess 19*b*, which is more remote from the distal ends of the top flaps 11, 12, 13 and 14 than is the first groove-shaped recess 19*a*, is formed and arranged such that the terminal ends of the slits 15 exist within the second groove-shaped recess 19*b*. Namely, the groove-shaped recess 19*b* is arranged to coincide in position with the roots of the top flaps 11, 12, 13 and 14, illustrated in FIG. 1.

Figure 3:
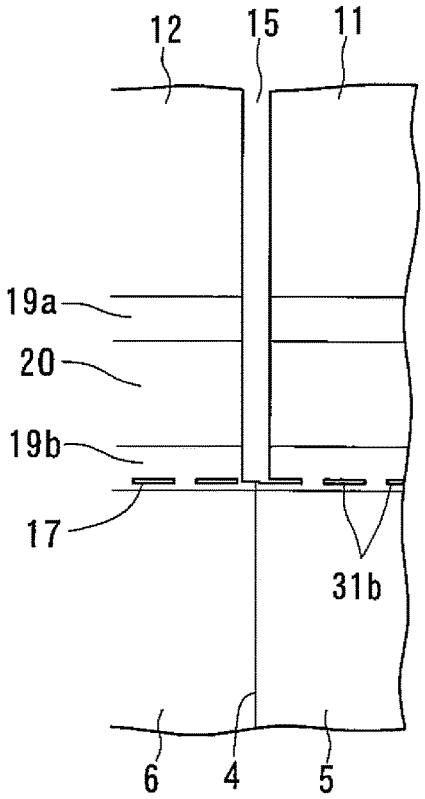
FIG. 3(A) is an enlarged view illustrating the vicinity of the perforated line illustrated in FIG. 2, when seen from the side of the inner linerboard (of the blank).
FIG. 3(B) is an enlarged sectional view taken along line IIIB-IIIB of FIG. 2.
FIG. 3(C) is an enlarged view illustrating the vicinity of the perforated line illustrated in FIG. 2, when seen from the side of the outer linerboard.
Figure 3:
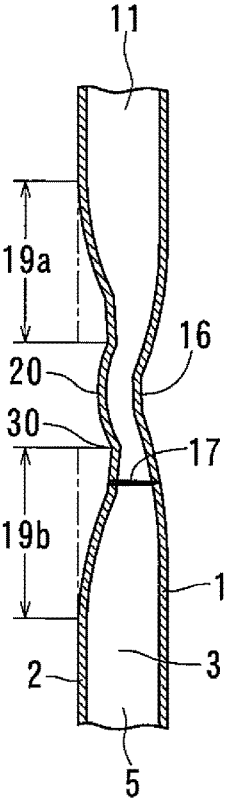
Figure 3:
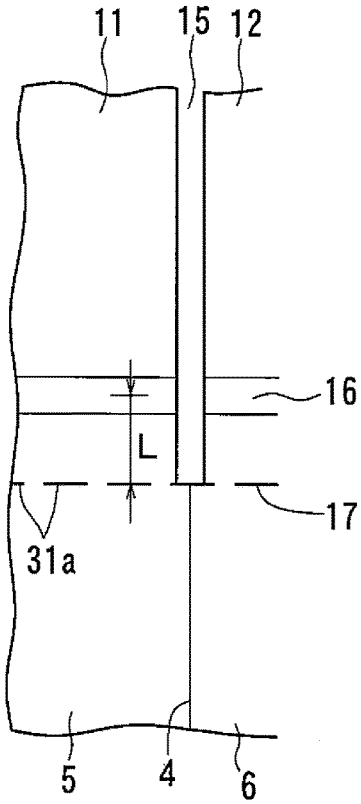
Figure 4:
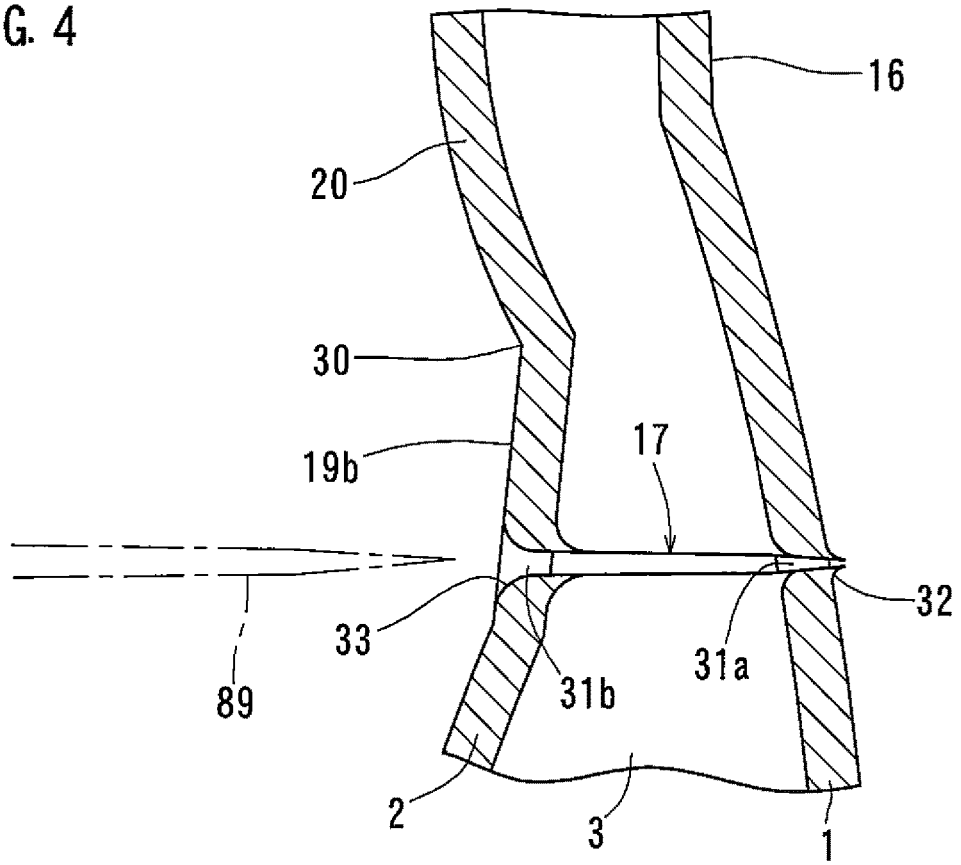
FIG. 4 is an enlarged view of the perforated line illustrated in FIG. 3(B).

As illustrated in FIG. 4, the second groove-shaped recess 19*b* is formed such that the recess 19*b* is the deepest at the boundary 30 between the recess 19*b* and the protrusion 20, and the farther away from the protrusion 20, the shallower the recess 19*b* is. The groove-shaped recess 19*b* comprises: a first area with which, when the corrugated paperboard is sandwiched by the below-described pair of first and second reverse scoreline rings 67 and 68 (see FIG. 16), an area D of one groove shoulder 73 of the ring 67 comes into contact (the area D comprising a cylindrical surface and constituting the largest outer diameter of the one groove shoulder 73); and a second area which is located outside of the first area, and in which the thickness of the corrugated paperboard is decreased by being sandwiched and pulled by the reverse scoreline rings 67 and 68 (see FIG. 3(B)). The second groove-shaped recess 19*b* is formed such that the distance between the deepest portion of the recess 19*b* (i.e., the boundary 30 between the recess 19*b* and the protrusion 20) and the center of the protrusion 20 is 3.0 mm to 5.0 mm. The first groove-shaped recess 19*a* is also formed in the same manner as the second groove-shaped recess 19*b*. Though the perforated line 17 may be formed anywhere in the second groove-shaped recess 19*b*, it is preferable that the perforated line 17 is formed in the above-mentioned first area of the recess 19*b* (i.e., the strip-shaped area with which the area D of the one groove shoulder 73 of the ring 67 (see FIG. 16) has been brought into contact) so that the contact trace of the ring 67 exists, or is formed in the area located outside of, and within 2.0 mm (more preferably within 1.0 mm) from the first area of the recess 19*b*.

Figure 2:
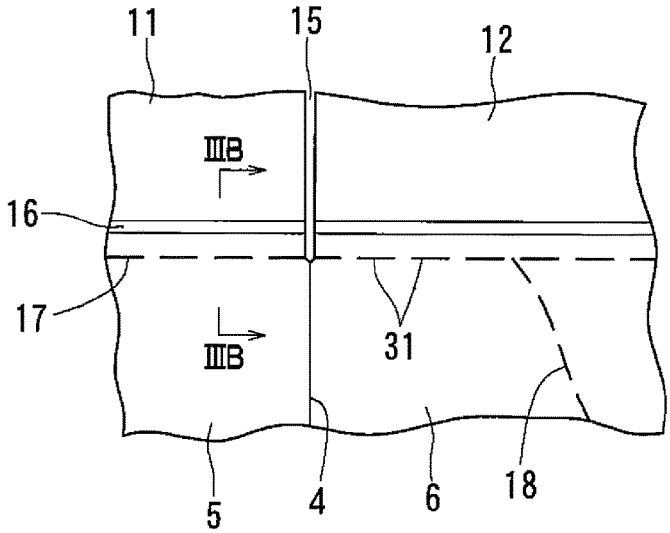
FIG. 2 is a partially enlarged view of the boundary area between the top flaps and the side panels illustrated in FIG. 1.

As illustrated in FIG. 2, the perforated line 17 comprises multiple cuts 31 spaced apart from each other at predetermined intervals. The cuts 31 are in the form of slits aligned in a straight line extending in parallel to the reverse scoreline 16. The cuts 31 extend to penetrate through the inner linerboard 2, the corrugated medium 3, and the outer linerboard 1 (see FIG. 5).

As illustrated in FIG. 3(A), the perforated line 17 is formed in the groove-shaped recess 19*b*, which is more remote from the distal ends of the top flaps 11, 12, 13 and 14 than is the recess 19*a*. As illustrated in FIG. 3(C), the distance L between the center of the perforated line 17 and the center of the reverse scoreline 16 is set within the range of 4.5 to 8.0 mm (preferably 5.0 to 7.0 mm). As illustrated in FIGS. 3(A) and 3(C), each of the cuts 31, constituting the perforated line 17, includes a first cut portion 31*a* formed in the outer linerboard 1, and a second cut portion 31*b* formed in the inner linerboard 2, and is formed such that the width of the cut portion 31*a* in the orthogonal direction to the direction in which the perforated line 17 extends is smaller than that of the cut portion 31*b* in the orthogonal direction.

As illustrated in FIG. 4, the perforated line 17 is formed such that each cut portion 31*a* on the side of the outer linerboard 1 includes a peripheral edge portion 32 having a protruding shape, namely protruding from the surface of the outer linerboard 1, and each cut portion 31*b* on the side of the inner linerboard 2 includes a peripheral edge portion 33 having a recessed shape, namely recessed from the surface of the inner linerboard 2 toward the corrugated medium 3. It is possible to form such a perforated line 17 by cutting the blank from the side of the inner linerboard 2 toward the side of the outer linerboard 1 by means of a perforation forming knife 89.

Figure 5:
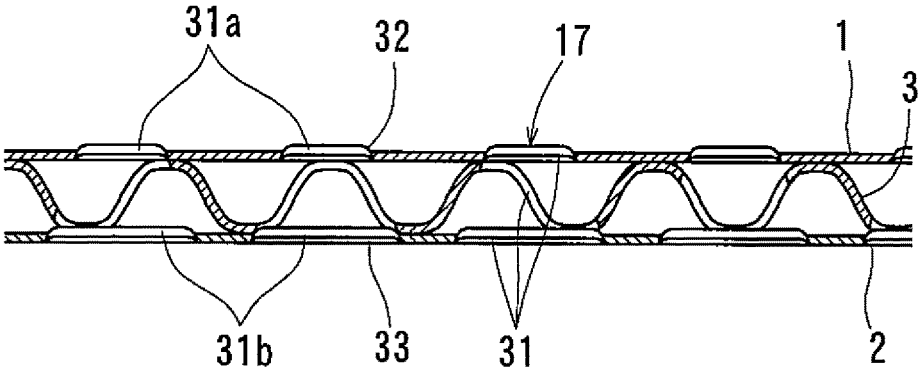
FIG. 5 is an enlarged sectional view taken along the perforated line illustrated in FIG. 2.
Figure 6:
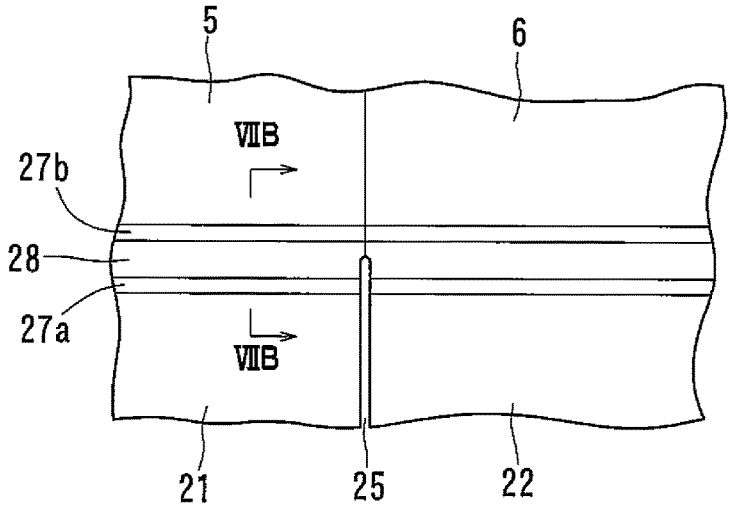
FIG. 6 is a partially enlarged view of the boundary area between the bottom flaps and the side panels illustrated in FIG. 1.
Figure 7:
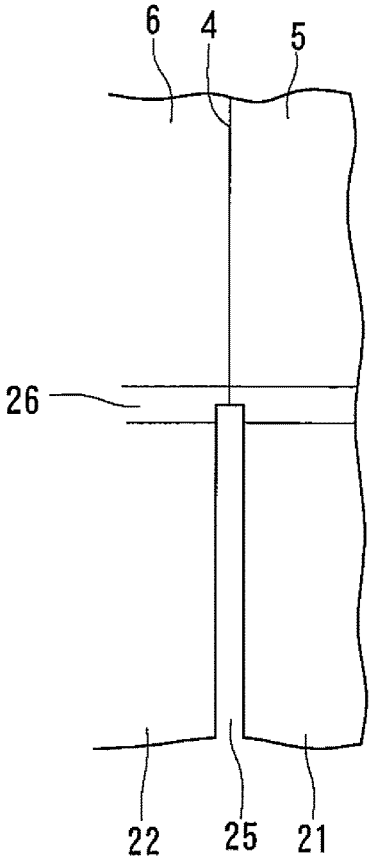
FIG. 7(A) is an enlarged view illustrating the vicinity of the groove-shaped recess illustrated in FIG. 6, when seen from the inner linerboard side.
FIG. 7(B) is an enlarged sectional view taken along line VIIB-VIIB of FIG. 2.
FIG. 7(C) is an enlarged view illustrating the vicinity of the groove-shaped recess illustrated in FIG. 2, when seen from the outer linerboard side.
Figure 7:
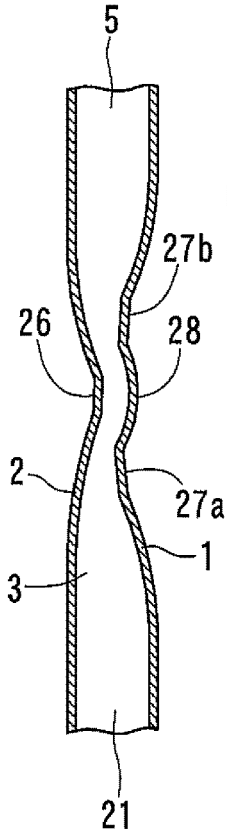
Figure 7:
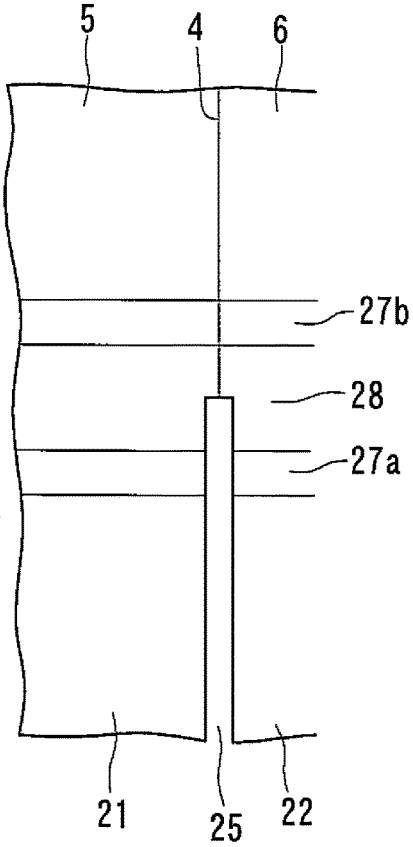

As illustrated in FIG. 5, each cut portion 31*a* on the side of the outer linerboard 1 is aligned in the thickness direction of the blank with the corresponding cut portion 31*b* on the side of the inner linerboard 2. The length of the joint portion between each adjacent pair of cut portions 31*a* on the side of the outer linerboard 1 is set within 2 mm to 4 mm (preferably 2.5 mm to 3.5 mm).

As illustrated in FIGS. 1, 6, 7(A), 7(B) and 7(C), at the boundary area between the bottom flaps 21, 22, 23 and 24 and the side panels 5, 6, 7 and 8, the blank of the box $\mathbf{40}_1$ is formed with a groove-shaped normal scoreline 26 recessed on the side of the inner linerboard 2 so that the bottom flaps 21, 22, 23 and 24 can be bent along the normal scoreline 26 toward the inner linerboard 2 (i.e. toward the inner surface of the peripheral wall 41 illustrated in FIG. 8), and with a pair of groove-shaped recesses 27*a* and 27*b* recessed on the side of the outer linerboard 1, and extending in parallel to each other so as to sandwich the area in which the normal scoreline 26 extends.

As illustrated in FIG. 7(A), the normal scoreline 26 is formed and arranged such that the terminal ends of the slits 25 exist within the normal scoreline 26. Namely, the normal scoreline 26 is arranged so as to coincide in position with the roots of the bottom flaps 21, 22, 23 and 24 illustrated in FIG. 1.

As illustrated in FIG. 7(B), between the pair of groove-shaped recesses 27*a* and 27*b*, a protrusion 28 having a circular arc-shaped section is formed on the side of the outer linerboard 1 at the boundary area between the bottom flaps 21, 22, 23 and 24 and the side panels 5, 6, 7 and 8 so as to correspond in position to, and extend in the same direction as, the normal scoreline 26 on the side of the inner linerboard 2.

As illustrated in FIG. 7(C), the first groove-shaped recess 27*a*, which is closer to the distal ends of the bottom flaps 21, 22, 23 and 24 than is the recess 27*b*, is formed at a position displaced from the terminal ends of the slits 25 toward the distal ends of the bottom flaps 21, 22, 23 and 24, and the groove-shaped recess 27*b*, more remote from the distal ends of the bottom flaps 21, 22, 23 and 24, is formed at the position displaced from the terminal ends of the slits 25 in the direction away from the distal ends of the bottom flaps 21, 22, 23 and 24.

For example, the blank illustrated in FIG. 1 can be formed into the box $\mathbf{40}_1$ as described below.

As illustrated in FIG. 8, first, the side panels 5, 6, 7 and 8 are bent along the respective scorelines 4 into a tubular shape such that the inner linerboard 2 is inside of the corrugated paperboard box $\mathbf{40}_1$, and the joint flap 10, integrally connected to the side panel 5 at one end of the blank, is bonded to the inner surface of the side panel 8 at the other end of the blank so that the side panels 5, 6, 7 and 8 constitute the peripheral wall 41. Second, the bottom flaps 22 and 24, which are integrally connected to the respective lower edges of the side panels 6 and 8, which correspond to or constitute the widthwise surfaces of the box $\mathbf{40}_1$, are bent along the normal scoreline 26 toward the inner surface of the peripheral wall 41, and the bottom flaps 21 and 23, which are integrally connected to the respective lower edges of the side panels 5 and 7, which correspond to or constitute the lengthwise surfaces of the box $\mathbf{40}_1$, are bent along the normal scoreline 26 toward the inner surface of the peripheral wall 41 such that the bottom flaps 21, 22, 23 and 24 constitute a bottom 42 that closes the lower end opening of the peripheral wall 41.

In this state, products 43 (see FIG. 9) are packed in the corrugated paperboard box $\mathbf{40}_1$. At this time, if the top flaps 11, 12, 13 and 14 extend upright at a higher level than the peripheral wall 41 as illustrated in FIG. 8, the top flaps 11, 12, 13 and 14 will make it difficult, though not make it impossible, to place the products 43 into the box $\mathbf{40}_1$ by hand. Also, when products 43 are to be automatically placed into the box $\mathbf{40}_1$ by a packing machine called an "auto-caser", if the top flaps 11, 12, 13 and 14 are tilted even slightly toward the inner surface of the peripheral wall 41, products 43 might interfere with the distal ends of the top flaps 11, 12, 13 and 14 when placed into the box $\mathbf{40}_1$.

Figure 9:
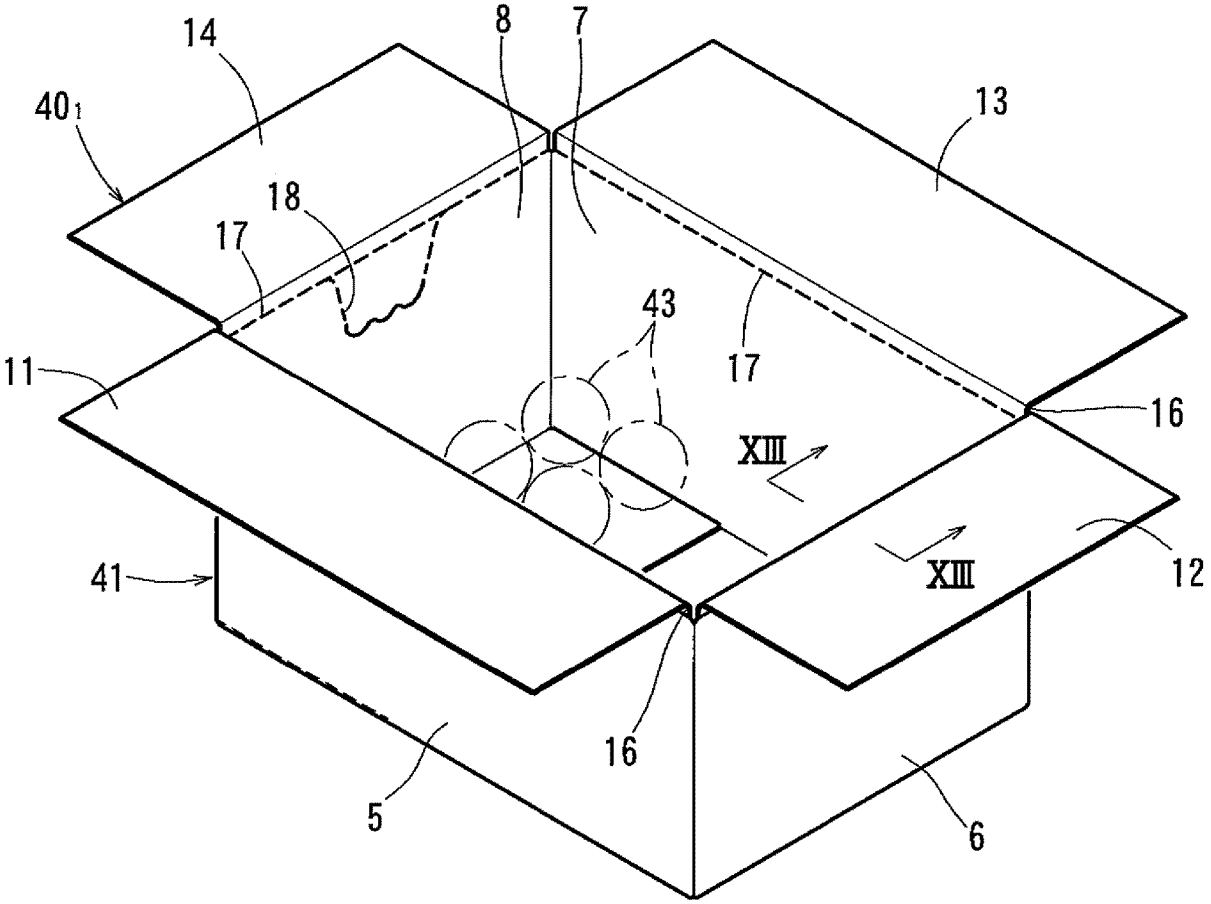
FIG. 9 is a perspective view of the corrugated paperboard box of which the top flaps illustrated in FIG. 8 have been bent toward the outer surface of the peripheral wall (of the box), and in which products have been placed.

Therefore, in order to enable products 43 to be easily placed into the corrugated paperboard box $\mathbf{40}_1$, the top flaps 11, 12, 13 and 14 are bent toward the outer surface of the peripheral wall 41 (i.e., bent outwardly) as illustrated in FIG. 9.

Since the groove-shaped recesses 19*a* and 19*b* are recessed on the side of the inner linerboard 2 as illustrated in FIG. 3(B), the top flaps 11, 12, 13 and 14 can be bent with a relatively small force along the recesses 19*a* and 19*b* toward the inner linerboard 2, whereas a relatively large force is required to bend the top flaps 11, 12, 13 and 14 along the recesses 19*a* and 19*b* toward the outer linerboard 1. On the other hand, because the groove-shaped reverse scoreline 16 is recessed on the side of the inner linerboard 1, the top flaps 11, 12, 13 and 14 can be bent with a relatively small force along the reverse scoreline 16 toward the outer linerboard 1, whereas a relatively large force is required to bend the top flaps 11, 12, 13 and 14 along the reverse scoreline 16 toward the inner linerboard 2.

Figure 13:
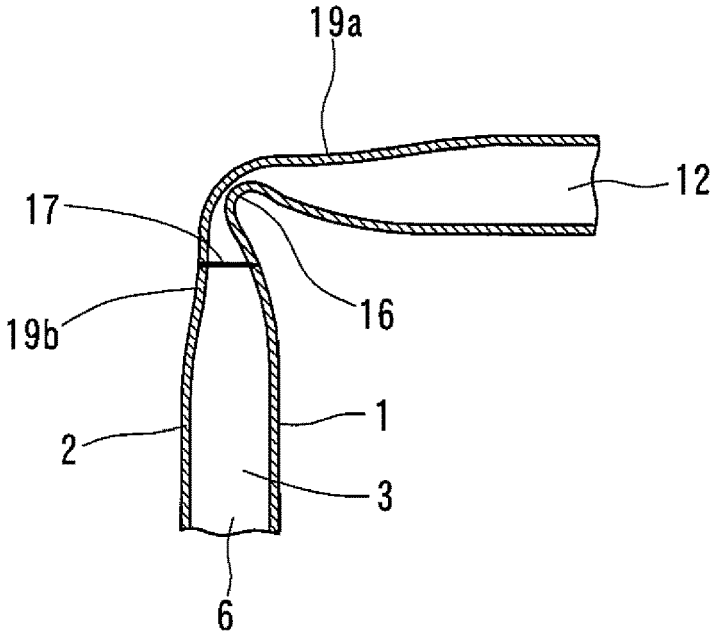
FIG. 13 is a sectional view taken along line XIII-XIII of FIG. 9.

Therefore, when the top flaps 11, 12, 13 and 14 are bent toward the outer surface of the peripheral wall 41 (i.e. toward the outer linerboard 1) as illustrated in FIG. 9, the top flaps 11, 12, 13 and 14 are bent not along the groove-shaped recesses 19*a* and 19*b* but along the reverse scoreline 16 (see FIG. 13).

Though, in FIG. 9, all of the top flaps 11, 12, 13 and 14 are bent toward the outer linerboard 1, only any one of the top flaps 11, 12, 13 and 14 (e.g., one in front of a user packing products in the box) may be bent toward the outer linerboard 1.

Figure 10:
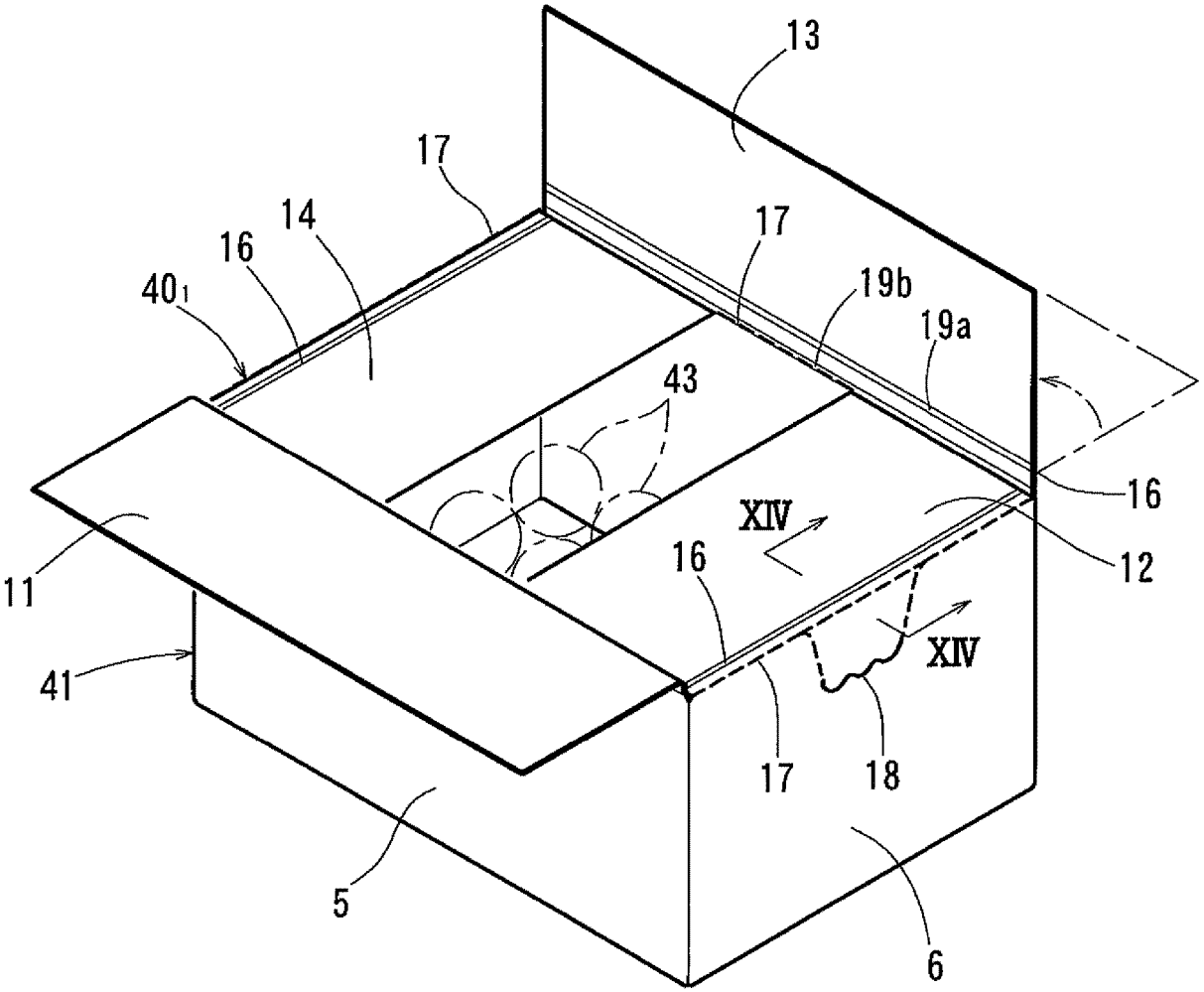
FIG. 10 is a perspective view of the corrugated paperboard box, the view illustrating the process of bending the top flaps of FIG. 9 toward the inner surface of the peripheral wall.
Figure 11:
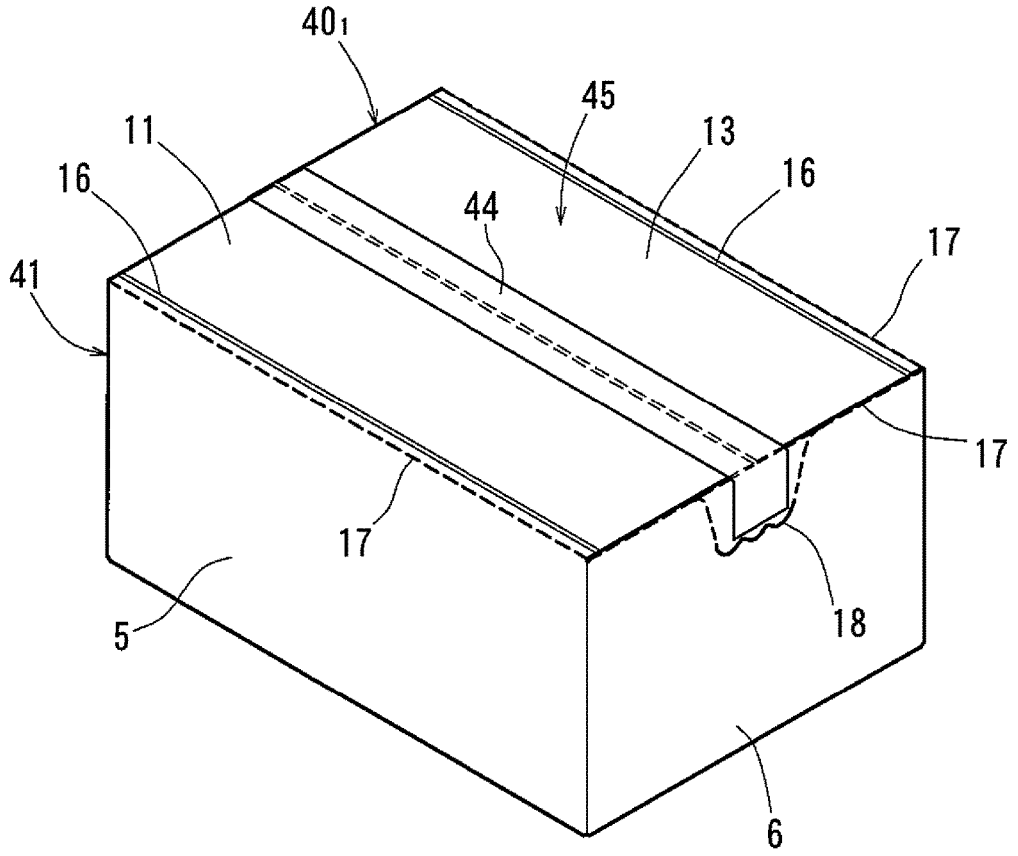
FIG. 11 is a perspective view of the corrugated paperboard box which has been sealed by closing the upper end opening of the peripheral wall by the top flaps of FIG. 10.
Figure 14:
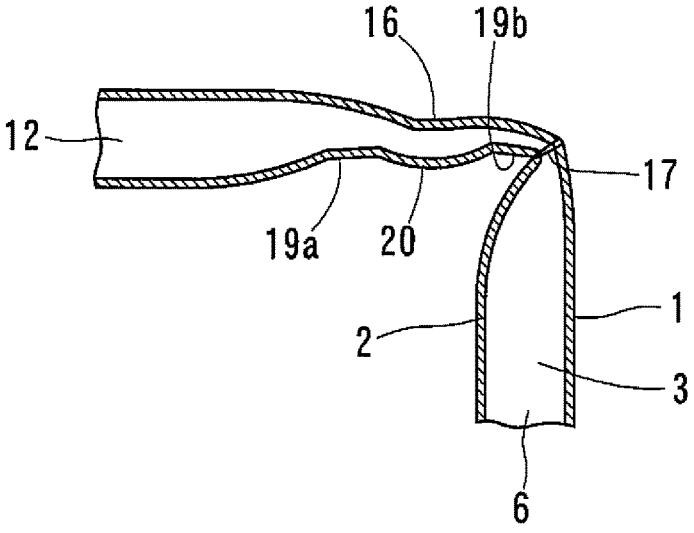
FIG. 14 is a sectional view taken along line XIV-XIV of FIG. 10.

Thereafter, the top flaps 11, 12, 13 and 14 are bent toward the inner surface of the peripheral wall 41 (i.e., bent inwardly) as illustrated in FIGS. 10 and 11. At this time, due to the above characteristics of the groove-shaped recesses 19*a* and 19*b* and the reverse scoreline 16 illustrated in FIG. 3(B), the top flaps 11, 12, 13 and 14 are bent inwardly not along the reverse scoreline 16 but along one of the groove-shaped recesses 19*a* and 19*b*. More specifically, due to the fact that the force necessary to bend the groove-shaped recess 19*b*, in which the perforated line 17 is formed, is smaller than the force necessary to bend the groove-shaped recess 19*a*, in which no perforated line is formed, when the top flaps 11, 12, 13 and 14 are bent inwardly, the top flaps are actually bent inwardly along the perforated line 17 in the grove-shaped recess 19*b* (see FIG. 14). Thereafter, a lid 45 is formed by joining the distal ends of the top flaps 11 and 13 to each other by an adhesive tape 44. Alternatively, the lid 45 may be formed by fixing to the top flaps 12 and 14 the portions of the top flaps 11 and 13 that overlap with the top flaps 12 and 14 by an adhesive such as hot-melt adhesive or a stapler for corrugated paperboard boxes.

For example, the corrugated paperboard box $\mathbf{40}_1$ constructed in this way can be opened as described below.

Figure 12:
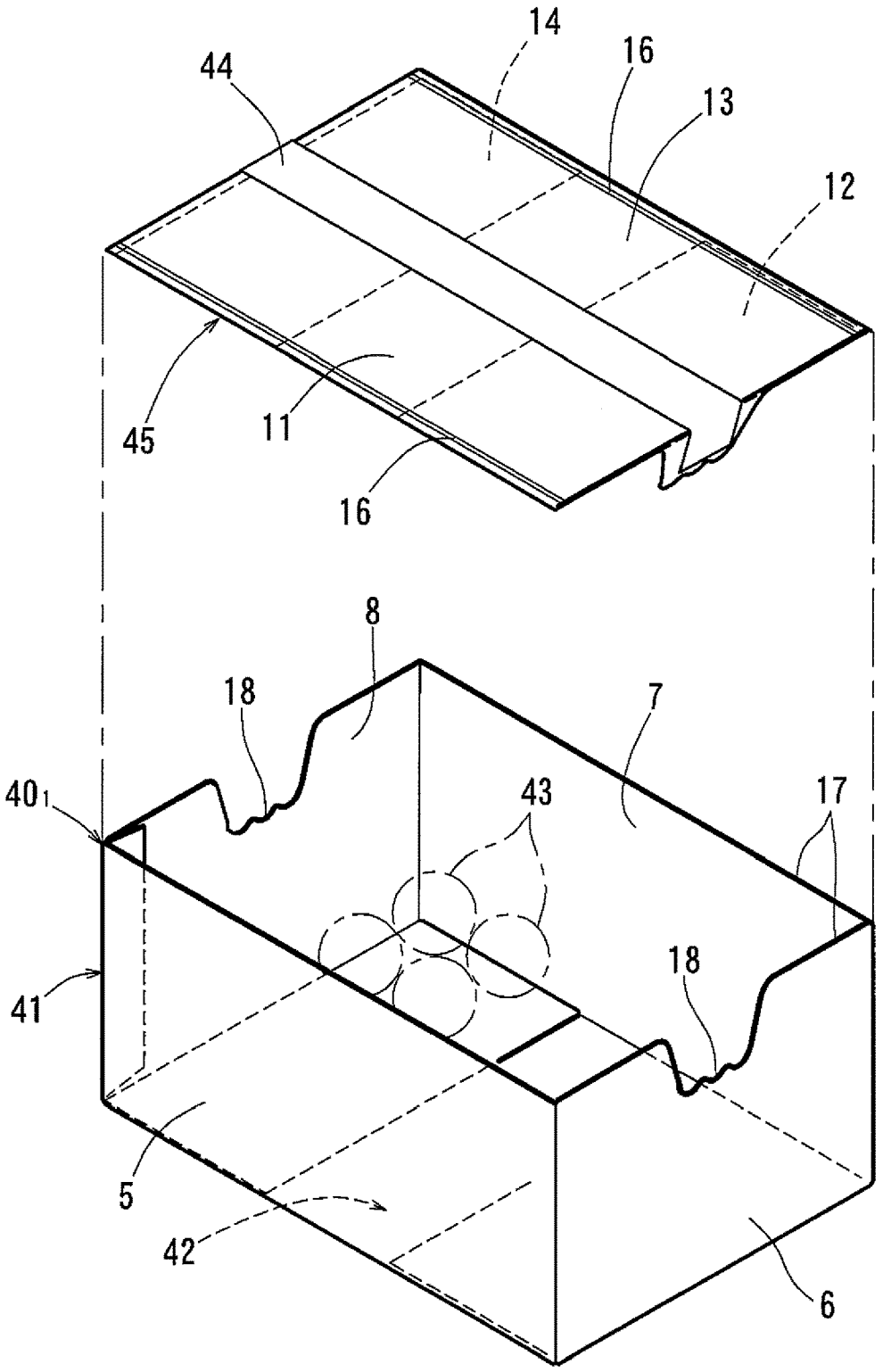
FIG. 12 is a perspective view of the corrugated paperboard box which has been opened by separating the top flaps of FIG. 11 along the perforated line from the peripheral wall.

A user severs the box along the opening assisting cut lines 18 of the respective side panels 6 and 8 illustrated in FIG. 11, inserts his/her fingers into these severed portions, and pulls up the top flaps 12 and 14, so that as illustrated in FIG. 12, the top flaps 12 and 14 are separated along the perforated line 17 from the side panels 6 and 8, respectively. At this time, the top flaps 11 and 13 are also pulled up together with the top flaps 12 and 14, and thus separated along the perforated line 17 from the side panels 5 and 7, respectively. In this way, it is possible to open the corrugated paperboard box $\mathbf{40}_1$ by smoothly separating the lid 45, constituted by the top flaps 11, 12, 13 and 14, from the peripheral wall 41 without using a cutter or any other cutting means. Also, as illustrated in FIG. 12, when the top flaps 11, 12, 13 and 14 are separated from the peripheral wall 41 to open the box $\mathbf{40}_1$, the products 43 received in the box become visible, because the products 43 are not hidden by the top panels 11, 12, 13 and 14. Therefore, it is possible to display the products 43 at a storefront while received in the box $\mathbf{40}_1$, i.e., without taking the products 43 out of the corrugated paperboard box $\mathbf{40}_1$.

As described above, since this corrugated paperboard box $\mathbf{40}_1$ is formed with a groove-shaped reverse scoreline 16 located at the boundary area between the peripheral wall 41 and the top flaps 11, 12, 13 and 14, and recessed on the side of the outer linerboard 1, it is possible to smoothly bend the top flaps 11, 12, 13 and 14 toward the outer surface of the peripheral wall 41, and thus to easily pack products 43 in the box $\mathbf{40}_1$.

This corrugated paperboard box $\mathbf{40}_1$ also allows the top flaps 11, 12, 13 and 14 to be easily separated along the perforated line 17, formed in the groove-shaped recess 19*b*.

Figure 57:
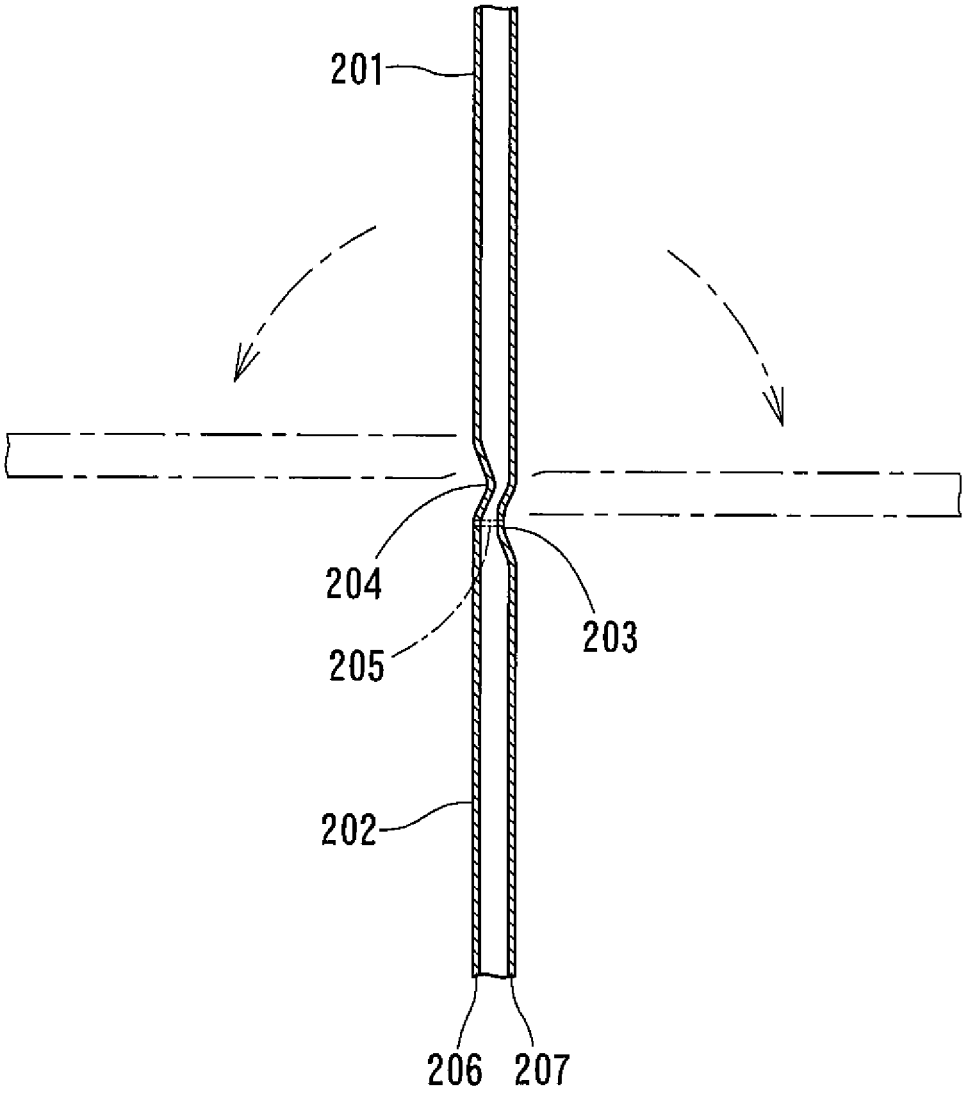
FIG. 57 is a sectional view illustrating the boundary area between the flap and the peripheral wall of a conventional corrugated paperboard box.

In this corrugated paperboard box $\mathbf{40}_1$, as described below, the pair of groove-shaped recesses 19*a* and 19*b* at the boundary area between the peripheral wall 41 and the top flaps 11, 12, 13 and 14 are formed on the side of the inner linerboard 2 at the same time as the corrugated paperboard sheet is sandwiched from the side of the outer linerboard 1 and the side of the inner linerboard 2 to form the reverse scoreline 16 which is recessed on the side of the outer linerboard 1, and at the boundary area between the peripheral wall 41 and the top flaps 11, 12, 13 and 14, there is no normal scoreline (corresponding to the normal scoreline 203 in FIG. 57) which is formed independently of the reverse scoreline 16 in conventional corrugated paperboard boxes. In the corrugated paperboard box $\mathbf{40}_1$, no such normal scoreline is necessary because the groove-shaped recess 19*b* and the perforated line 17, along which the top flaps 11, 12, 13 and 14 can be separated from the peripheral wall 41, function as such a normal scoreline. Therefore, in this corrugated paperboard box $\mathbf{40}_1$, the tensile strengths of the portions of the outer and inner linerboards 1 and 2 at the boundary area between the peripheral wall 41 and the top flaps 11, 12, 13 and 14 are less likely to decrease due to the tensile load applied when the reverse scoreline 16 is formed, so that when the top flaps 11, 12, 13 and 14 are bent along the perforated line 17 toward the inner surface of the peripheral wall 41, it is possible to prevent the breakage of the perforated line 17 due to the tension applied to the outer linerboard 1.

A corrugator is now described which is suitable for manufacturing a corrugated paperboard sheet from which the corrugated paperboard box 41 is formed. The corrugator includes, from the upstream side toward the downstream side, a single facer (not shown), a double facer (not shown), a slitter scorer 50 (see FIG. 15), a perforation forming device 51 (see FIG. 15), and a cut-off device (not shown). The single facer is a device configured to corrugate a corrugating medium into a corrugated medium 3, and bond an inner linerboard 2 to the corrugated medium 3 so as to form a single-faced corrugated paperboard sheet. The double facer is a device configured to bond an outer linerboard 1 to the single-faced corrugated paperboard sheet fed/conveyed from the single facer so as to form a strip-shaped double-faced corrugated paperboard sheet continuously extending in the conveying direction (direction in which the paperboard sheet is conveyed) (this double-faced corrugated paperboard is hereinafter referred to as the "corrugated paperboard sheet"). The cut-off device is configured to cut the corrugated paperboard sheet in the direction orthogonal to the conveying direction into individual sheets. In the slitter scorer 50, the corrugated paperboard sheet is moved horizontally with the outer linerboard 1 positioned under inner linerboard 2.

Figure 15:
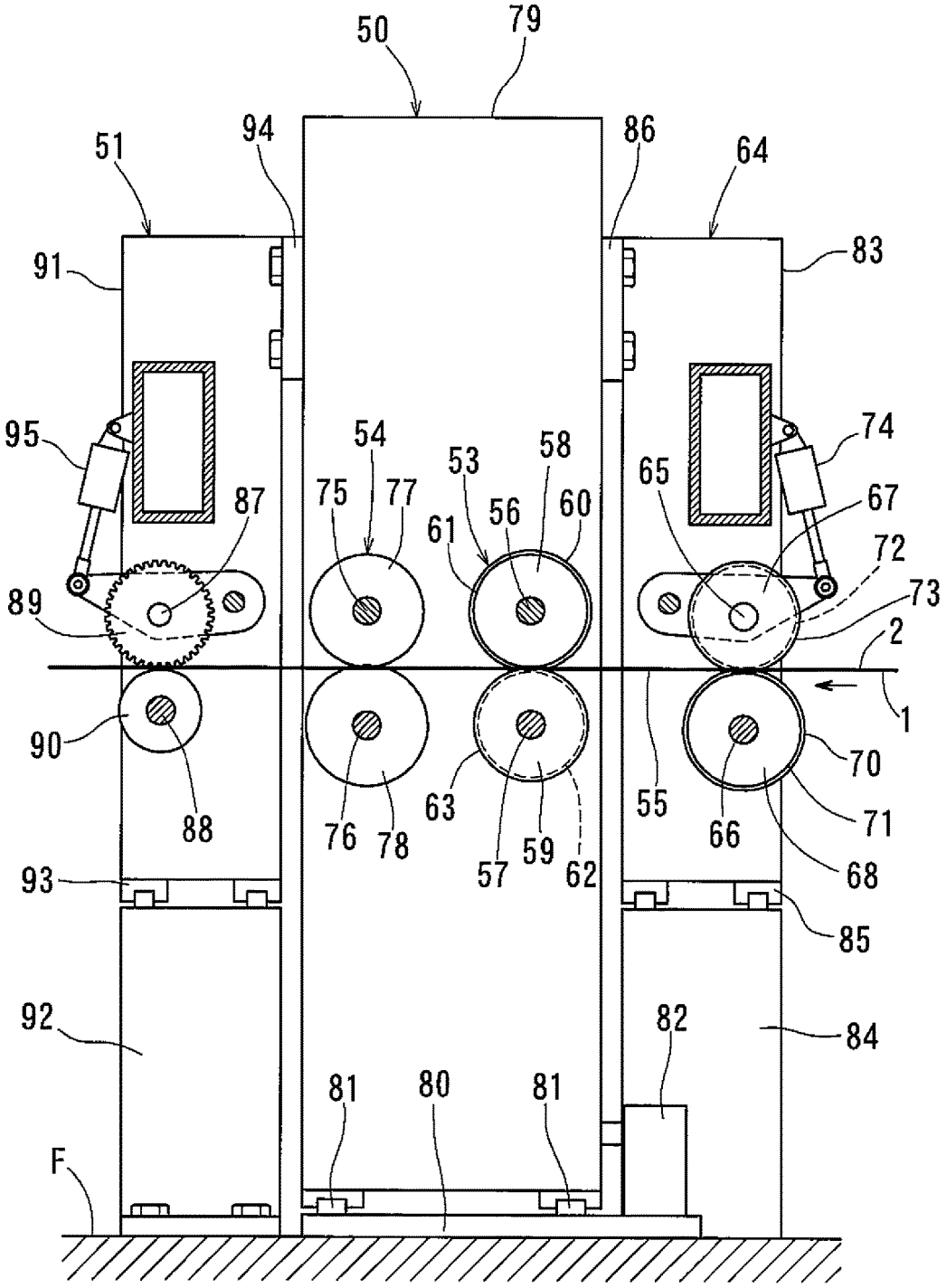
FIG. 15 is a sectional view of a corrugator suitable for manufacturing a corrugated paperboard sheet from which the blank of FIG. 1 is formed, the view illustrating a slitter scorer and a perforation forming device.

As illustrated in FIG. 15, the slitter scorer 50 includes a scorer 53 and a slitter 54. The scorer 53 includes a rotary shaft 56 arranged over the corrugated paperboard sheet 55, a rotary shaft 57 arranged under the corrugated paperboard sheet 55, a normal scoreline ring 58 fixed to the upper rotary shaft 56, and a normal scoreline ring 59 fixed to the lower rotary shaft 57. The scorer 53 is configured to sandwich the corrugated paperboard sheet 55 between the upper normal scoreline ring 58 and the lower normal scoreline ring 59.

The upper normal scoreline ring 58 is formed on its outer periphery with a protrusion 60 continuously extending circumferentially over the entire circumference of the ring 58, and a pair of recesses 61 arranged on the respective axial sides of the protrusion 60. The lower normal scoreline ring 59 is formed on its outer periphery with a groove 62 opposed to the protrusion 60 of the upper ring 58, and a pair of groove shoulders 63 arranged on the respective axial sides of the groove 62. The upper normal scoreline ring 58 and the lower normal scoreline ring 59 sandwich the corrugated paperboard sheet 55 between the protrusion 60 of the upper ring 58 and the groove 62 of the lower ring 59, thereby forming in the corrugated paperboard sheet 55 the groove-shaped normal scoreline 26 (see FIGS. 7(A) and 7(B)) recessed on the upper side of the paperboard sheet 55 (i.e., on the side of the inner linerboard 2). At this time, the upper normal scoreline ring 58 and the lower normal scoreline ring 59 also sandwich the corrugated paperboard sheet 55 between the pair of groove shoulders 63 on both sides of the groove 62 of the lower ring 59 and the pair of recesses 61 on both sides of the protrusion 60 of the upper ring 58, thereby simultaneously forming therein the pair of groove-shaped recesses 27*a* and 27*b* (see FIGS. 7 (B) and 7(C)) recessed on the lower side of the paperboard sheet 55 (i.e., on the side of the outer linerboard 1). The slitter scorer 50 forms the normal scoreline 26 at the boundary area between the peripheral wall 41 and the bottom flaps 21, 22, 23 and 24 illustrated in FIG. 1, but forms no normal scoreline at the boundary area between the peripheral wall 41 and the top flaps 11, 12, 13 and 14.

As illustrated in FIG. 15, the slitter scorer 50 further includes a reverse scoreline forming device 64. The reverse scoreline forming device 64 includes a rotary shaft 65 arranged over the corrugated paperboard sheet 55, a rotary shaft 66 arranged under the corrugated paperboard sheet 55, a reverse scoreline ring 67 fixed to the upper rotary shaft 65, and a reverse scoreline ring 68 fixed to the lower rotary shaft 66. The reverse scoreline forming device 64 is configured to sandwich the corrugated paperboard sheet 55 between the upper reverse scoreline ring 67 and the lower reverse scoreline ring 68.

Figure 16:
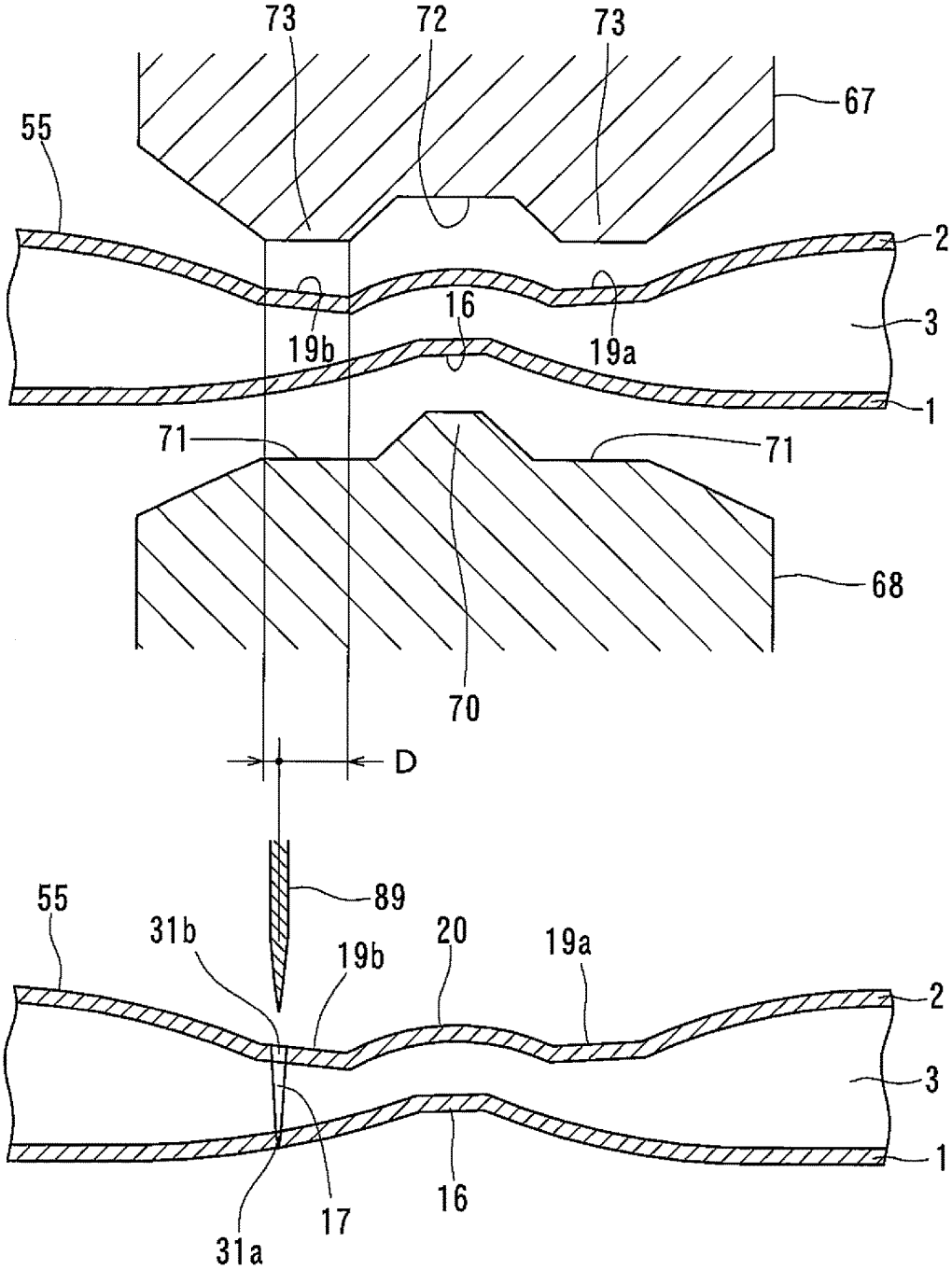
FIG. 16 is a view schematically illustrating the relative positional relationship between the reverse scoreline rings and the perforation forming knife illustrated in FIG. 15.

As illustrated in FIG. 16, the lower reverse scoreline ring 68 (which faces the outer linerboard 1) is formed on its outer periphery with a protrusion 70 continuously extending circumferentially over the entire circumference of the ring 68, and a pair of recesses 71 arranged on the respective axial sides of the protrusion 70. The upper reverse scoreline ring 67 (which faces the inner linerboard 2) is formed on its outer periphery with a groove 72 opposed to the protrusion 70 of the lower ring 68, and a pair of groove shoulders 73 arranged on the respective axial sides of the groove 72. The upper reverse scoreline ring 67 and the lower reverse scoreline ring 68 sandwich the corrugated paperboard sheet 55 between the groove 72 of the upper ring 67 and the protrusion 70 of the lower ring 68, thereby forming in the corrugated paperboard sheet 55 the groove-shaped reverse scoreline 16 recessed on the lower side of the paperboard sheet 55 (i.e., on the side of the outer linerboard 1). At this time, the upper reverse scoreline ring 67 and the lower reverse scoreline ring 68 also sandwich the corrugated paperboard sheet 55 between the pair of groove shoulders 73 of the upper ring 67 and the pair of recesses 71 of the lower ring 68, thereby simultaneously forming therein the pair of groove-shaped recesses 19*a* and 19*b* recessed on the upper side of the paperboard sheet 55.

As illustrated in FIG. 15, the reverse scoreline forming device 64 further includes a driving device 74 configured to move up and down the upper reverse scoreline ring 67. The driving device 74 moves up the upper reverse scoreline ring 67 when no reverse scoreline 16 needs to be formed in the corrugated paperboard sheet 55, and moves down the upper reverse scoreline ring 67 when the reverse scoreline 16 needs to be formed in the corrugated paperboard sheet 55.

The slitter 54 includes a rotary shaft 75 arranged over the corrugated paperboard sheet 55, a rotary shaft 76 arranged under the corrugated paperboard sheet 55, a knife receiver 77 fixed to the upper rotary shaft 75, and a slitter knife 78 fixed to the lower rotary shaft 76. The slitter knife 78 is a rotary blade formed on its outer periphery with a cutting edge continuous circumferentially over the entire circumference of the slitter knife 78, and configured to slit the corrugated paperboard sheet 55 from the lower side of the sheet 55 (i.e., from the side of the outer linerboard 1), and cut the corrugated paperboard sheet 55 along the conveying direction (direction perpendicular to the corrugations of the sheet 55).

The slitter scorer 50 includes a frame 79 supporting the upper rotary shafts 56 and 75 and the lower rotary shafts 57 and 76, a base member 80 fixed to the floor F, and linear guides 81 provided between the frame 79 and the base member 80. The linear guides 81 support the frame 79 such that the frame 79 is movable in the horizontal direction orthogonal to the direction in which the corrugated paperboard sheet 55 is conveyed. The slitter scorer 50 further includes a frame moving device 82 mounted to the frame 79, and configured such that if, while passing through the slitter scorer 50, the corrugated paperboard sheet 55 is displaced in the direction orthogonal to the direction in which the corrugated paperboard sheet 55 is conveyed, the frame 79 is moved by the frame moving device 82 to follow the displacement of the corrugated paperboard sheet 55

The reverse scoreline forming device 64 includes an auxiliary frame 83 supporting the upper rotary shaft 65 and the lower rotary shaft 66, a base member 84 fixed to the floor F, and linear guides 85 provided between the auxiliary frame 83 and the base member 84. The linear guides 85 support the auxiliary frame 83 such that the auxiliary frame 83 is movable in the horizontal direction orthogonal to the direction in which the corrugated paperboard sheet 55 is conveyed. The reverse scoreline forming device 64 further includes a coupling bracket 86 which is mounted to the auxiliary frame 83, and through which the auxiliary frame 83 and the frame 79 of the slitter scorer 50 are coupled together. Since the auxiliary frame 83 and the frame 79 are coupled together through the coupling bracket 86, when the frame moving device 82 moves the frame 79 of the slitter scorer 50, the auxiliary frame 83 is also moved together with the frame 79.

The perforation forming device 51 is arranged on the downstream side of the scorer 53, and includes a rotary shaft 87 arranged over the corrugated paperboard sheet 55, a rotary shaft 88 arranged under the corrugated paperboard sheet 55, a disk-shaped, perforation forming knife 89 fixed to the upper rotary shaft 87, and a knife receiver 90 fixed to the lower rotary shaft 88. The perforation forming knife 89 is a rotary blade configured to cut the corrugated paperboard sheet 55 from the upper side of the sheet 55 toward the lower side thereof (i.e., from the side of the inner linerboard 2 toward the side of the outer linerboard 1), thereby forming the perforated line 17 (see FIG. 1) in the corrugated paperboard sheet 55.

As illustrated in FIG. 16, the perforation forming knife 89 is arranged at the position corresponding to the position of the one groove shoulder 73 so that the perforated line 17 is formed within the groove-shaped recess 19*b*, which has been formed by sandwiching the corrugated paperboard sheet 55 between the one groove shoulder 73 of the upper reverse scoreline ring 67 and the corresponding recess 71 of the lower reverse scoreline ring 68. It is preferable that the perforation forming knife 89 is aligned in the conveying direction with the area D of the one groove shoulder 73, comprising a cylindrical surface and constituting the largest outer diameter of the one groove shoulder 73, However, the perforation forming knife 89 may be aligned with the portion of the one groove shoulder 73 displaced from the area D by 2.0 mm or less (preferably 1.0 mm or less) in the direction away from the other groove shoulder 73.

The perforation forming device 51 includes a frame 91 supporting the rotary shafts 87 and 88, a base member 92 fixed to the floor F, and linear guides 93 provided between the frame 91 and the base member 92. The linear guides 93 support the frame 91 such that the frame 91 is movable in the horizontal direction orthogonal to the direction in which the corrugated paperboard sheet 55 is conveyed. The perforation forming device 51 further includes a coupling bracket 94 which is mounted to the frame 91, and through which the frame 91 and the frame 79 of the slitter scorer 50 are coupled together. Since the frames 79 and 91 are coupled together through the coupling bracket 94, when the frame moving device 82 moves the frame 79 of the slitter scorer 50, the frame 91 of the perforation forming device 51 is also moved together with the frame 79.

The perforation forming device 51 further includes a driving device 95 configured to move up and down the perforation forming knife 89. The driving device 95 moves up the perforation forming knife 89 when no perforated line 17 needs to be formed in the corrugated paperboard sheet 55, and moves down the perforation forming knife 89 when the perforated line 17 needs to be formed in the corrugated paperboard sheet 55.

Figure 17:
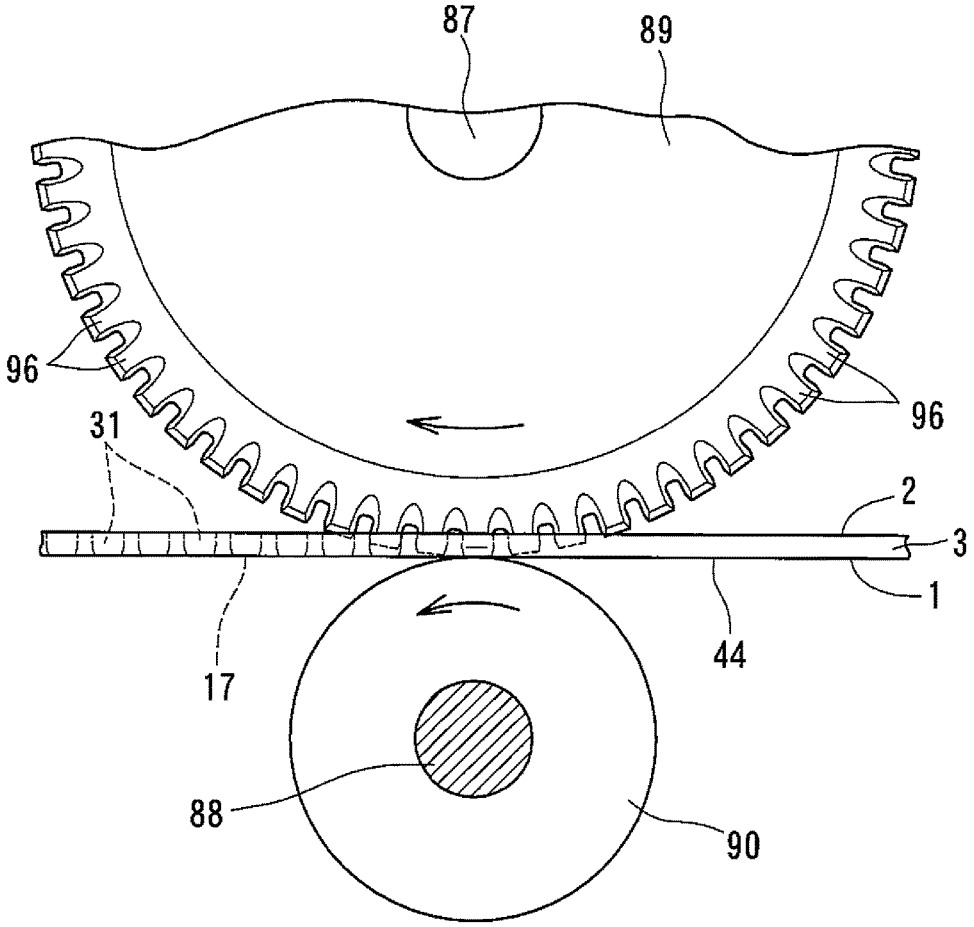
FIG. 17 is an enlarged sectional view illustrating the vicinity of the perforation forming knife of the perforation forming device illustrated in FIG. 15.

As illustrated in FIG. 17, the perforation forming knife 89 is formed on its outer periphery with a plurality of cutting portions 96 protruding radially outwardly, and circumferentially equidistantly spaced apart from each other. The radially outer edges of the respective cutting portions 96 lie on a circular arc having a center at the same position as the center of the rotary shaft 87.

Figure 18:
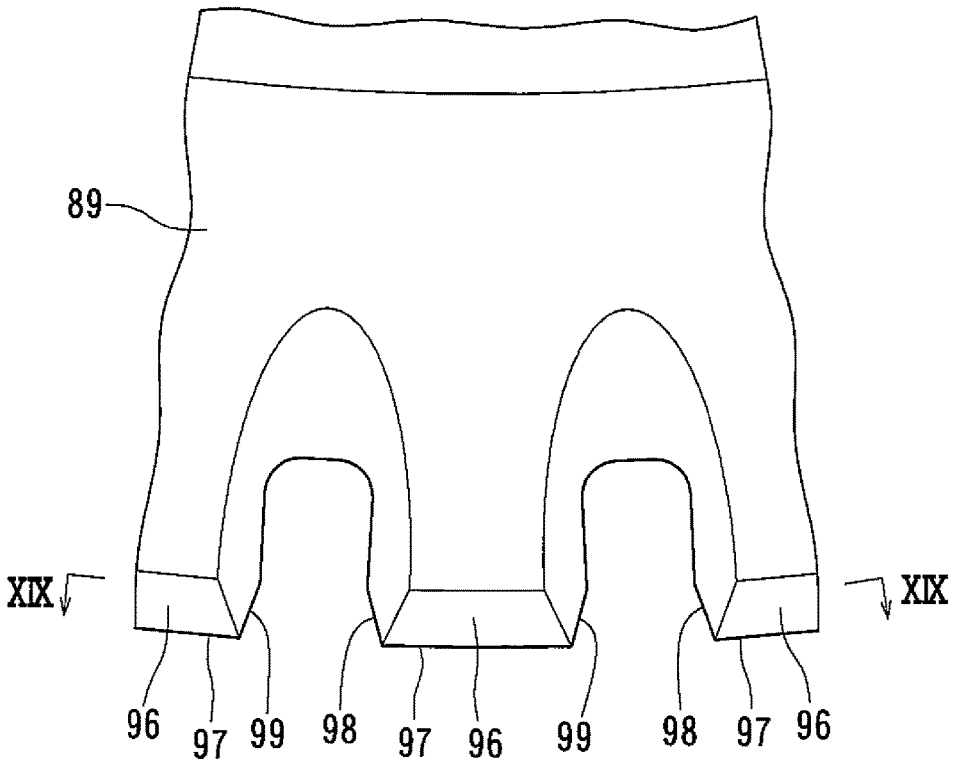
FIG. 18 is an enlarged view of cutting portions of the perforation forming knife illustrated in FIG. 17.
Figure 19:
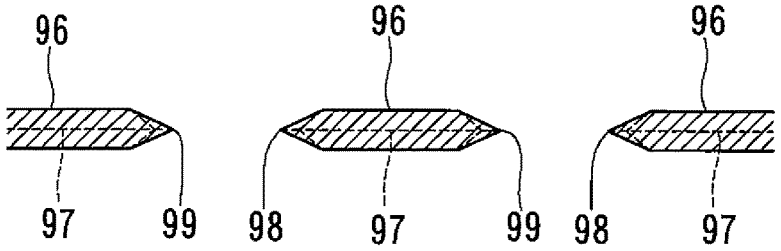
FIG. 19 is a sectional view taken along line XIX-XIX of FIG. 18.
Figure 20:
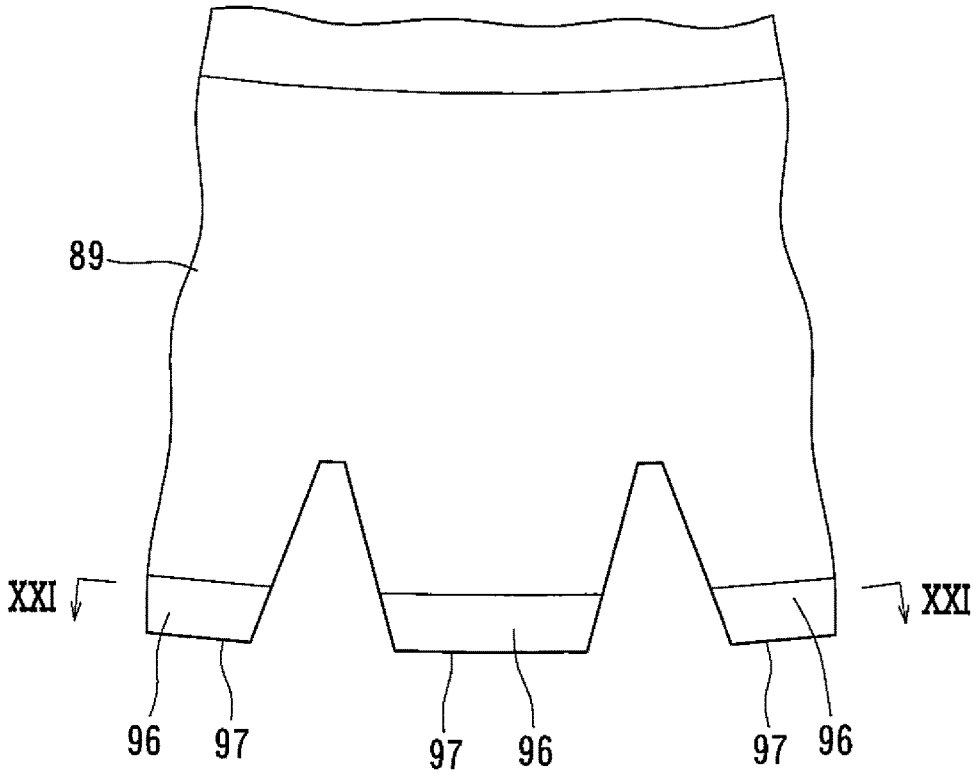
FIG. 20 is a view illustrating a variation of the cutting portions illustrated in FIG. 18.
Figure 21:
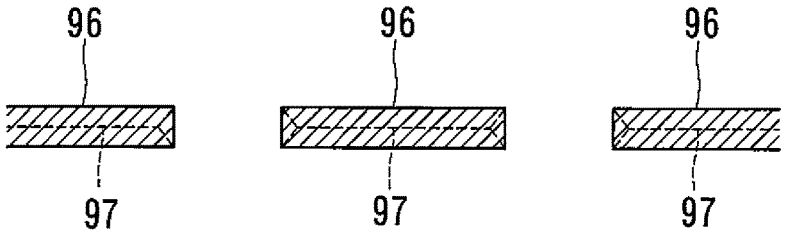
FIG. 21 is a sectional view taken along line XXI-XXI of FIG. 20.

As illustrated in FIGS. 18 and 19, each cutting portion 96 includes a radially outer cutting edge 97, a front cutting edge 98 in the rotation direction of the perforation forming knife 89, and a rear cutting edge 99 in the rotation direction thereof. The cutting edges 97, 98 and 99 are formed by a ridgeline along which the two side surfaces of the cutting portion 96 intersect with each other at an acute angle. Such an arrangement can effectively prevent the breakage of the perforated line 17. As illustrated in FIGS. 20 and 21, the cutting portions 96 may include only the radially outer edges 97, namely may exclude/omit the front and rear cutting edges 98 and 99 in the rotation direction of the perforation forming knife 89. However, such an arrangement increases resistance when the cutting portions 96 cut the corrugated paperboard sheet 55, so that cracks extending from the respective cuts 31 of the perforated line 17 to the areas around the cuts 31 might occur at the same time as the perforated line 17 is formed in the corrugated paperboard sheet 55, namely the perforated line 17 might break relatively easily. In contrast thereto, if the cutting portions 96 include the front and rear cutting edges 98 and 99 in the rotation direction of the perforation forming knife 89 as illustrated in FIGS. 18 and 19, it is possible to prevent the occurrence of cracks in the outer linerboard 1 or in the inner linerboard 2 due to the resistance generated when the cutting portions 96 cut the corrugated paperboard sheet 55. As a result thereof, when the top flaps 11, 12, 13 and 14 illustrated in FIG. 8 are bent along the perforated line 17 toward the inner surface of the peripheral wall 41, it is possible to effectively prevent the breakage of the perforated line 17.

When this corrugator is used to manufacture the corrugated paperboard sheet 55, by sandwiching the corrugated paperboard sheet 55 from the side of the outer linear board 1 and the side of the inner linerboard 2, the first and second reverse scoreline rings 67 and 68 can simultaneously form the reverse scoreline 16 on the side of the outer linerboard 1, and the groove-shaped recesses 19*a* and 19*b* on the side of the inner linerboard 2. Since the reverse scoreline 16 and the groove-shaped recesses 19*a* and 19*b* are first formed by the reverse scoreline rings 67 and 68, and then the perforated line 17 is formed by the perforation forming knife 89, arranged on the downstream side of the reverse scoreline rings 67 and 68, it is possible to prevent the breakage of the perforated line 17 due to the pressing force of the reverse scoreline rings 67 and 68. Namely, if the perforated line 17 is formed before the reverse scoreline 16 is formed, the perforated line 17 might break due to the pressing force of the reverse scoreline rings 67 and 68. In contrast thereto, by forming the perforated line 17 after the reverse scoreline 16 is formed, it is possible to prevent the breakage of the perforated line 17 due to the pressing force of the reverse scoreline rings 67 and 68.

When this corrugator is used to manufacture the corrugated paperboard sheet 55, since the perforation forming knife 89 cuts the corrugated paperboard sheet 55 from the side of the inner linerboard 2 toward the side of the outer linerboard 1, as illustrated in FIGS. 3(A) and 3(C), the widths of the cut portions 31*a* of the perforated line 17 on the side of the outer linerboard 1 are smaller than those of the cut portions 31*b* of the perforated line 17 on the side of the inner linerboard 2, and as illustrated in FIG. 4, the peripheral edge portions 32 of the cut portions 31*a* on the side of the outer linerboard 1 are formed in a protruding shape, and the peripheral edge portions 33 of the cut portions 31*b* on the side of the inner linerboard 2 are formed in a recessed shape.

If the auxiliary frame 83 of the reverse scoreline forming device 64 is formed separately from the frame 79 of the slitter scorer 50 as illustrated in FIG. 15, it is possible to use an existing slitter scorer as the slitter scorer 50 by modifying the existing slitter scorer such that the reverse scoreline forming device 64 can be introduced into the corrugator. On the other hand, if a new slitter scorer is used as the slitter scorer 50, for example, the reverse scoreline forming device 64 may be provided in the frame 79 of the slitter scorer 50 as a device integral with the slitter scorer 50.

While, in FIG. 15, the reverse scoreline forming device 64 is arranged on the upstream side of the slitter scorer 50, the reverse scoreline forming device 64 may be arranged on the downstream side of the slitter scorer 50 and on the upstream side of the perforation forming device 51. Alternatively, the reverse scoreline forming device 64 and the perforation forming device 51 may be arranged on the upstream side of the slitter scorer 50 with the reverse scoreline forming device 64 arranged on the upstream side of the perforation forming device 51.

While, in FIG. 15, the upper and lower reverse scoreline rings 67 and 68 are fixed to the respective rotary shafts 65 and 66, provided separately from the upper and lower rotary shafts 56 and 57, to which the respective normal scoreline rings 58 and 59 are fixed, the upper and lower reverse scoreline rings 67 and 68 may be fixed to the upper and lower rotary shafts 56 and 57, respectively.

The inventors of the present application experimentally prepared multiple of corrugated paperboard boxes 41 as illustrated in FIG. 8 by use of a corrugated paperboard sheet 55 manufactured by the above corrugator, and performed experiments to confirm whether the top flaps 11, 12, 13 and 14 are bent not along the perforated line 17 but along the reverse scoreline 16 when bent toward the outer surface of the peripheral wall 41; whether the top flaps 11, 12, 13 and 14 are bent not along the reverse scoreline 16 but along the perforated line 17 when bent toward the inner surface of the peripheral wall 41; and whether the perforated line 17 does not break when the top flaps 11, 12, 13 and 14 are bent toward the inner surface of the peripheral wall 41. The experimental results are shown in the following Tables 1 to 3.

TABLE 1

| | | Reverse scoreline ring gap (mm) | | | | | | | | |
|---|---|---|---|---|---|---|---|---|---|---|
| AF High material | | 1.10 | 1.15 | 1.20 | 1.25 | 1.30 | 1.35 | 1.40 | 1.45 | 1.50 |
| Perforation position (mm) | 4.0 | ○ | ○ | ○ | ○ | ○ | ○ | ○ | ○ | ○ |
| | 4.5 | ○ | ○ | ○ | ○ | ○ | ○ | ○ | ○ | ○ |
| | 5.0 | ○ | ○ | ○ | ○ | ○ | ○ | ○ | ○ | ○ |
| | 5.5 | ○ | ○ | ○ | ○ | ○ | ○ | ○ | ○ | ○ |
| | 6.0 | ○ | ○ | ◎ | ◎ | ◎ | ○ | ○ | ○ | ○ |
| | 6.5 | ○ | ○ | ◎ | ◎ | ◎ | ○ | ○ | ○ | ○ |
| | 7.0 | ○ | ○ | ◎ | ◎ | ◎ | ○ | ○ | ○ | ○ |
| | 7.5 | ○ | ○ | ○ | ○ | ○ | ○ | ○ | ○ | ○ |
| | 8.0 | Δ | Δ | Δ | Δ | Δ | Δ | Δ | Δ | Δ |

TABLE 2

| CF Middle material | | Reverse scoreline ring gap (mm) | | | | | | | | |
|---|---|---|---|---|---|---|---|---|---|---|
| | | 1.30 | 1.35 | 1.40 | 1.45 | 1.50 | 1.55 | 1.60 | 1.65 | 1.70 |
| Perfo | 4.5 | ○ | ○ | ○ | ○ | ○ | ○ | ○ | ○ | ○ |
| | 5.0 | ◎ | ◎ | ◎ | ◎ | ◎ | ◎ | ◎ | ◎ | ◎ |
| | 5.5 | ◎ | ◎ | ◎ | ◎ | ◎ | ◎ | ◎ | ◎ | ◎ |
| | 6.0 | ◎ | ◎ | ◎ | ◎ | ◎ | ◎ | ◎ | ◎ | ◎ |
| | 6.5 | ◎ | ◎ | ◎ | ◎ | ◎ | ◎ | ◎ | ◎ | ◎ |
| | 7.0 | ◎ | ◎ | ◎ | ◎ | ◎ | ◎ | ◎ | ◎ | ◎ |
| | 7.5 | ◎ | ○ | ○ | ○ | ○ | ○ | ○ | ○ | ○ |
| | 8.0 | ◎ | ○ | ○ | ○ | ○ | ○ | ○ | ○ | ○ |
| | 8.5 | ◎ | ○ | ○ | ○ | ○ | ○ | ○ | ○ | ○ |
| | 9.0 | ○ | ○ | ○ | ○ | ○ | ○ | ○ | ○ | ○ |

TABLE 3

| BF High material | | Reverse scoreline ring gap (mm) | | | | | | | | |
|---|---|---|---|---|---|---|---|---|---|---|
| | | 1.30 | 1.35 | 1.40 | 1.45 | 1.50 | 1.55 | 1.60 | 1.65 | 1.70 |
| Perforation position (mm) | 4.5 | ◎ | ◎ | ◎ | ◎ | ◎ | ◎ | ◎ | ◎ | ◎ |
| | 5.0 | ◎ | ◎ | ◎ | ◎ | ◎ | ◎ | ◎ | ◎ | ◎ |
| | 5.5 | ◎ | ◎ | ◎ | ◎ | ◎ | ◎ | ◎ | ◎ | ◎ |
| | 6.0 | ◎ | ◎ | ◎ | ◎ | ◎ | ◎ | ◎ | ◎ | ◎ |
| | 6.5 | ◎ | ◎ | ◎ | ◎ | ◎ | ◎ | ◎ | ◎ | ◎ |
| | 7.0 | ◎ | ◎ | ◎ | ◎ | ◎ | ◎ | ◎ | ◎ | ◎ |
| | 7.5 | ◎ | ◎ | ◎ | ◎ | ◎ | ◎ | ◎ | ◎ | ◎ |
| | 8.0 | ◎ | ◎ | ◎ | ◎ | ◎ | ◎ | ◎ | ◎ | ◎ |
| | 8.5 | Δ | Δ | Δ | Δ | Δ | Δ | Δ | Δ | Δ |
| | 9.0 | Δ | Δ | Δ | Δ | Δ | Δ | Δ | Δ | Δ |

In Tables 1 to 3, "perforation position" means the distance L between the center of the perforated line 17 and the center of the reverse scoreline 16 illustrated in FIG. 3(C); and "reverse scoreline ring gap" means the distance between the groove shoulders 73 of the upper reverse scoreline ring 67 and the recesses 71 of the lower reverse scoreline ring 68 illustrated in FIG. 16.

The symbols "◎", "○" and "Δ" in Tables 1 to 3 are described below.

The symbol "◎" means "extremely good", namely means that the top flaps 11, 12, 13 and 14 were bent not along the perforated line 17 but along the reverse scoreline 16 when bent toward the outer surface of the peripheral wall 41; that the top flaps 11, 12, 13 and 14 were bent not along the reverse scoreline 16 but along the perforated line 17 when bent toward the inner surface of the peripheral wall 41; and that the perforated line 17 did not break when the top flaps 11, 12, 13 and 14 were bent toward the inner surface of the peripheral wall 41.

The symbol "○" means "good", namely means that the top flaps 11, 12, 13 and 14 were bent not along the perforated line 17 but along the reverse scoreline 16 when bent toward the outer surface of the peripheral wall 41; that the top flaps 11, 12, 13 and 14 were bent not along the reverse scoreline 16 but along the perforated line 17 when bent toward the inner surface of the peripheral wall 41; and that the perforated line 17 did not break when the top flaps 11, 12, 13 and 14 were bent once toward the inner surface of the peripheral wall 41, but slight cracks occurred in the perforated line 17 when the top flaps 11, 12, 13 and 14 were bent two or three times toward the inner surface of the peripheral wall 41.

The symbol "Δ" means "relatively good", namely means that the top flaps 11, 12, 13 and 14 were bent not along the perforated line 17 but along the reverse scoreline 16 when bent toward the outer surface of the peripheral wall 41; that when bent toward the inner surface of the peripheral wall 41, the top flaps 11, 12, 13 and 14 were bent not along the reverse scoreline 16 but along the perforated line 17, but were bent at two portions, i.e., along both the perforated line 17 and the groove-shaped recess 19*a*, in which no perforated line 17 is formed; and that the perforated line 17 did not break when the top flaps 11, 12, 13 and 14 were bent toward the inner surface of the peripheral wall 41.

The above experimental results show that when the distance L between the center of the perforated line 17 and the center of the reverse scoreline 16 was set within the range of 4.5 to 8.0 mm (preferably 5.0 to 7.0 mm) in the corrugated paperboard box $\mathbf{40}_1$, the top flaps 11, 12, 13 and 14 were bent not along the perforated line 17 but along the reverse scoreline 16 when bent toward the outer surface of the peripheral wall 41; the top flaps 11, 12, 13 and 14 were bent not along the reverse scoreline 16 but along the perforated line 17 when bent toward the inner surface of the peripheral wall 41; and the perforated line 17 was less likely to break when the top flaps 11, 12, 13 and 14 were bent toward the inner surface of the peripheral wall 41.

Figure 22:
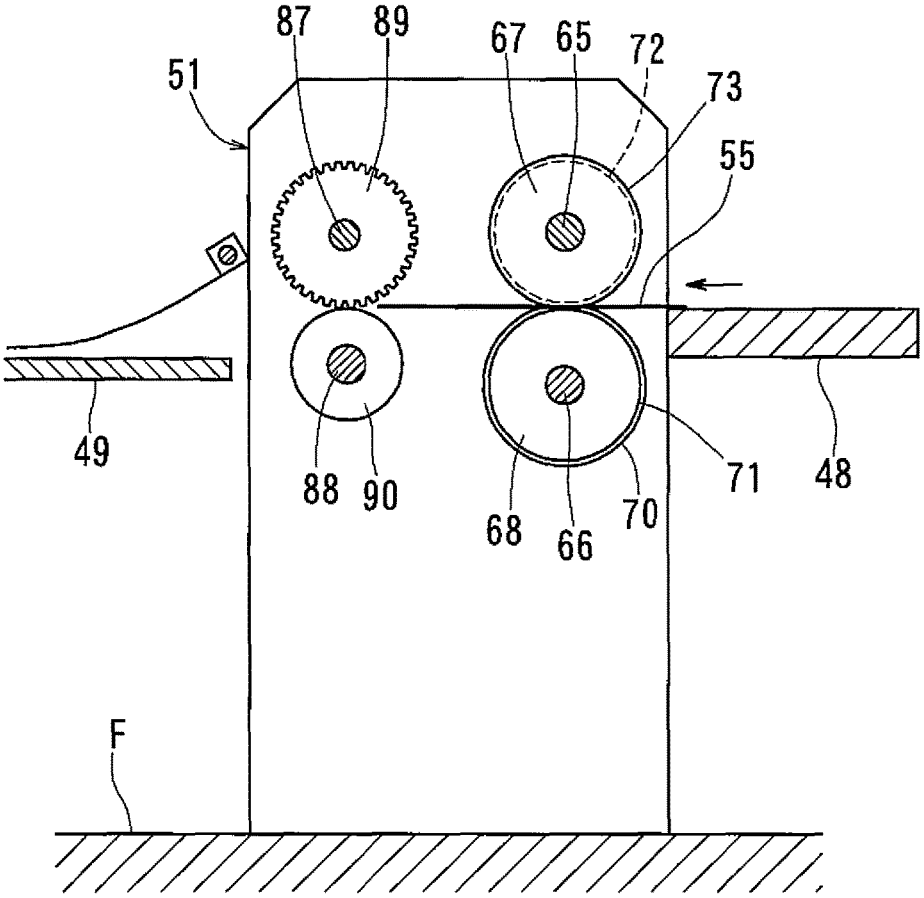
FIG. 22 is a sectional view of a perforation forming device for cut sheets cut off from the corrugated paperboard sheet.

While the perforation forming device 51 of the corrugator shown in FIG. 15 is configured to form the perforated line 17 after the reverse scoreline 16 is formed in the corrugated paperboard sheet 55, which continuously extends in a strip shape in the corrugator, the perforation forming device 51 illustrated in FIG. 22 may be used instead which is provided as a part of a cutting machine configured to cut, to a predetermined width size, cut sheets cut off from the corrugated paperboard sheet 55 by the corrugator (such cut sheets are hereinafter simply referred to as "cut sheets 55" or "cut corrugated paperboard sheets 55").

The perforation forming device 51 shown in FIG. 22 is, for example, a device provided by modifying a cutting machine configured to cut a cut corrugated paperboard sheet 55 to a predetermined width size. As for the elements corresponding to elements illustrated in FIG. 15, the same reference numerals as used in FIG. 15 are used below, and their description is omitted.

The perforation forming device 51 of FIG. 22 includes, from the upstream side toward the downstream side, a sheet feed table 48 supporting cut corrugated paperboard sheets 55, upper and lower reverse scoreline rings 67 and 68, a perforation forming knife 89, and a sheet discharge table 49. The perforation forming device 51 may further include upper and lower normal scoreline rings 58 and 59 (not shown) axially aligned with the upper and lower reverse scoreline rings 67 and 68, respectively, and/or a slitter knife (not shown) similar to the slitter knife 78 and axially aligned with the perforation forming knife 89, and configured to cut a cut corrugated paperboard sheet 55 to a predetermined width size.

It is now described how this perforation forming device 51 is used. First, when a cut corrugated paperboard sheet 55 supported by the sheet feed table 48 is fed to the downstream side, and sandwiched between the upper reverse scoreline ring 67 and the lower reverse scoreline ring 68, the reverse scoreline rings 67 and 68 form the reverse scoreline 16 recessed on the lower side of the cut sheet 55 (i.e., on the side of the outer linerboard 1) by sandwiching the cut sheet 55 between the groove 72 of the upper reverse scoreline ring 67 and the protrusion 70 of the lower reverse scoreline ring 68, and simultaneously form the pair of groove-shaped recesses 19*a* and 19*b* recessed on the upper side of the cut sheet 55 by sandwiching the cut sheet 55 between the groove shoulders 73 of the upper reverse scoreline ring 67 and the recesses 71 of the lower reverse scoreline ring 68. Thereafter, the perforation forming knife 89 forms the perforated line 17 in the groove-shaped recess 19*b*.

Figure 23:
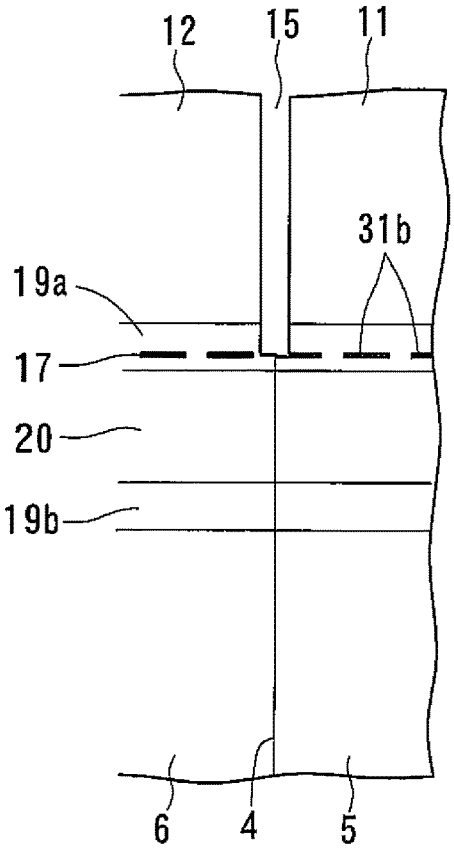
FIG. 23(A) is a view illustrating a variation of the corrugated paperboard box illustrated in FIG. 3(A).
FIG. 23(B) is a view illustrating a variation of the corrugated paperboard box illustrated in FIG. 3(B).
FIG. 23(C) is a view illustrating a variation of the corrugated paperboard box illustrated in FIG. 3(C).
Figure 23:
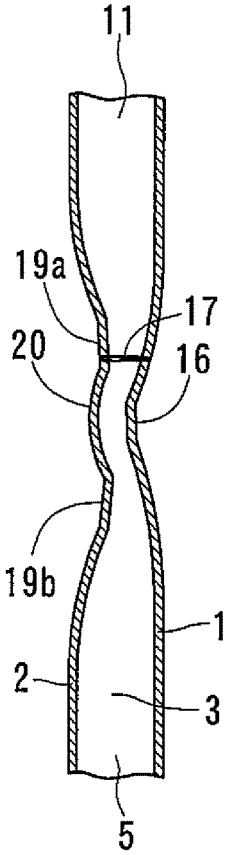
Figure 23:
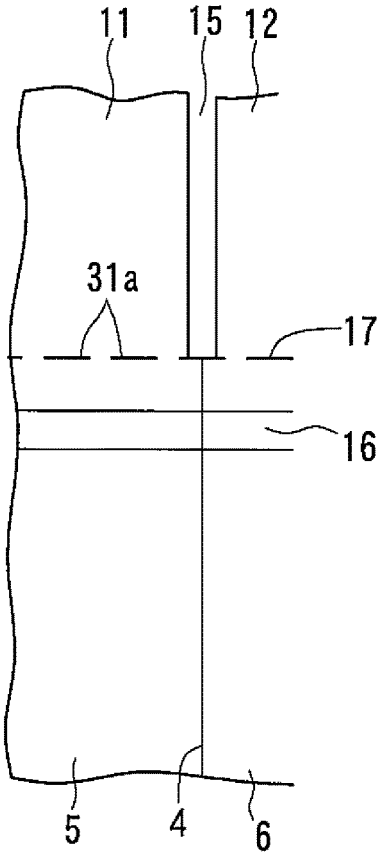

While, in FIG. 3, the perforated line 17 is formed in the groove-shaped recess 19*b*, i.e., one of the recesses 19*a* and 19*b* that is remoter from the distal ends of the top flaps 11, 12, 13 and 14 than is the other, as illustrated in FIGS. 23(A), 23(B) and 23(C), the perforated line 17 may be formed not in the groove-shaped recess 19*b* but in the groove-shaped recess 19*a*, closer to the distal ends of the top flaps 11, 12, 13 and 14, so that the top flaps 11, 12, 13 and 14 can be bent along the perforated line 17 of the recess 19*a* toward the inner linerboard 2 (i.e., toward the inner surface of the peripheral wall 41 of FIG. 8). With this arrangement too, it is possible to prevent the breakage of the perforated line 17 due to the tension applied to the outer linerboard 1 when the top flaps 11, 12, 13 and 14 are bent along the perforated line 17 toward the inner surface of the peripheral wall 41. With the top flaps 11, 12, 13 and 14 bent in this way, the reverse scoreline 16 prevents the peripheral wall 41 of the corrugated paperboard box $\mathbf{40}_1$ from bulging outwardly when the box $\mathbf{40}_1$ is sealed as illustrated in FIG. 11 and other boxes are stacked on it.

While FIG. 1 shows a blank for a corrugated paperboard box $\mathbf{40}_1$ of which the top flaps 11, 12, 13 and 14 have the same length (generally known as an "A" type corrugated paperboard box), the present invention can be also applied to a different type corrugated paperboard box (such as a "B" type corrugated paperboard box which includes a top flap 11 large enough such that the upper end opening of the peripheral wall 41 is closed by the top flap 11 alone, and in which an insertion piece integrally connected to the distal end of the top flap 11 is inserted in the inner side of the peripheral wall 41 so as to form the lid of the box).

While FIG. 8 shows a corrugated paperboard box $\mathbf{40}_1$ including a quadrangular peripheral wall 41, the present invention can be also applied to a corrugated paperboard box including a peripheral wall 41 having a shape other than a quadrangular shape, for example, a corrugated paperboard box including an octagonal peripheral wall 41 (formed by cutting the four corners of the quadrangular peripheral wall). The present invention can be also applied to a corrugated paperboard box which includes the top flaps 11, 12, 13 and 14 at the upper end of the peripheral wall 41, but which includes no bottom flaps 21, 22, 23 and 24 at the lower end of the peripheral wall 41 (known as a "semi-A" type corrugated paperboard box), or to a two-piece box comprising a semi-A type corrugated paperboard box, and a tray covered by the semi-A type corrugated paperboard box.

Figure 24:
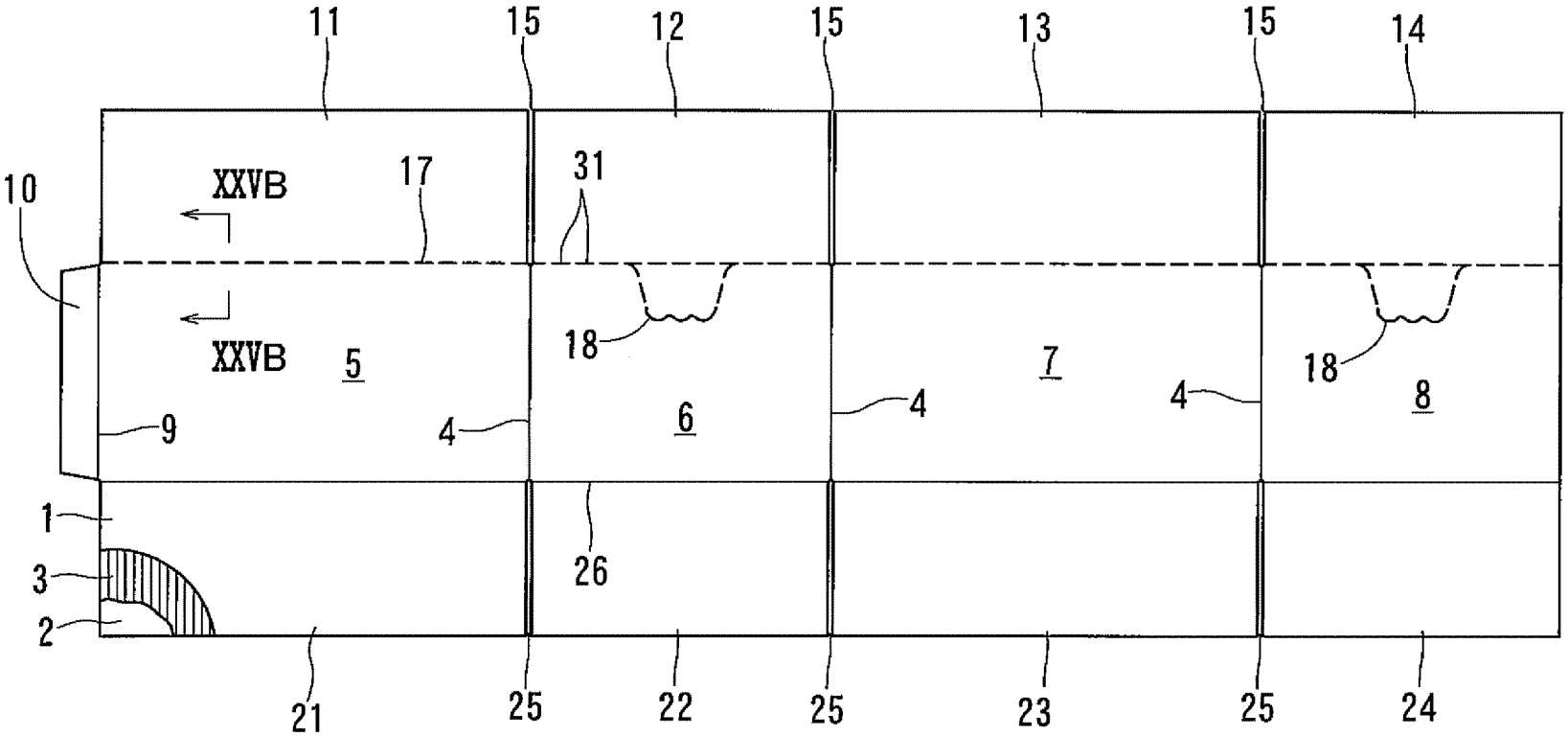
FIG. 24 is a view of the blank of a corrugated paperboard box according to a second embodiment of the present invention, when seen from the side of the outer linerboard (of the blank).

FIG. 24 illustrates the blank of a corrugated paperboard box $\mathbf{40}_2$ according to the second embodiment of the present invention (see FIG. 2). As for the elements corresponding to those of (the blank of) the corrugated paperboard box $\mathbf{40}_1$ described in the first embodiment, the same reference numerals as used in the first embodiment are used below, and their description is omitted.

Figure 25:
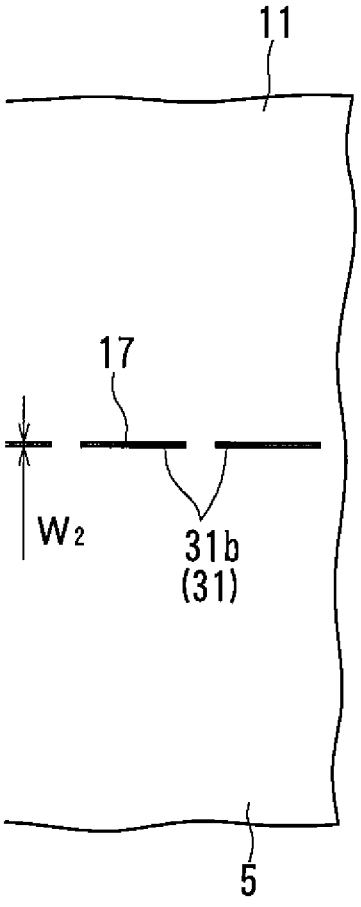
FIG. 25(A) is an enlarged view illustrating the vicinity of the perforated line of the blank illustrated in FIG. 24, when seen from the side of the inner linerboard (of the blank), the view corresponding to the left side surface illustrated in FIG. 25(B).
FIG. 25(B) is an enlarged sectional view taken along line XXVB-XXVB of FIG. 24.
FIG. 25(C) is an enlarged view illustrating the vicinity of the perforated line of the blank illustrated in FIG. 24, when seen from the side of the outer linerboard, the view corresponding to the right side surface illustrated in FIG. 25(B).
Figure 25:
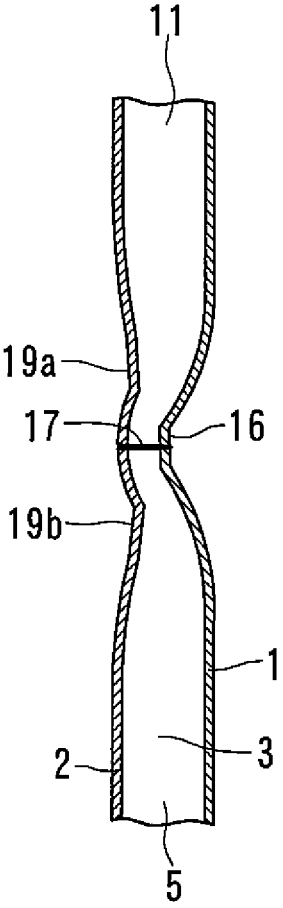
Figure 25:
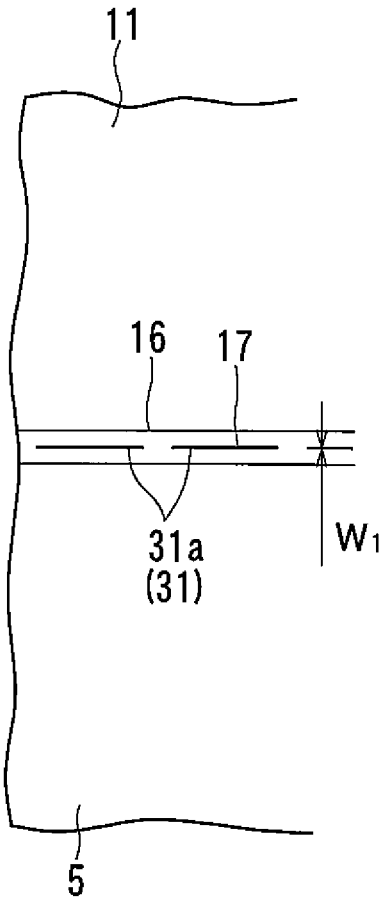
Figure 28:
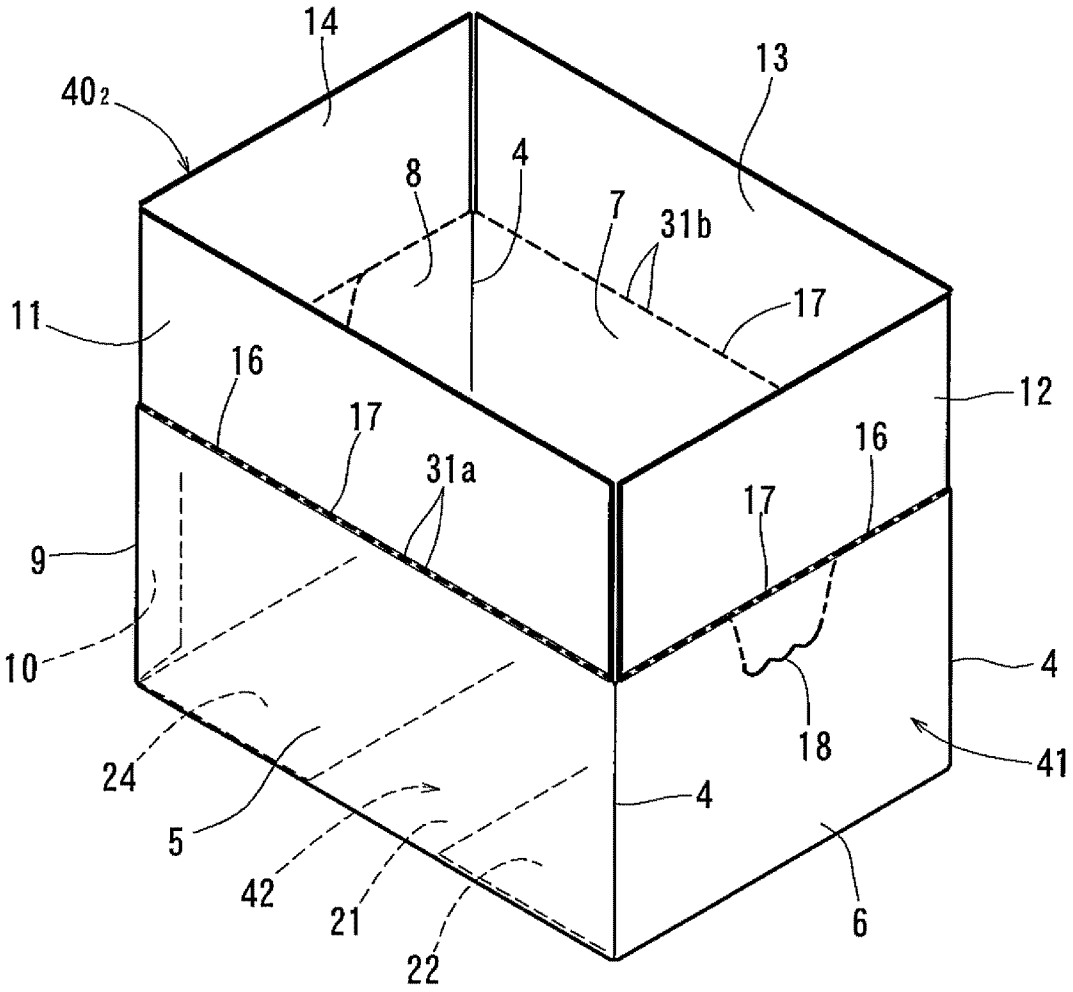
FIG. 28 is perspective view of the corrugated paperboard box which has been partially constructed from the blank of FIG. 24, namely, of which the top flaps have not been bent yet.

As illustrated in FIGS. 25(A), 25(B) and 25(C), at the boundary area between the top flaps 11, 12, 13 and 14 and the side panels 5, 6, 7 and 8 illustrated in FIG. 24, the blank of the box $\mathbf{40}_2$ is formed with a groove-shaped reverse scoreline 16 recessed on the side of the outer linerboard 1 so that the top flaps 11, 12, 13 and 14 can be bent along the reverse scoreline 16 toward the outer linerboard 1 (i.e. toward the outer surface of the peripheral wall 41 illustrated in FIG. 28), and with a perforated line 17 along which the top flaps 11, 12, 13 and 14 can be separated from the box. The reverse scoreline 16 and the perforated line 17 extend in the direction perpendicular to the corrugations of the corrugated paperboard.

As illustrated in FIG. 25(B), at the boundary area between the top flaps 11, 12, 13 and 14 and the side panels 5, 6, 7 and 8, the blank of the box $\mathbf{40}_2$ is formed with a pair of groove-shaped recesses 19*a* and 19*b* recessed on the side of the inner linerboard 2 so as to be shallower than the reverse scoreline 16. The groove-shaped recesses 19*a* and 19*b* are inevitably formed in the inner linerboard 2 when the corrugated paperboard sheet 55 is sandwiched between the below-described reverse scoreline rings 67 and 68 (see FIG. 35) to form the reverse scoreline 16 in the outer linerboard 1.

As illustrated in FIGS. 25(A) and 25(C), the perforated line 17 comprises multiple of cuts 31 spaced apart from each other at predetermined intervals. The cuts 31 are in the form of slits aligned in a straight line extending in parallel to the reverse scoreline 16. The cuts 31 extend to penetrate through the inner linerboard 2, the corrugated medium 3, and the outer linerboard 1 (see FIG. 27).

As illustrated in FIGS. 25(A) and 25(C), each of the cuts 31 of the perforated line 17 includes a cut portion 31*a* formed in the outer linerboard 1, and a cut portion 31*b* formed in the inner linerboard 2. The cuts 31 are formed such that the width $W_1$ of each cut portion 31*a* in the orthogonal direction to the direction in which the perforated line 17 extends is smaller than the width $W_2$ of each cut portion 31*b* in the orthogonal direction.

Figure 26:
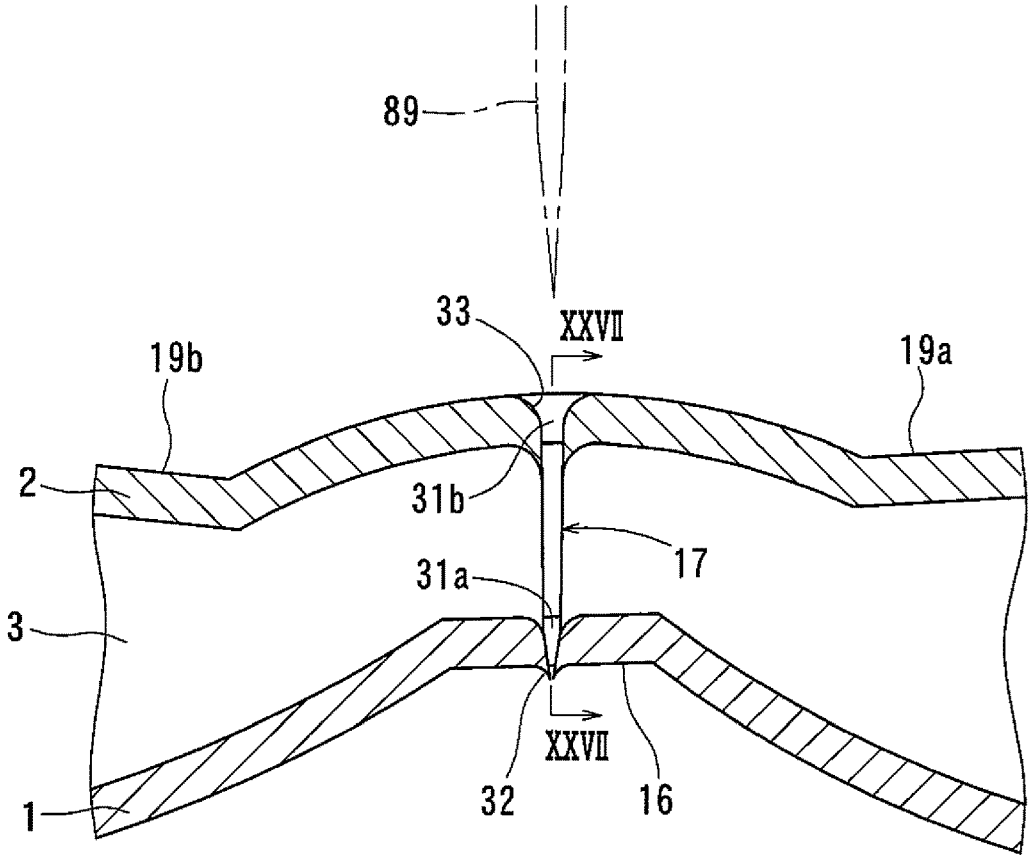
FIG. 26 is an enlarged view illustrating the vicinity of the perforated line illustrated in FIG. 25(B).

As illustrated in FIG. 26, the perforated line 17 is formed such that each cut portion 31*a* on the side of the outer linerboard 1 includes a peripheral edge portion 32 having a protruding shape, namely protruding from the surface of the outer linerboard 1, and each cut portion 31*b* on the side of the inner linerboard 2 includes a peripheral edge portion 33 having a recessed shape, namely recessed from the surface of the inner linerboard 2 toward the corrugated medium 3. It is possible to form such a perforated line 17 by cutting the blank from the side of the inner linerboard 2 toward the side of the outer linerboard 1 by means of a perforation forming knife 89.

Figure 27:
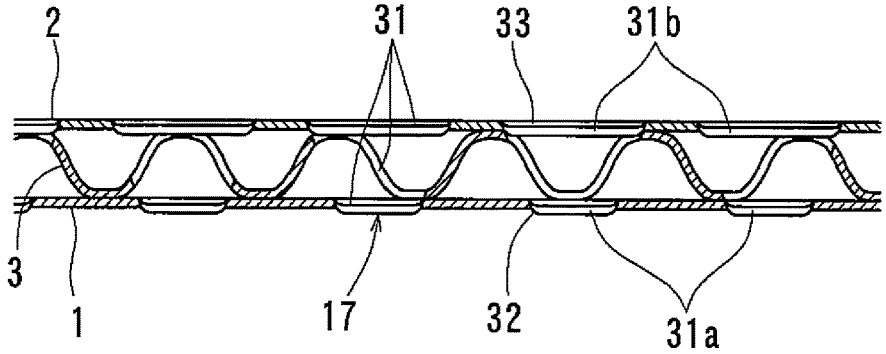
FIG. 27 is a sectional view taken along line XXVII-XXVII of FIG. 26.

As illustrated in FIG. 27, each cut portion 31*a* on the side of the outer linerboard 1 is aligned in the thickness direction of the blank with the corresponding cut portion 31*b* on the side of the inner linerboard 2. The length of the joint portion between each adjacent pair of cut portions 31*a* on the side of the outer linerboard 1 is set within 2 mm to 4 mm (preferably 2.5 mm to 3.5 mm).

For example, the blank of FIG. 24 can be formed into the box $\mathbf{40}_2$ as described below.

As illustrated in FIG. 28, first, the side panels 5, 6, 7 and 8 are bent along the respective scorelines 4 into a tubular shape such that the inner linerboard 2 constitutes the inner surface of the corrugated paperboard box $\mathbf{40}_2$, and the joint flap 10, integrally connected to the side panel 5 at one end of the blank, is bonded to the inner surface of the side panel 8 at the other end of the blank such that the side panels 5, 6, 7 and 8 constitute the peripheral wall 41. Second, the bottom flaps 22 and 24, which are integrally connected to the respective lower ends of the side panels 6 and 8, which correspond to or constitute the widthwise surfaces of the box $\mathbf{40}_2$, are bent along the normal scoreline 26 toward the inner surface of the peripheral wall 41, and the bottom flaps 21 and 23, which are integrally connected to the respective lower ends of the side panels 5 and 7, which correspond to or constitute the lengthwise surfaces of the box $\mathbf{40}_2$, are bent along the normal scoreline 26 toward the inner surface of the peripheral wall 41 such that the bottom flaps 21, 22, 23 and 24 constitute a bottom 42 that closes the lower end opening of the peripheral wall 41.

Figure 29:
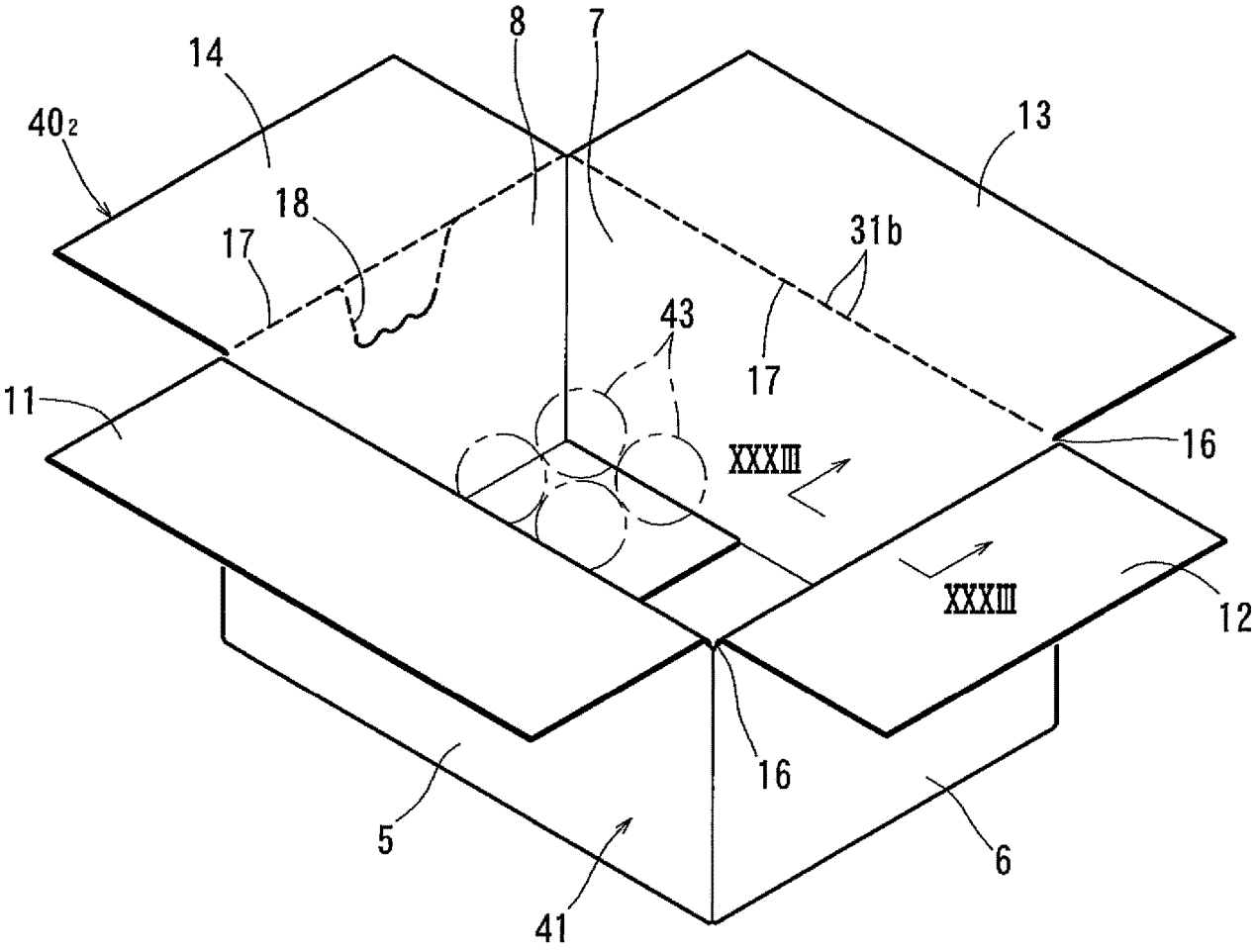
FIG. 29 is a perspective view of the corrugated paperboard box of which the top flaps illustrated in FIG. 28 have been bent toward the outer surface of the peripheral wall (of the box), and in which products have been placed.
Figure 33:
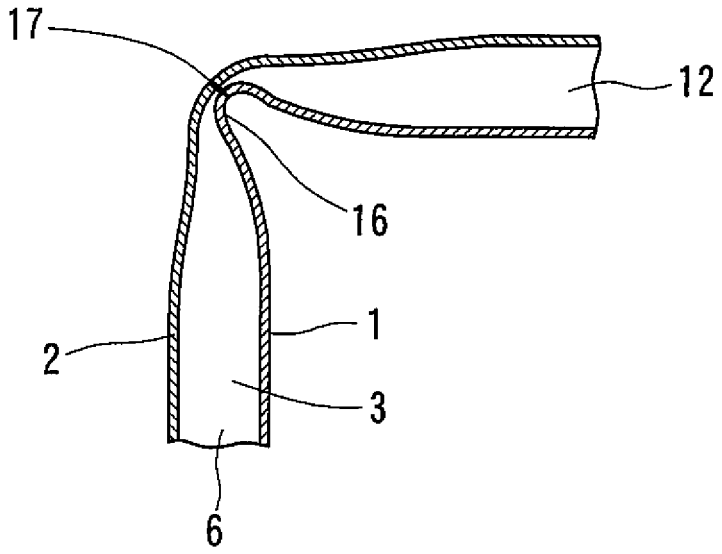
FIG. 33 is a sectional view taken along line XXXIII-XXXIII of FIG. 29.

In this state, products 43 are packed in the corrugated paperboard box $\mathbf{40}_2$. At this time, in order to enable the products 43 to be easily placed into the corrugated paperboard box $\mathbf{40}_2$, the top flaps 11, 12, 13 and 14 are bent toward the outer surface of the peripheral wall 41 (i.e., bent outwardly) as illustrated in FIG. 29. At this time, the top flaps 11, 12, 13 and 14 are bent outwardly along the reverse scoreline 16, formed at the boundary area between the peripheral wall 41 and the top flaps 11, 12, 13 and 14 (see FIG. 33).

Figure 30:
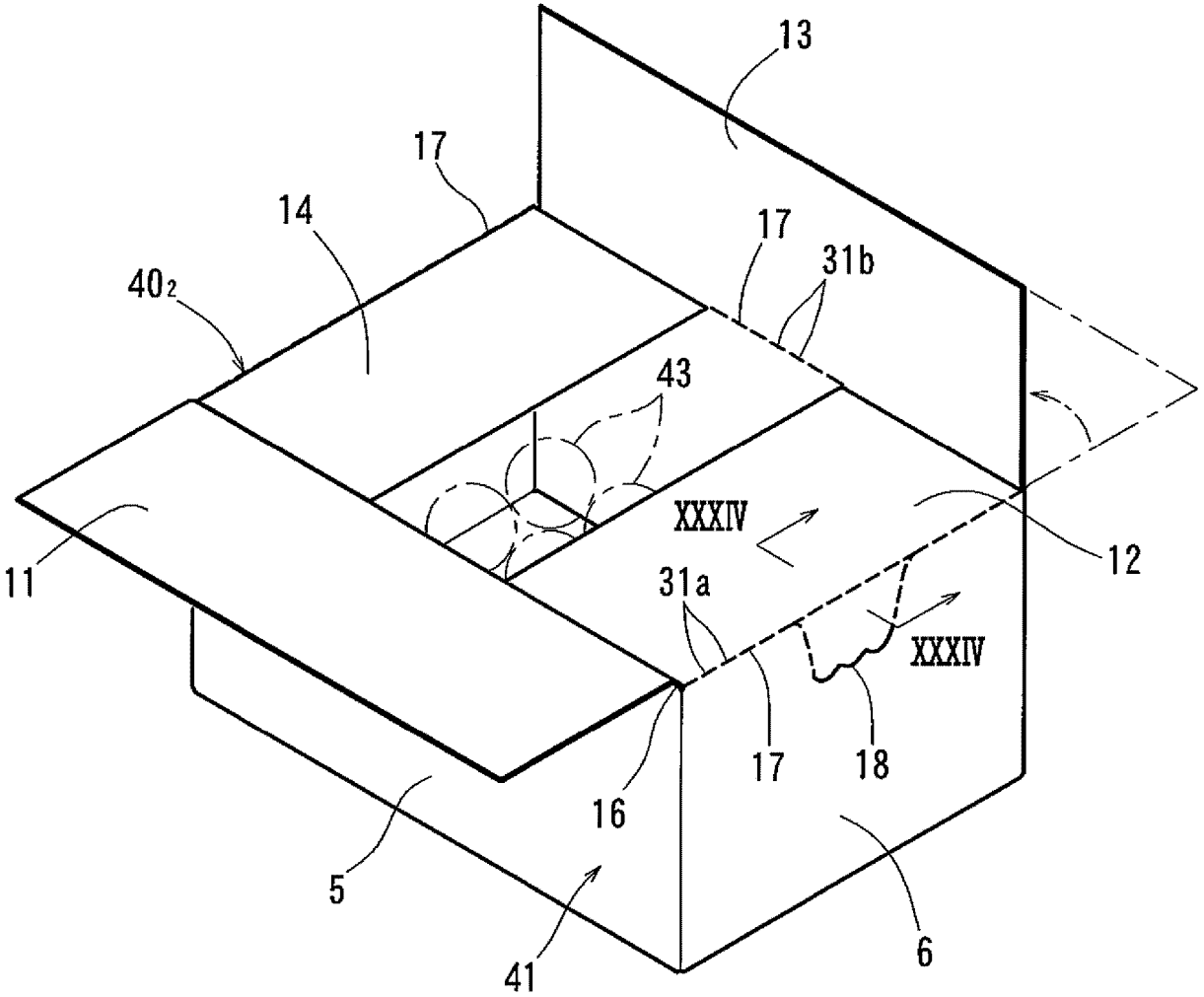
FIG. 30 is a perspective view of the corrugated paperboard box, the view illustrating the process of bending the top flaps of FIG. 29 toward the inner surface of the peripheral wall.
Figure 31:
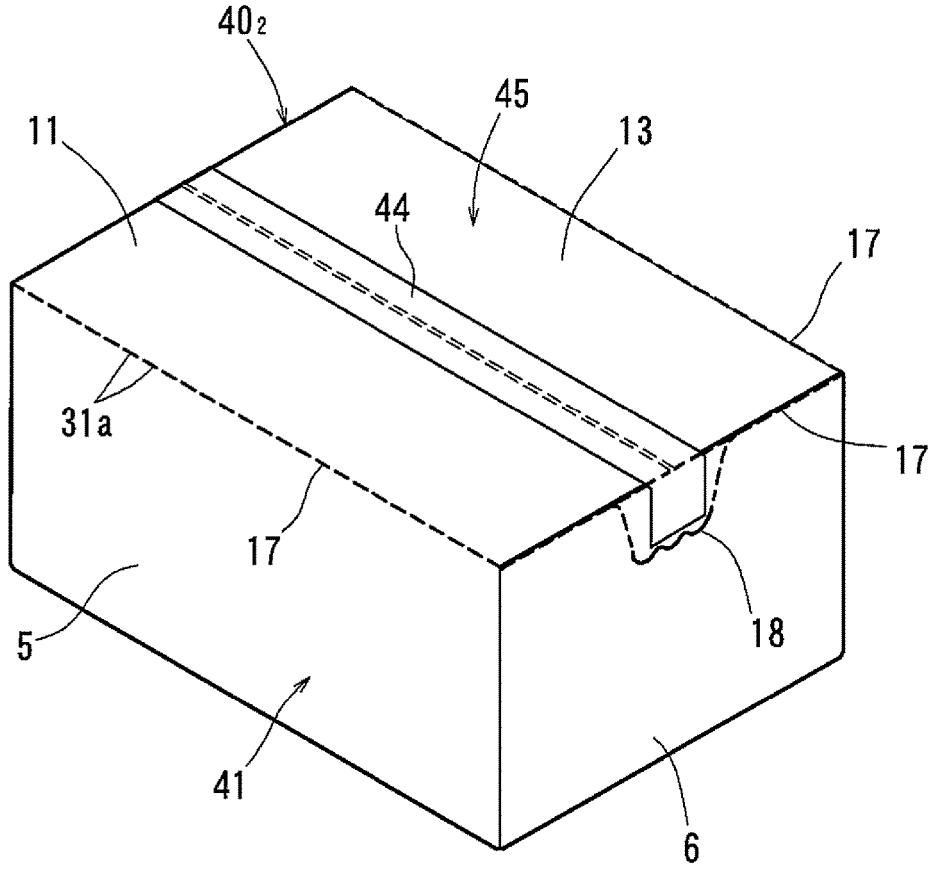
FIG. 31 is a perspective view of the corrugated paperboard box which has been sealed by closing the upper end opening of the peripheral wall by the top flaps of FIG. 30.
Figure 34:
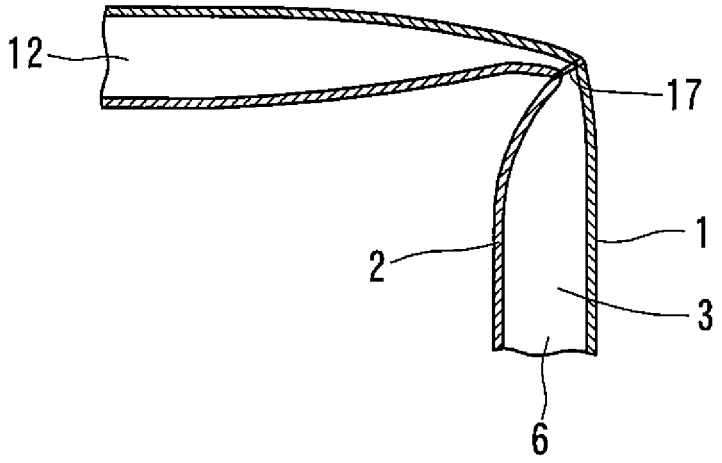
FIG. 34 is a sectional view taken along line XXXIV-XXXIV of FIG. 30.

Thereafter, the top flaps 11, 12, 13 and 14 are bent toward the inner surface of the peripheral wall 41 (i.e., bent inwardly) as illustrated in FIGS. 30 and 31. At this time, the top flaps 11, 12, 13 and 14 are bent inwardly along the perforated line 17 (see FIG. 34). Thereafter, a lid 45 is formed by joining the distal ends of the top flaps 11 and 13 to each other by means of an adhesive tape 44.

For example, the corrugated paperboard box $\mathbf{40}_2$ constructed in this way can be opened as described below.

Figure 32:
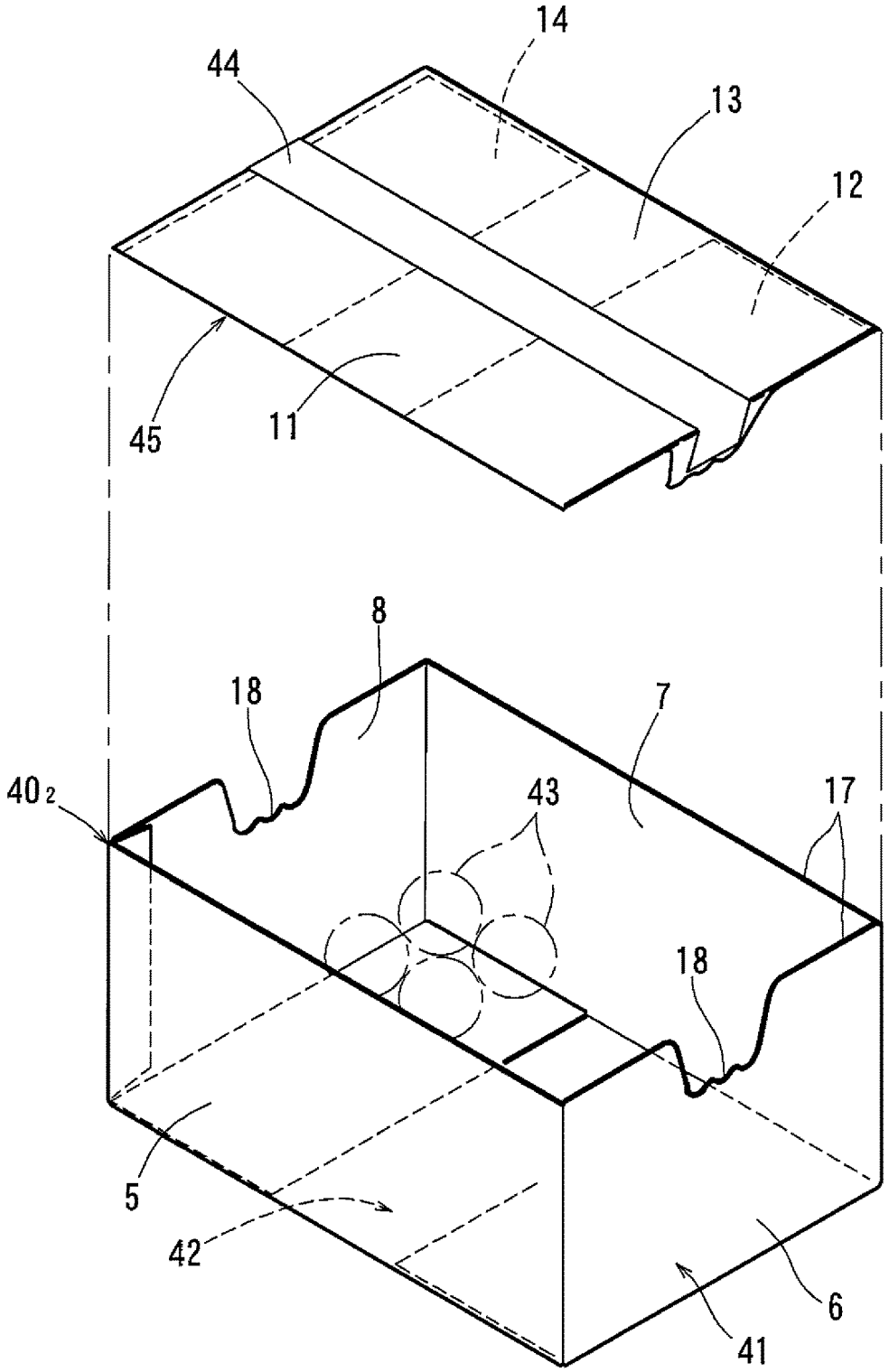
FIG. 32 is a perspective view of the corrugated paperboard box which has been opened by separating the top flaps of FIG. 31 along the perforated line from the peripheral wall.

A user severs the box along the opening assisting cut lines 18 of the respective side panels 6 and 8 illustrated in FIG. 31, inserts his/her fingers into these severed portions, and pulls up the top flaps 12 and 14, so that as illustrated in FIG. 32, the top flaps 12 and 14 are separated along the perforated line 17 from the side panels 6 and 8, respectively. At this time, the top flaps 11 and 13 are also pulled up together with the top flaps 12 and 14, and separated along the perforated line 17 from the side panels 5 and 7, respectively. In this way, it is possible to open the corrugated paperboard box $\mathbf{40}_2$ by smoothly separating the lid 45, constituted by the top flaps 11, 12, 13 and 14, from the peripheral wall 41 without using a cutter or any other cutting means.

This corrugated paperboard box $\mathbf{40}_2$ is configured such that, as described later, when the reverse scoreline 16 is formed, a large load is applied to the outer linerboard 1, whereas when the perforated line 17 is formed, a large load is applied to the inner linerboard 2 on the opposite side of the outer linerboard 1, namely loads do not concentrate on one of the outer and inner linerboards 1 and 2 when the reverse scoreline 16 and the perforated line 17 are formed. Therefore, the perforated line 17 is relatively less likely to break. This can prevent the perforated line 17 from breaking both when the top flaps 11, 12, 13 and 14 are bent along the perforated line 17 toward the outer surface of the peripheral wall 41 (i.e., toward the inner linerboard 1), and when the top flaps are bent along the perforated line 17 toward the inner surface of the peripheral wall 41 (i.e., toward the outer linerboard 2).

Since the perforated line 17 of this corrugated paperboard box $\mathbf{40}_2$ is formed such that as illustrated in FIG. 26, the peripheral edge portions 32 of the respective cut portions 31*a* on the side of the outer linerboard 1 have a protruding shape, and the peripheral edge portions 33 of the respective cut portions 31*b* on the side of the inner linerboard 2 have a recessed shape, when the top flaps 11, 12, 13 and 14 are bent along the perforated line 17 toward the inner surface of the peripheral wall 41, it is possible to effectively prevent the breakage of the perforated line 17 due to the tension applied to the outer linerboard 1.

It is possible to suitably manufacture the corrugated paperboard box $\mathbf{40}_2$ of the second embodiment by use of a corrugator similar to the one described in the first embodiment. As for the elements of this corrugator corresponding to those of the corrugator described in the first embodiment, the same reference numerals as used in the first embodiment are used below, and their description is omitted.

As illustrated in FIG. 15, the slitter scorer 50 of this corrugator includes a reverse scoreline forming device 64 configured to sandwich a corrugated paperboard sheet 55 between the upper reverse scoreline ring 67 and the lower reverse scoreline ring 68.

Figure 35:
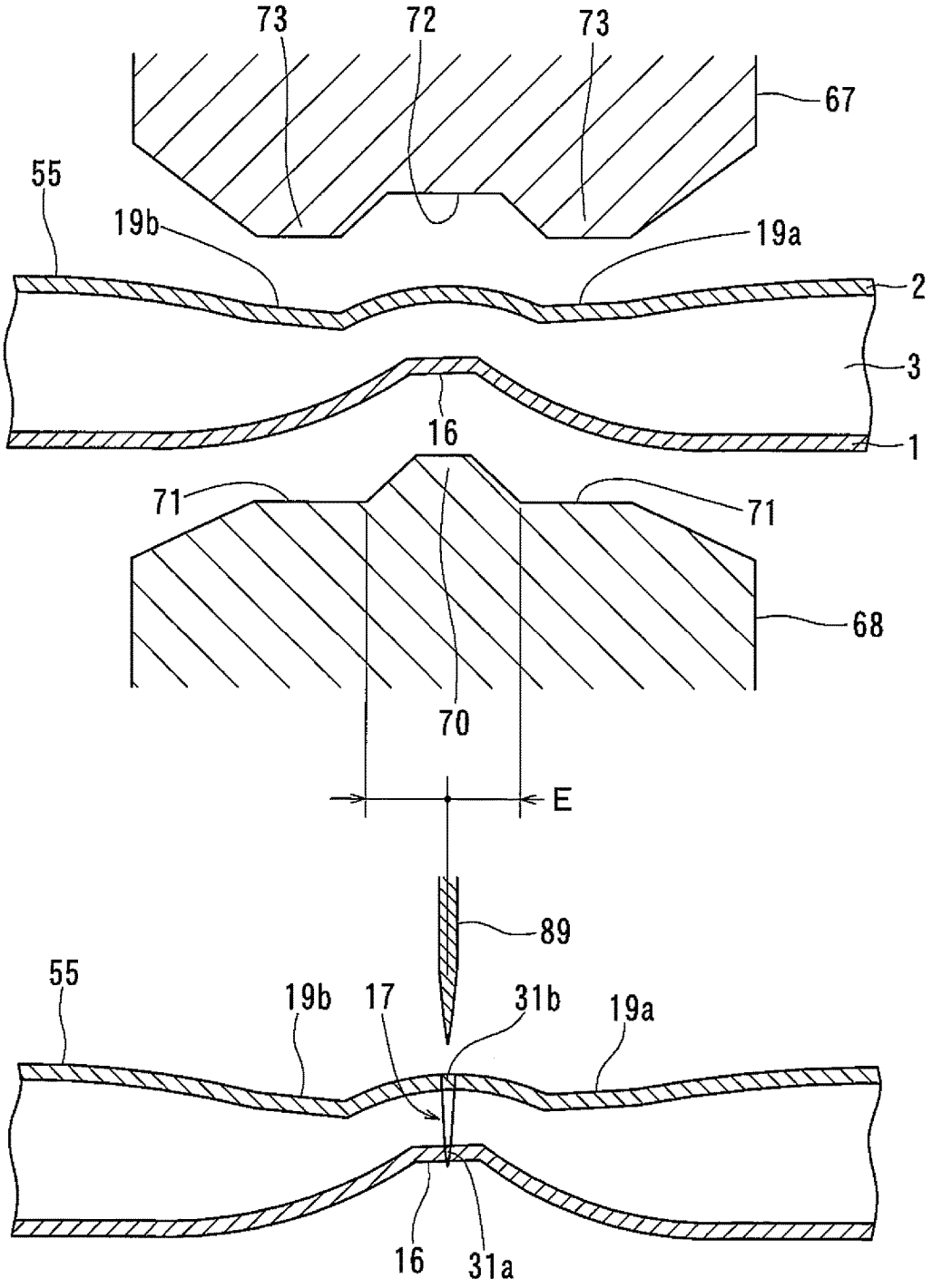
FIG. 35 is a view schematically illustrating the relative positional relationship between reverse scoreline rings and a perforation forming knife which form, respectively, the reverse scoreline and the perforated line of the blank illustrated in FIG. 24.

As illustrated in FIG. 35, the upper reverse scoreline ring 67 and the lower reverse scoreline ring 68 sandwich the corrugated paperboard sheet 55 between the groove 72 of the upper ring 67 and the protrusion 70 of the lower ring 68, thereby forming in the corrugated paperboard sheet 55 the groove-shaped reverse scoreline 16 recessed on the lower side of the paperboard sheet 55 (i.e., on the side of the outer linerboard 1). At this time, the reverse scoreline ring 67 and the lower reverse scoreline ring 68 also sandwich the corrugated paperboard sheet 55 between the pair of groove shoulders 73 of the upper ring 67 and the pair of recesses 71 of the lower ring 68, thereby simultaneously forming therein the pair of groove-shaped recesses 19*a* and 19*b* recessed on the upper side of the paperboard sheet 55.

The perforation forming knife 89 is arranged so as to correspond to the position of the protrusion 70 such that the perforated line 17 is formed within the reverse scoreline 16, which has been formed by sandwiching the corrugated paperboard sheet 55 between the groove 72 of the upper reverse scoreline ring 67 and the protrusion 70 of the lower reverse scoreline ring 68. The perforation forming knife 89 is aligned in the conveying direction with the area E of the protrusion 70 (area of the lower ring 68 protruding from the outer peripheral cylindrical surfaces of the recesses 71 illustrated in FIG. 35).

When this corrugator is used to manufacture a corrugated paperboard sheet 55, since the perforation forming knife 89 cuts the corrugated paperboard sheet 55 from the side of the inner linerboard 2 toward the side of the outer linerboard 1, as illustrated in FIGS. 25(A) and 25(C), the widths $W_1$ of the cut portions 31*a* of the perforated line 17 on the side of the outer linerboard 1 are smaller than the widths $W_2$ of the cut portions 31*b* of the perforated line 17 on the side of the inner linerboard 2, and as illustrated in FIG. 26, the peripheral edge portions 32 of the cut portions 31*a* on the side of the outer linerboard 1 are formed in a protruding shape, and the peripheral edge portions 33 of the cut portions 31*b* on the side of the inner linerboard 2 are formed in a recessed shape.

Figure 36:
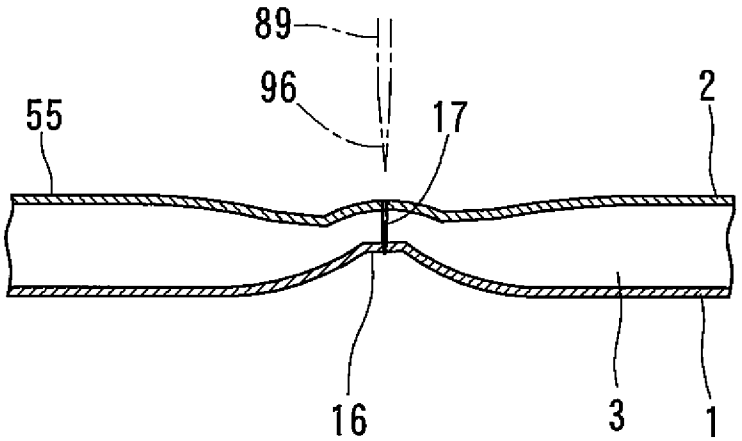
FIG. 36(A) is a sectional view of a corrugated paperboard sheet according to a comparative example in which the perforated line is formed within a normal scoreline recessed on the side of the inner linerboard by cutting the sheet from the side of the inner linerboard.
FIG. 36(B) is a sectional view of a corrugated paperboard sheet according to the second embodiment in which the perforated line is formed within the reverse scoreline recessed on the side of the outer linerboard by cutting the sheet from the side of the inner linerboard.
Figure 36:
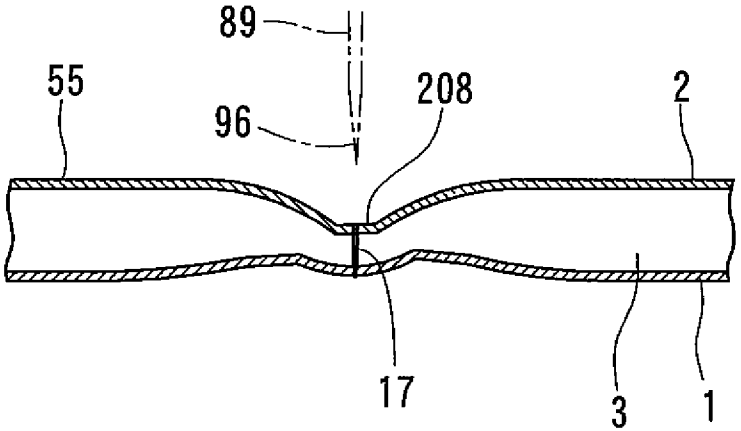

Since the reverse scoreline 16 and the perforated line 17 are formed in this way, when the reverse scoreline 16 is formed, a large load is applied to the outer linerboard 1, whereas when the perforated line 17 is formed, a large load is applied to the inner linerboard 2 on the opposite side of the outer linerboard 1. Thus, the perforated line 17 is relatively less likely to break. Namely, if, as illustrated in FIG. 36(A), a normal scoreline 208 recessed on the side of the inner linerboard 2, and the perforated line 17, cut from the side of the inner linerboard 2, are formed in the corrugated paperboard sheet 55 such that the perforated line 17 is located within the normal scoreline 208, when the normal scoreline 208 is formed, the inner linerboard 2 is pulled and receives a large load, and when the perforated line 17 is formed too, due to the thickness of the cutting portions 96 of the perforation forming knife 89, the inner linerboard 2 receives a larger load than the load which the outer linerboard 1 receives. Namely, loads concentrate on the inner linerboard 2, so that the perforated line 17 tends to break very easily on the side of the inner linerboard 2. In contrast thereto, if, as illustrated in FIG. 36(B), the reverse scoreline 16, recessed on the side of the outer linerboard 1, and the perforated line 17, cut from the side of the inner linerboard 2, are formed in the corrugated paperboard sheet 55 such that the perforated line 17 is located within the reverse scoreline 16, when the reverse scoreline 16 is formed, the outer linerboard 1 receives a large load, and when the perforated line 17 is formed, the inner linerboard 2 on the opposite side of the outer linerboard 1 receives a large load due to the thickness of the cutting portions 96 of the perforation forming knife 89. Namely, loads do not concentrate on one of the outer and inner linerboards 1 and 2, so that the perforated line 17 is relatively less likely to break. Therefore, if the corrugated paperboard box $\mathbf{40}_2$ is formed by a corrugated paperboard sheet 55 in which the reverse scoreline 16 and the perforated line 17 are formed as described above, it is possible to prevent the perforated line 17 from breaking both when the top flaps 11, 12, 13 and 14 are bent along the perforated line 17 toward the inner linerboard 1 (toward the outer surface of the peripheral wall 41 illustrated in FIG. 28), and when the top flaps are bent along the perforated line 17 toward the outer linerboard 2 (toward the inner surface of the peripheral wall 41 illustrated in FIG. 28).

Figure 37:
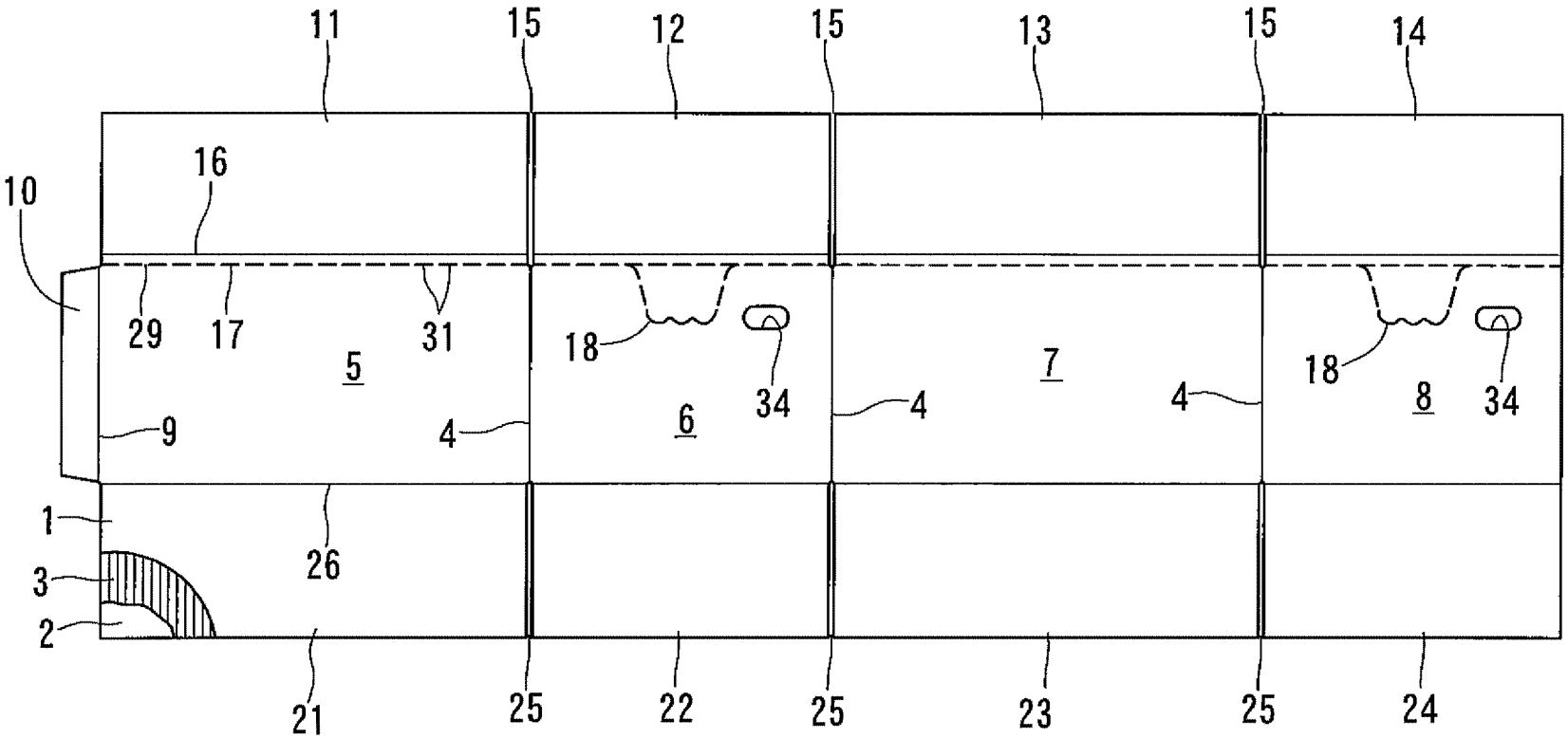
FIG. 37 is a view of the blank of a corrugated paperboard box according to a third embodiment of the present invention, when seen from the side of the outer linerboard (of the blank).

FIG. 37 illustrates the blank of a corrugated paperboard box $\mathbf{40}_3$ (see FIG. 44) according to the third embodiment of the present invention. As for the elements corresponding to those of (the blank of) the corrugated paperboard box $\mathbf{40}_1$ described in the first embodiment, the same reference numerals as used in the first embodiment are used below, and their description is omitted.

The blank of the box $\mathbf{40}_3$ is formed between the side panels 5, 6, 7 and 8 and the top flaps 11, 12, 13 and 14 with a normal scoreline 29 along which the top flaps 11, 12, 13 and 14 can be bent inwardly, and which extends in the direction perpendicular to the corrugations of the corrugated paperboard. The blank of the box $\mathbf{40}_3$ is further formed between the side panels 5, 6, 7 and 8 and the 11, 12, 13 and 14 with a perforated line 17 which is located within the normal scoreline 29, and along which the top flaps 11, 12, 13 and 14 can be separated from the box.

The blank of the box $\mathbf{40}_3$ is further formed at the proximal end portions (roots) of the top flaps 11, 12, 13 and 14 (i.e., at the end portions thereof close to the normal scoreline 29) with a reverse scoreline 16 along which the top flaps 11, 12, 13 and 14 can be bent outwardly. The reverse scoreline 16 extends in parallel to the normal scoreline 29, and thus, in the direction perpendicular to the corrugations of the corrugated paperboard, while spaced apart from the normal scoreline 29 toward the top flaps 11, 12, 13 and 14.

The side panels 6 and 8 are each formed with an opening assisting cut line 18 having a central portion located at a lower level than the perforated line 17, and connected at both ends thereof to the perforated line 17. In the drawings, the central portion of the cut line 18 is constituted by a single continuous cut, and both end portions thereof are each constituted by a perforated line comprising disconnected perforations. The side panels 6 and 8 are each formed with a hand hole 34 located outside of the area of the side panel 6, 8 surrounded by the perforated line 17 and the cut line 18.

Figure 38:
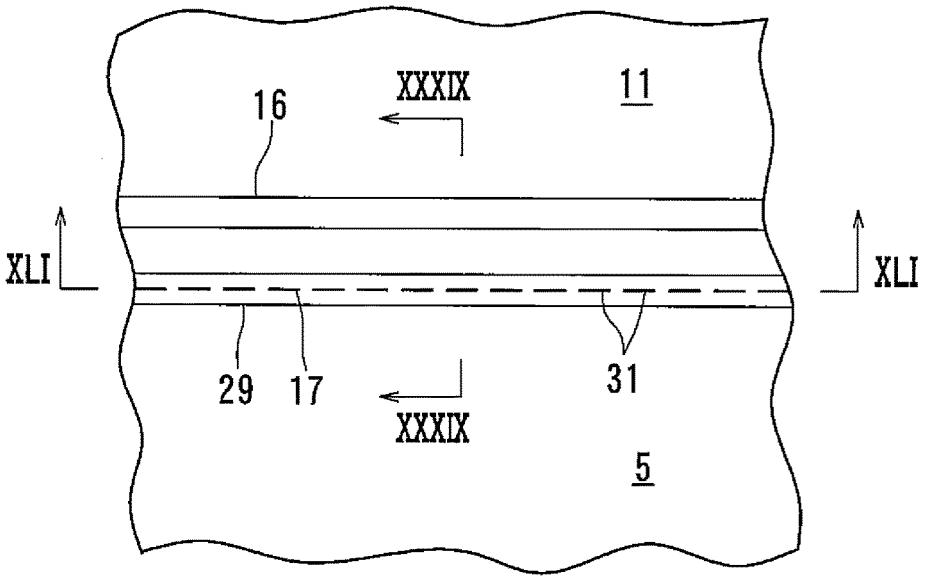
FIG. 38 is an enlarged view illustrating the vicinity of the normal scoreline and the perforated line formed between the top flaps and the side panels of the blank illustrated in FIG. 37.
Figure 39:
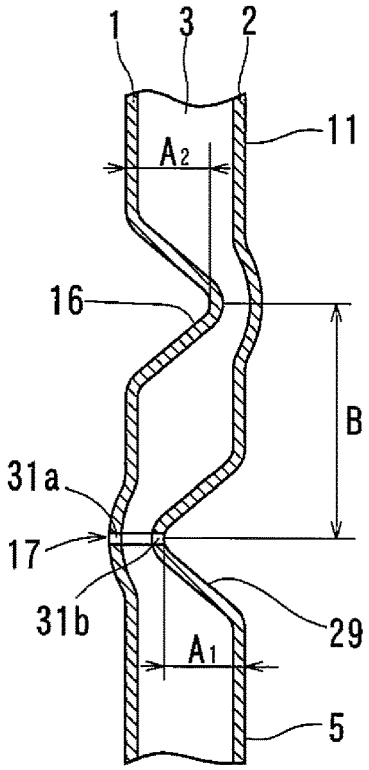
FIG. 39 is an enlarged sectional view taken along line XXXIX-XXXIX of FIG. 38.
Figure 40:
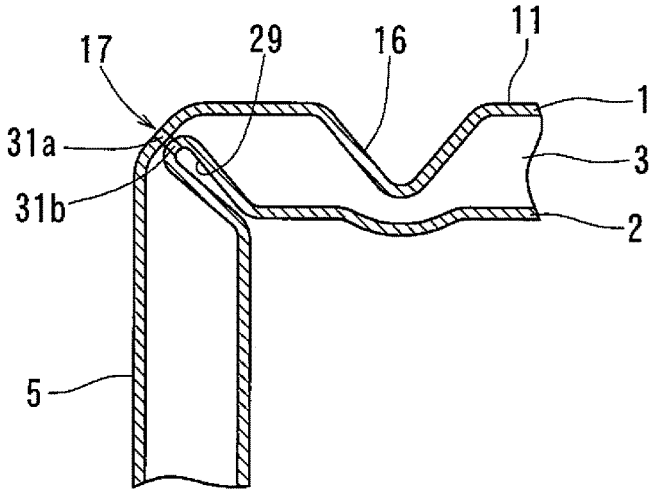
FIG. 40 is an enlarged sectional view illustrating the top flaps of FIG. 39 bent toward the inner linerboard (of the blank).
Figure 42:
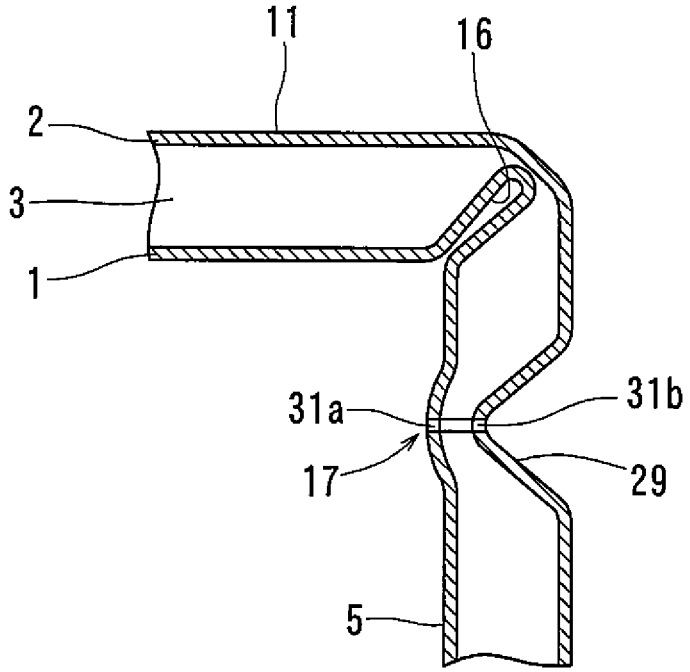
FIG. 42 is an enlarged sectional view illustrating the top flaps of FIG. 39 bent toward the outer linerboard.

As illustrated in FIGS. 38 and 39, the normal scoreline 29 is a groove-shaped scoreline recessed on the side of the inner linerboard 2 so that as illustrated in FIG. 40, the top flaps 11, 12, 13 and 14 can be bent along the normal scoreline 29 toward the inner linerboard 2. As illustrated in FIG. 39, the perforated line 17 is formed in (i.e., extends through) the bottom of the (groove-shaped) normal scoreline 29. The reverse scoreline 16 is a groove-shaped scoreline recessed on the side of the outer linerboard 1 so that as illustrated in FIG. 42, the top flaps 11, 12, 13 and 14 can be bent along the reverse scoreline 16 toward the outer linerboard 1.

As illustrated in FIG. 39, the depth $A_2$ of the reverse scoreline 16 is set to be equal to or larger than the depth $A_1$ of the normal scoreline 29. Also, the reverse scoreline 16 is arranged such that the distance B between the center of the normal scoreline 29 and the center of the reverse scoreline 16 is set within 5 mm to 20 mm. The center of the normal scoreline 29 is located at the deepest portion of the normal scoreline 29, as measured from the surface of the inner linerboard 2. The center of the reverse scoreline 16 is located at the deepest portion of the reverse scoreline 16, as measured from the surface of the outer linerboard 1.

As illustrated in FIG. 38, the perforated line 17 comprises multiple of cuts 31 spaced apart from each other at predetermined intervals, and aligned in a straight line extending in parallel to the normal scoreline 29. The cuts 31 are equal in length to each other.

Figure 41:
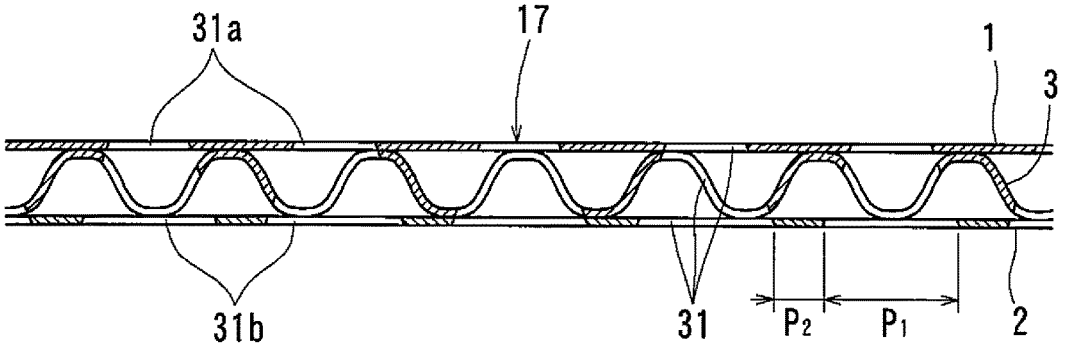
FIG. 41 is an enlarged sectional view taken along line XLI-XLI of FIG. 38.

As illustrated in FIG. 41, the cuts 31 extend to penetrate through the outer linerboard 1, the corrugated medium 3 and the inner linerboard 2, and each includes a cut portion 31*a* formed in the outer linerboard 1, and a cut portion 31*b* formed in the inner linerboard 2. Each cut portion 31*a* on the side of the outer linerboard 1 is aligned in the thickness direction of the blank with the corresponding cut portion 31*b* on the side of the inner linerboard 2. The lengths of the cut portions 31*a* on the side of the outer linerboard 1 are smaller than those of the cut portions 31*b* on the side of the inner linerboard 2, so that the lengths of the joint portions between the adjacent pairs of cut portions 31*a* on the side of the outer linerboard 1 are larger than those of the joint portions between the adjacent pairs of cut portions 31*b* on the side of the inner linerboard 2. Also, the widths of the cut portions 31*a* on the side of the outer linerboard 1 (i.e., the dimensions thereof in the direction orthogonal to the direction in which the perforated line 17 extends) are smaller than those of the cut portions 31*b* on the side of the inner linerboard 2.

Figure 48:
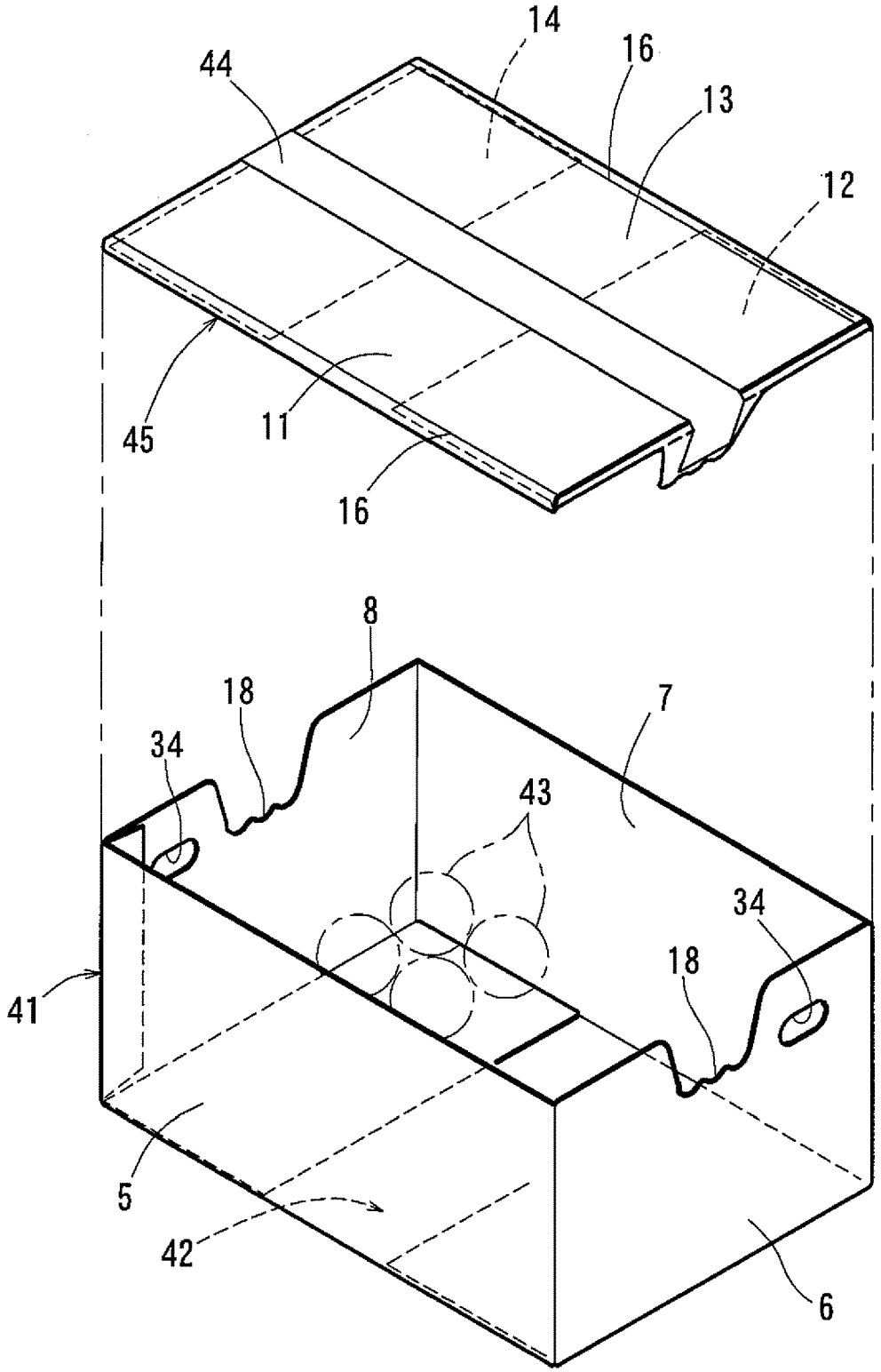
FIG. 48 is a perspective view of the corrugated paperboard box of FIG. 47 which has been opened.

The distance between each adjacent pair of cut portions 31*a* on the side of the outer linerboard 1 (i.e., the length of the joint portion therebetween) is set within 2 mm to 4 mm (preferably 2.5 mm to 3.5 mm). By setting this distance to be 2 mm or over (preferably 2.5 mm or over), it is possible to prevent the breakage of the outer linerboard 1 along the perforated line 17 due to the tension applied to the outer linerboard 1 when the top flaps 11, 12, 13 and 14 (see FIG. 37) are bent at a right angle along the perforated line 17 toward the inner linerboard 2. By setting this distance to be 4 mm or less (preferably 3.5 mm or less), a smooth and clean surface will appear on the box when the top flaps 11, 12, 13 and 14 are separated along the perforated line 17 will be smooth and clean as illustrated in FIG. 48.

As illustrated in FIG. 41, the ratio of the length $P_1$ (i.e., the length of each cut portion 31*b* on the side of the inner linerboard 2) to the length $P_2$ (i.e., the length of the joint portion between each adjacent pair of cut portions 31*b*) is set within the range of 2:1 to 4:1. The length $P_2$ can be set within 2 mm to 4 mm (preferably 2.5 mm to 3.5 mm).

For example, the blank illustrated in FIG. 37 can be formed into the box $\mathbf{40}_3$ as described below.

Figure 44:
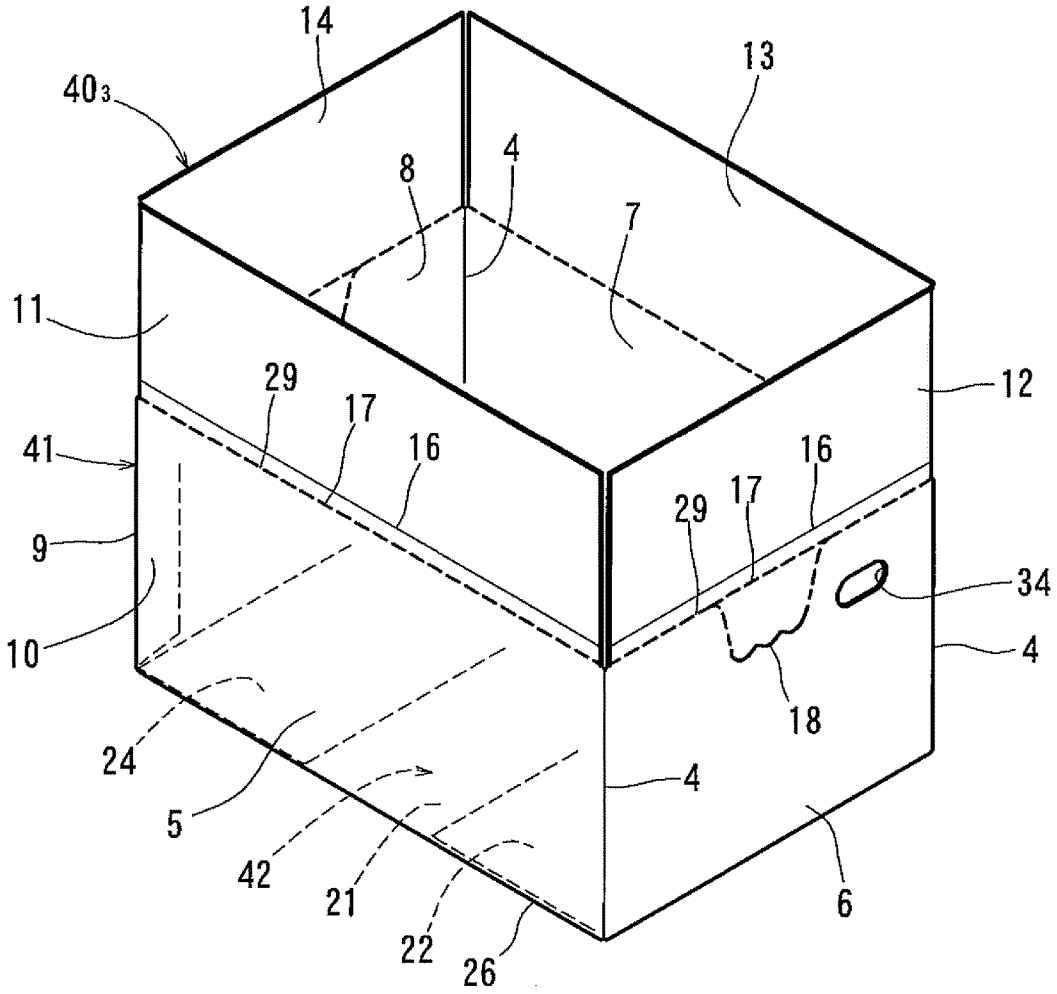
FIG. 44 is perspective view of the corrugated paperboard box which has been partially constructed from the blank of FIG. 37, namely, of which the top flaps have not been bent yet.

As illustrated in FIG. 44, first, the side panels 5, 6, 7 and 8 are bent along the respective scorelines 4 into a tubular shape such that the inner linerboard 2 constitutes the inner surface of the corrugated paperboard box $\mathbf{40}_3$, and the joint flap 10, integrally connected to the side panel 5 at one end of the blank, is bonded to the inner surface of the side panel 8 at the other end of the blank so that the side panels 5, 6, 7 and 8 constitute the peripheral wall 41 of the box $\mathbf{40}_3$. Second, the bottom flaps 22 and 24, which are integrally connected to the respective lower ends of the side panels 6, and 8, which correspond to or constitute the widthwise surfaces of the box $\mathbf{40}_3$, are bent along the normal scoreline 26 toward the inner surface of the peripheral wall 41, and the bottom flaps 21 and 23, which are integrally connected to the respective lower ends of the side panels 5, and 7, which correspond to or constitute the lengthwise surfaces of the box $\mathbf{40}_3$, are bent along the normal scoreline 26 toward the inner surface of the peripheral wall 41 such that the bottom flaps 21, 22, 23 and 24 constitute a bottom 42 that closes the lower end opening of the peripheral wall 41. The distance between the normal scoreline 29 and the reverse scoreline 16 (i.e., the distance B illustrated in FIG. 39) is shown exaggeratedly, i.e., shown to be larger than its actual size.

Figure 45:
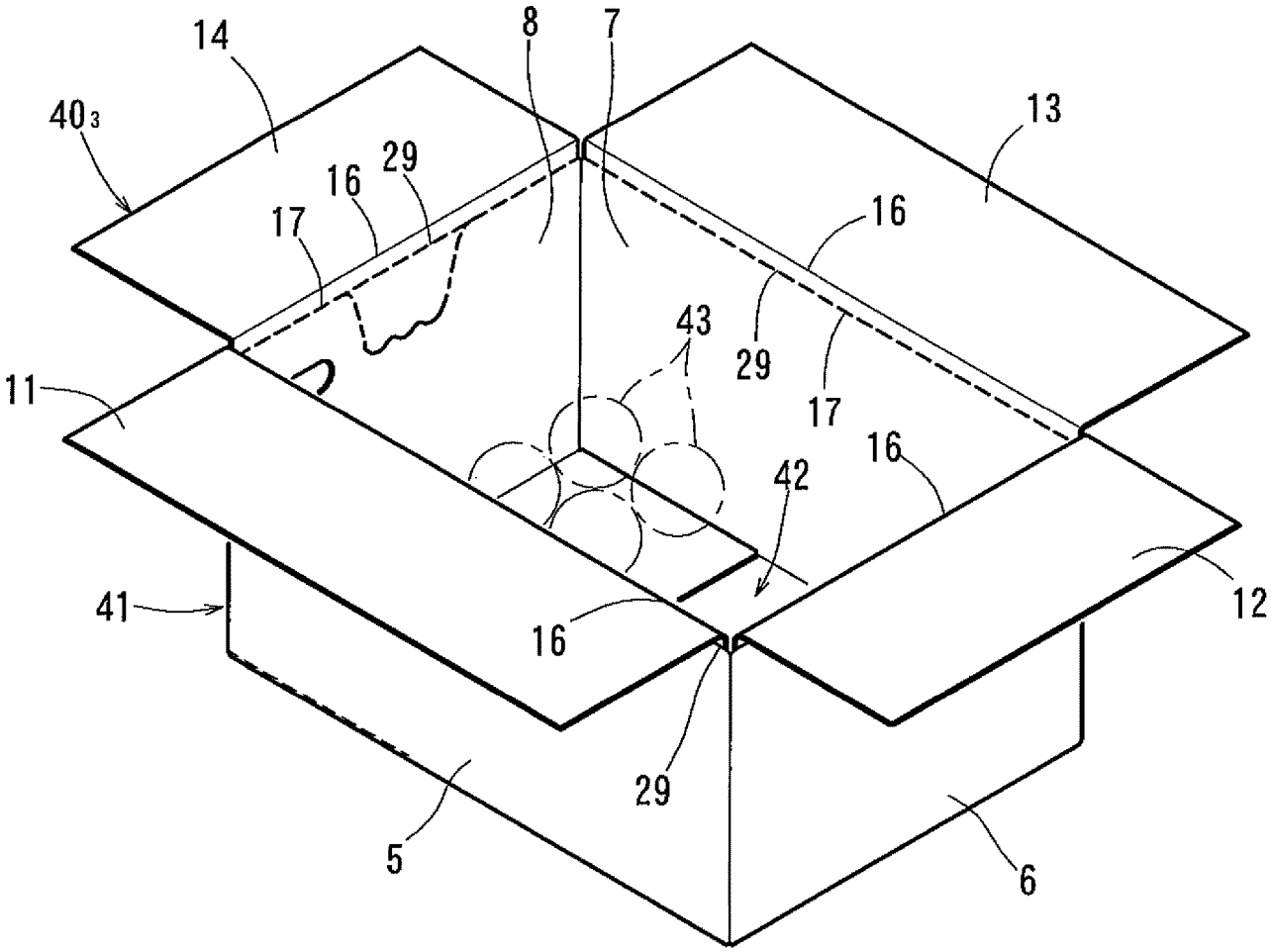
FIG. 45 is a perspective view of the corrugated paperboard box of which the top flaps illustrated in FIG. 44 have been bent toward the outer surface of the peripheral wall (of the box), and in which products have been placed.

Products 43 are then packed in the thus formed corrugated paperboard box $\mathbf{40}_3$. At this time, in order to enable the products 43 to be easily placed into the box $\mathbf{40}_3$, the top flaps 11, 12, 13 and 14 are bent toward the outer surface of the peripheral wall 41 (i.e., bent in the reverse direction) as illustrated in FIG. 45. The normal scoreline 29 has the following characteristic: Since the normal scoreline 29 is recessed on the side of the inner linerboard 2 as illustrated in FIG. 39, the top flaps 11, 12, 13 and 14 can be bent with a relatively small force along the normal scoreline 29 toward the inner linerboard 2, whereas a relatively large force is required to bend the top flaps 11, 12, 13 and 14 along the normal scoreline 29 toward the outer linerboard 1. On the other hand, the reverse scoreline 16 has the following characteristic: Since the reverse scoreline 16 is recessed on the side of the inner linerboard 1, the top flaps 11, 12, 13 and 14 can be bent with a relatively small force along the reverse scoreline 16 toward the outer linerboard 1, whereas a relatively large force is required to bend the top flaps 11, 12, 13 and 14 along the reverse scoreline 16 toward the inner linerboard 2.

Figure 43:
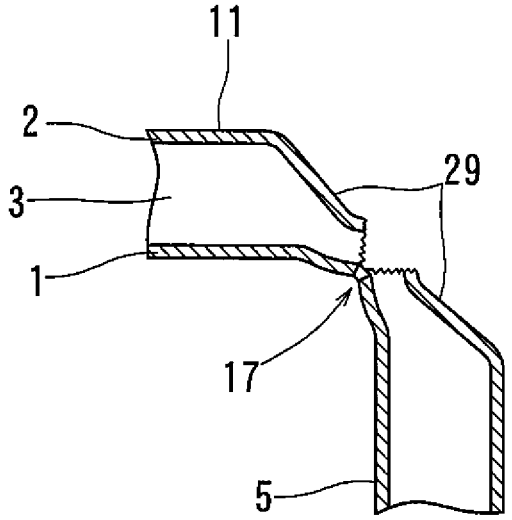
FIG. 43 is an enlarged sectional view illustrating the top flaps bent toward the outer linerboard in the blank in which the reverse scoreline of FIG. 39 is not formed.

Therefore, when the top flaps 11, 12, 13 and 14 are bent toward the outer surface of the peripheral wall 41 as illustrated in FIGS. 42 and 45, the top flaps 11, 12, 13 and 14 are bent not along the normal scoreline 29 but along the reverse scoreline 16. If, however, no reverse scoreline 16 were formed in the box $\mathbf{40}_3$, the top flaps 11, 12, 13 and 14 would be bent along the normal scoreline 29 as illustrated in FIG. 43 when bent toward the outer surface of the peripheral wall 41, so that the boundary area between the peripheral wall 41 and the top flaps 11, 12, 13 and 14 might break along the perforated line 17 due to the tension applied to the inner linerboard 2. In contrast thereto, since this corrugated paperboard box $\mathbf{40}_3$ is formed with the reverse scoreline 16 at a position spaced apart from the normal scoreline 29 toward the top flaps 11, 12, 13 and 14, when the top flaps 11, 12, 13 and 14 are bent toward the outer surface of the peripheral wall 41, it is possible to prevent the top flaps 11, 12, 13 and 14 from being bent along the normal scoreline 29, and thus to prevent the breakage of the perforated line 17.

Figure 46:
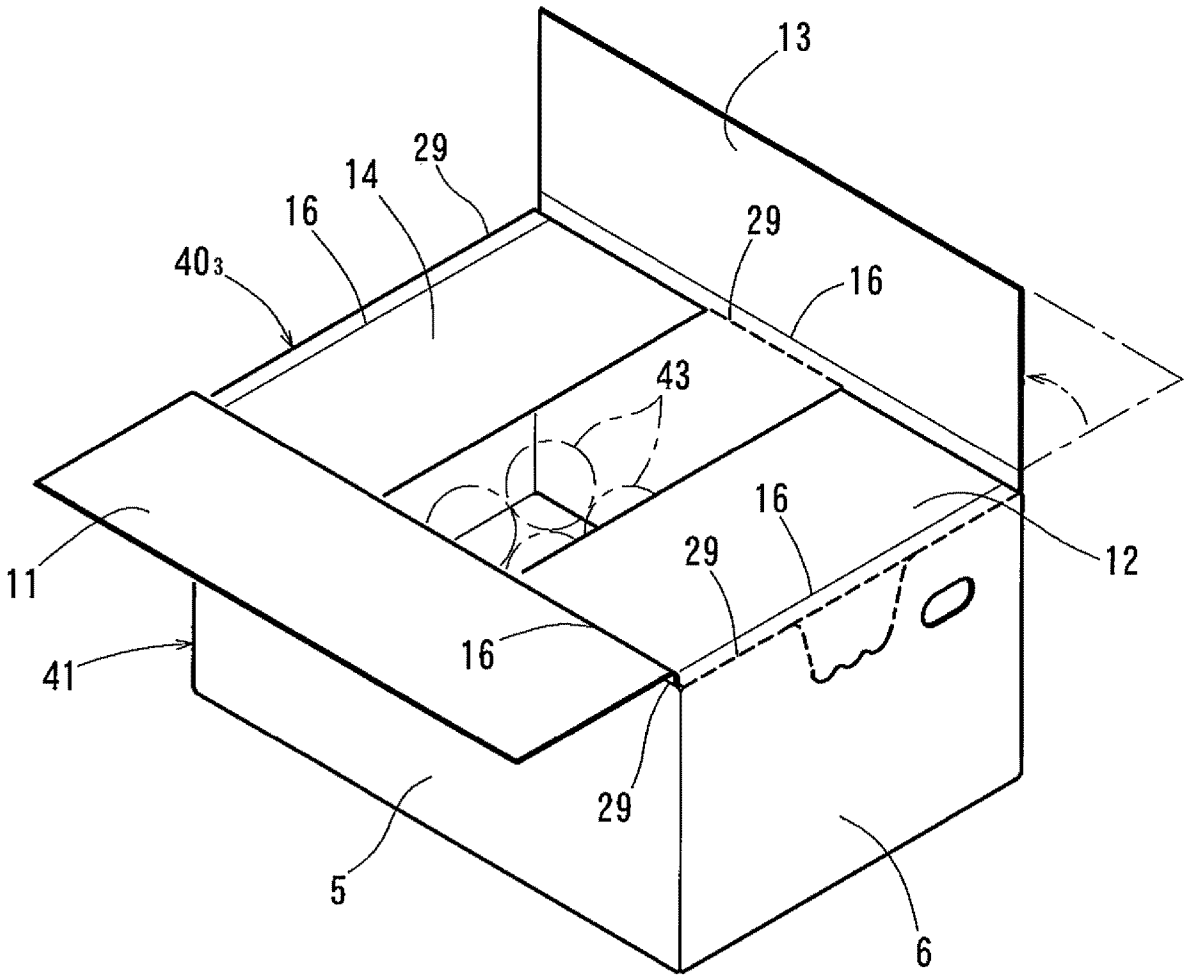
FIG. 46 is a perspective view of the corrugated paperboard box, the view illustrating the process of bending the top flaps of FIG. 45 toward the inner surface of the peripheral wall.
Figure 47:
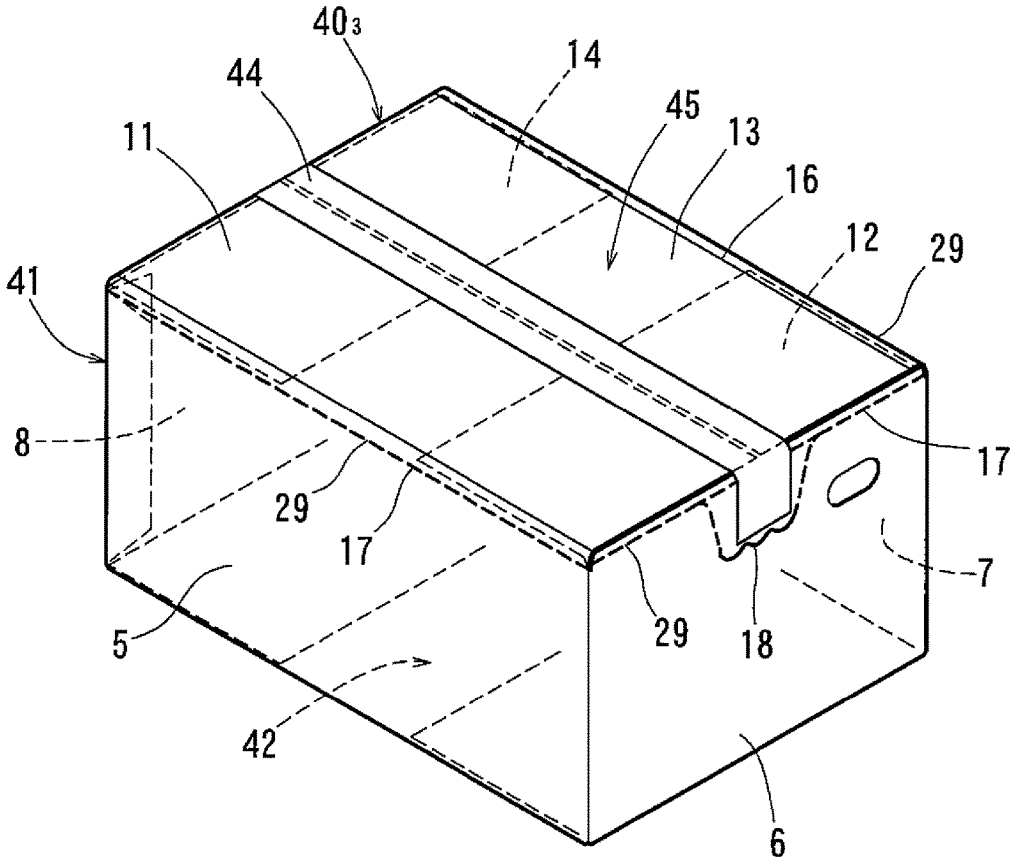
FIG. 47 is a perspective view of the corrugated paperboard box which has been sealed by closing the upper end opening of the peripheral wall by the top flaps of FIG. 46.

Thereafter, as illustrated in FIGS. 46 and 47, the top flaps 12 and 14 are bent along the normal scoreline 29 toward the inner surface of the peripheral wall 41, and the top flaps 11 and 13 are bent along the normal scoreline 29 toward the inner surface of the peripheral wall 41. When the top flaps 11, 12, 13 and 14 are bent toward the inner surface of the peripheral wall 41 (i.e., bent in the normal direction), the top flaps 11, 12, 13 and 14 are bent not along the reverse scoreline 16 but along the normal scoreline 29 (see FIG. 40) due to the above characteristics of the normal scoreline 29 and the reverse scoreline 16. Thereafter, a lid 45 is formed by joining the distal ends of the top flaps 11 and 13 to each other by means of an adhesive tape 44.

As illustrated in FIG. 47, with the top flaps 11, 12, 13 and 14 bent toward the inner surface of the peripheral wall 41, the reverse scoreline 16 is located not in the vertically extending peripheral wall 41 but in the lid 45. Therefore, though the corrugated paperboard box $\mathbf{40}_3$ is formed with the reverse scoreline 16, the reverse scoreline 16 hardly decreases the compressive strength of the box $\mathbf{40}_3$ (especially the endurance strength of the box $\mathbf{40}_3$ when vertical compressive loads are applied to the box $\mathbf{40}_3$).

For example, the corrugated paperboard box $\mathbf{40}_3$ formed in this way can be opened as described below.

A user severs the box along the opening assisting cut lines 18 of the respective side panels 6 and 8 illustrated in FIG. 47, inserts his/her fingers into these severed portions, and pulls up the top flaps 12 and 14, so that as illustrated in FIG. 48, the top flaps 12 and 14 are separated along the normal scoreline 29 and the perforated line 17 from the side panels 6 and 8, respectively. At this time, the top flaps 11 and 13 are also pulled up together with the top flaps 12 and 14, and thus separated along the normal scoreline 29 and the perforated line 17 from the side panels 5 and 7, respectively. In this way, it is possible to open the corrugated paperboard box $\mathbf{40}_3$ by smoothly separating the lid 45, constituted by the top flaps 11, 12, 13 and 14, from the peripheral wall 41 without using a cutter or any other cutting means.

Since this corrugated paperboard box $\mathbf{40}_3$ is configured such that when the top flaps 11, 12, 13 and 14 are bent toward the outer surface of the peripheral wall 41, the top flaps are bent not along the normal scoreline 29, in which the perforated line 17 is formed, but along the reverse scoreline 16, in which no perforated line 17 is formed, when products 43 are packed in the box $\mathbf{40}_3$, it is possible to prevent the breakage of the boundary area between the peripheral wall 41 and the top flaps 11, 12, 13 and 14 along the perforated line 17.

Since the depth $A_2$ of the reverse scoreline 16 (see FIG. 39) is set to be equal to or larger than the depth $A_1$ of the normal scoreline 29 in this corrugated paperboard box $\mathbf{40}_3$, when the top flaps 11, 12, 13 and 14 are bent toward the outer surface of the peripheral wall 41, the top flaps are not bent along the normal scoreline 29, and can be reliably bent along the reverse scoreline 16.

Since the distance B (see FIG. 39) between the center of the normal scoreline 29 and the center of the reverse scoreline 16 is set to be 5 mm or over in this corrugated paperboard box $\mathbf{40}_3$, when the top flaps 11, 12, 13 and 14 are bent toward the outer surface of the peripheral wall 41, the top flaps are not bent simultaneously along both the normal scoreline 29 and the reverse scoreline 16. Since the distance B is set to be 20 mm or less, it is possible to effectively prevent the top flaps 11, 12, 13 and 14 from being bent not along the reverse scoreline 16 but along the normal scoreline 29 when the top flaps are bent toward the outer surface of the peripheral wall 41.

Since the perforated line 17 is formed in this corrugated paperboard box $\mathbf{40}_3$ such that the lengths of the joint portions between the adjacent pairs of cut portions 31*a* on the side of the outer linerboard 1 are larger than those of the joint portions between the adjacent pairs of cut portions 31*b* on the side of the inner linerboard 2, when the top flaps 11, 12, 13 and 14 are bent toward the inner surface of the peripheral wall 41 to form the box, the outer linerboard 1 is less likely to break.

In order to confirm that by setting the depth $A_2$ of the reverse scoreline 16 (see FIG. 39) to be equal to or larger than the depth $A_1$ of the normal scoreline 29, it is possible to prevent the top flap 11 from being bent along the normal scoreline 29 when bent toward the outer surface of the peripheral wall 41, the inventors of the present application prepared, for each of the materials shown in the below Table 4, five corrugated paperboard box samples satisfying the relation $A_1>A_2$, five corrugated paperboard box samples satisfying the relation $A_1=A_2$, and five corrugated paperboard box samples satisfying the relation $A_1<A_2$, and performed experiments to examine along which of the normal scoreline 29 and the reverse scoreline 16 the top flap 11 of each sample is bent when bent toward the outer surface of the peripheral wall 41. The experimental results are shown in Table 4.

TABLE 4

| | $A_1 > A_2$ | $A_1 = A_2$ | $A_1 < A_2$ |
|---|---|---|---|
| C160 × S120 × C160 (CF) | Δ | Δ | ○ |
| C160 × S120 × S120 (CF) | X | Δ | ○ |
| K210 × S160 × K210 (CF) | Δ | ○ | ○ |
| K280 × reinforcement 180 × K210 (AF) | Δ | ○ | ○ |

The symbols "○", "Δ" and "X" in Table 4 are described below.

The symbol "○" means that the top flaps of all of the five samples were bent only along the reverse scoreline.

The symbol "Δ" means that the top flaps of three or four of the five samples were bent only along the reverse scoreline, but the top flaps of the remaining sample or samples were bent only along the normal scoreline or bent both along the reverse scoreline and along the normal scoreline.

The symbol "X" means that the top flaps of none, one or two of the five samples were bent only along the reverse scoreline, but the top flaps of the remaining samples were bent only along the normal scoreline or bent both along the reverse scoreline and along the normal scoreline.

The above experimental results show that by setting the depth $A_2$ of the reverse scoreline 16 to be equal to, or preferably larger than, the depth $A_1$ of the normal scoreline 29, it is possible to prevent the top flap 11 from being bent along the normal scoreline 29 when bent toward the outer surface of the peripheral wall 41.

Also, in order to confirm that by setting the distance B between the center of the normal scoreline 29 and the center of the reverse scoreline 16 to be within 5 mm to 20 mm, the reverse scoreline 16 performs its expected function more effectively when the top flap 11 is bent toward the outer surface of the peripheral wall 41, the inventors of the present application prepared, for each of the materials shown in the below Table 5 and for each of the different values of the distance B shown in Table 5, five corrugated paperboard box samples, and performed experiments to examine along which of the normal scoreline 29 and the reverse scoreline 16 the top flap 11 of each sample is bent when bent toward the outer surface of the peripheral wall 41. The experimental results are shown in Table 5.

TABLE 5

| | Space B | | | | | | |
|---|---|---|---|---|---|---|---|
| Material | Under 4 mm | 4 mm or over to under 5 mm | 5 mm | 6 mm | 8 mm | 10 mm or over to under 20 mm | 20 mm or over |
| C160 × S120 × C160 (CF) | X | Δ | ○ | ○ | ○ | ○ | Δ |
| C160 × S120 × S120 (CF) | X | Δ | ○ | ○ | ○ | Δ | Δ |
| K210 × S160 × K210 (CF) | X | Δ | ○ | ○ | ○ | ○ | Δ |
| K280 × reinforcement 180 × K210 (AF) | X | X | ○ | ○ | ○ | ○ | Δ |

The symbols "○", "Δ" and "X" in Table 5 are described below.

The symbol "○" means that the top flaps of all of the five samples were bent only along the reverse scoreline.

The symbol "Δ" means that the top flaps of three or four of the five samples were bent only along the reverse scoreline, but the top flaps of the remaining sample or samples were bent only along the normal scoreline or bent both along the reverse scoreline and along the normal scoreline.

The symbol "X" means that the top flaps of none, one or two of the five samples were bent only along the reverse scoreline, but the top flaps of the remaining samples were bent only along the normal scoreline or bent both along the reverse scoreline and along the normal scoreline.

The above experimental results show that by setting the distance B between the center of the normal scoreline 29 and the center of the reverse scoreline 16 within 5 mm to 20 mm (more preferably 5 mm to 10 mm), the reverse scoreline 16 performs its expected function more effectively when the top flap 11 is bent toward the outer surface of the peripheral wall 41.

It is possible to suitably manufacture the corrugated paperboard box $\mathbf{40}_3$ of the third embodiment by use of a corrugator similar to the one described in the first embodiment. As for the elements of this corrugator corresponding to those of the corrugator described in the first embodiment, the same reference numerals as used in the first embodiment are used below, and their description is omitted.

Figure 49:
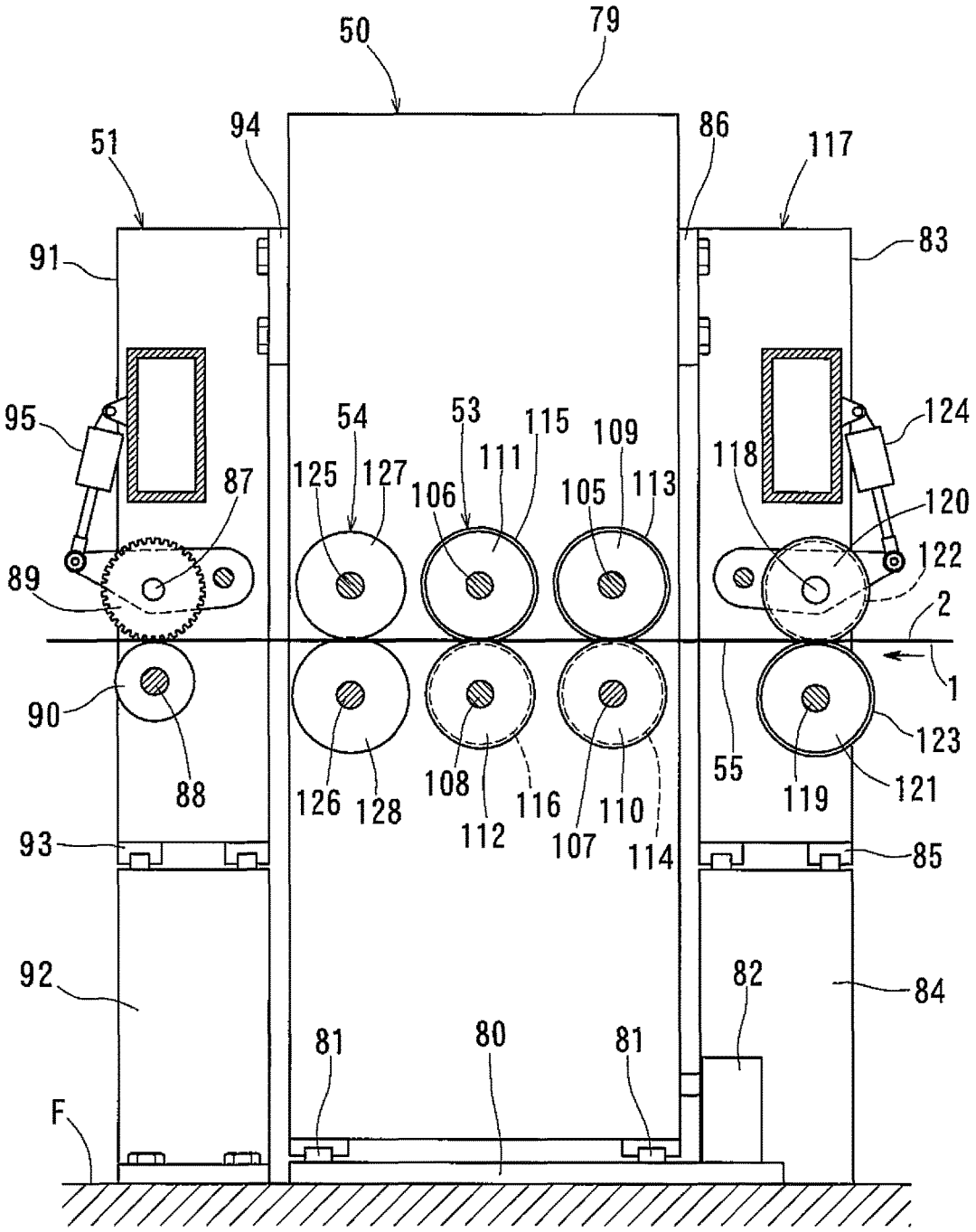
FIG. 49 is a sectional view of a corrugator suitable for manufacturing a corrugated paperboard sheet from which the blank of FIG. 37 is formed, the view illustrating a slitter scorer and a perforation forming device.

As illustrated in FIG. 49, the slitter scorer 50 of this corruagator includes a scorer 53 and a slitter 54.

The scorer 53 includes an upper first rotary shaft 105 and an upper second rotary shaft 106 which are arranged over a corrugated paperboard sheet 55, a lower first rotary shaft 107 and a lower second rotary shaft 108 which are arranged under the corrugated paperboard sheet 55, upper scoreline rings 109 fixed to the upper first rotary shaft 105, lower scoreline rings 110 fixed to the lower first rotary shaft 107, upper normal scoreline rings 111 fixed to the upper second rotary shaft 106, and lower normal scoreline rings 112 fixed to the lower second rotary shaft 108. The upper first rotary shaft 105 is vertically opposed to the lower first rotary shaft 107. The upper second rotary shaft 106 is vertically opposed to the lower second rotary shaft 108. The upper second rotary shaft 106 is arranged on the downstream side of, and adjacent to, the upper first rotary shaft 105. The lower second rotary shaft 108 is arranged on the downstream side of, and adjacent to, the lower first rotary shaft 107.

Each upper scoreline ring 109 is formed on its outer periphery with a protrusion 113 continuously extending circumferentially over the entire circumference of the ring 109. Each lower scoreline ring 110 is formed in its outer periphery with a recess 114 continuously extending circumferentially over the entire circumference of the ring 110. Each upper normal scoreline ring 111 is formed on its outer periphery with a protrusion 115 continuously extending circumferentially over the entire circumference of the ring 111. Each lower normal scoreline ring 112 is formed in its outer periphery with a recess 116 continuously extending circumferentially over the entire circumference of the ring 112.

The scorer 53 sandwiches the corrugated paperboard sheet 55 between the protrusions 113 of the upper scoreline rings 109 and the recesses 114 of the respective lower scoreline rings 110, thereby forming in the corrugated paperboard sheet 55 scorelines extending in the conveying direction (direction perpendicular to the corrugations of the corrugated paperboard sheet 55). Similarly, the scorer 53 sandwiches the corrugated paperboard sheet 55 between the protrusions 115 of the upper normal scoreline rings 111 and the recesses 116 of the respective lower normal scoreline rings 112, thereby forming in the corrugated paperboard sheet 55 normal scorelines 29 extending in the conveying direction (direction perpendicular to the corrugations of the corrugated paperboard sheet 55).

The scorer 53 further includes a reverse scoreline forming device 117. The reverse scoreline forming device 117 includes an upper rotary shaft 118 arranged over the corrugated paperboard sheet 55, a lower rotary shaft 119 arranged under the corrugated paperboard sheet 55, upper reverse scoreline rings 120 fixed to the upper rotary shaft 118, and lower reverse scoreline rings 121 fixed to the lower rotary shaft 119. The upper rotary shaft 118 is vertically opposed to the lower rotary shaft 119. Each upper reverse scoreline ring 120 is formed in its outer periphery with a recess 122 continuously extending circumferentially over the entire circumference of the ring 120. Each lower reverse scoreline ring 121 is formed on its outer periphery with a protrusion 123 continuously extending circumferentially over the entire circumference of the ring 121. The reverse scoreline forming device 117 sandwiches the corrugated paperboard sheet 55 between the recesses 122 of the upper reverse scoreline rings 120 and the protrusions 123 of the respective lower reverse scoreline rings 121, thereby forming in the corrugated paperboard sheet 55 reverse scorelines 16 extending in the conveying direction (direction perpendicular to the corrugations of the corrugated paperboard sheet 55).

The reverse scoreline forming device 117 further includes a driving device 124 configured to move up and down the upper reverse scoreline rings 120. The driving device 124 moves up the upper reverse scoreline rings 120 when no reverse scorelines 16 need to be formed in the corrugated paperboard sheet 55, and moves down the upper reverse scoreline rings 120 to form the reverse scorelines 16 in the corrugated paperboard sheet 55.

The slitter 54 includes a rotary shaft 125 arranged over the corrugated paperboard sheet 55, a rotary shaft 126 arranged under the corrugated paperboard sheet 55, knife receivers 127 fixed to the upper rotary shaft 125, and slitter knives 128 fixed to the lower rotary shaft 126. Each slitter knife 128 is a rotary blade formed on its outer periphery with a cutting edge continuous circumferentially over the entire circumference of the slitter knife 128, and configured to slit the corrugated paperboard sheet 55 from the lower side of the sheet 55 (i.e., from the side of the outer linerboard 1), and cut the corrugated paperboard sheet 55 along the conveying direction (direction perpendicular to the corrugations of the sheet 55).

The slitter scorer 50 includes a frame 79 supporting the upper rotary shafts 105 and 106 and the lower rotary shafts 107 and 108, a base member 80 fixed to the floor F, and linear guides 81 provided between the frame 79 and the base member 80.

The reverse scoreline forming device 117 includes an auxiliary frame 83 supporting the upper rotary shaft 118 and the lower rotary shaft 119, a base member 84 fixed to the floor F, and linear guides 85 provided between the auxiliary frame 83 and the base member 84.

The perforation forming device 51 of this corrugator includes perforation forming knives 89 arranged such that each perforation forming knife 89 and the corresponding normal scoreline rings 111 and 112 lie on a common straight line extending in the direction in which the corrugated paperboard sheet 55 is conveyed so that the perforated lines 17 are formed within the respective normal scorelines 29, which have been formed by the normal scoreline rings 111 and 112.

Figure 50:
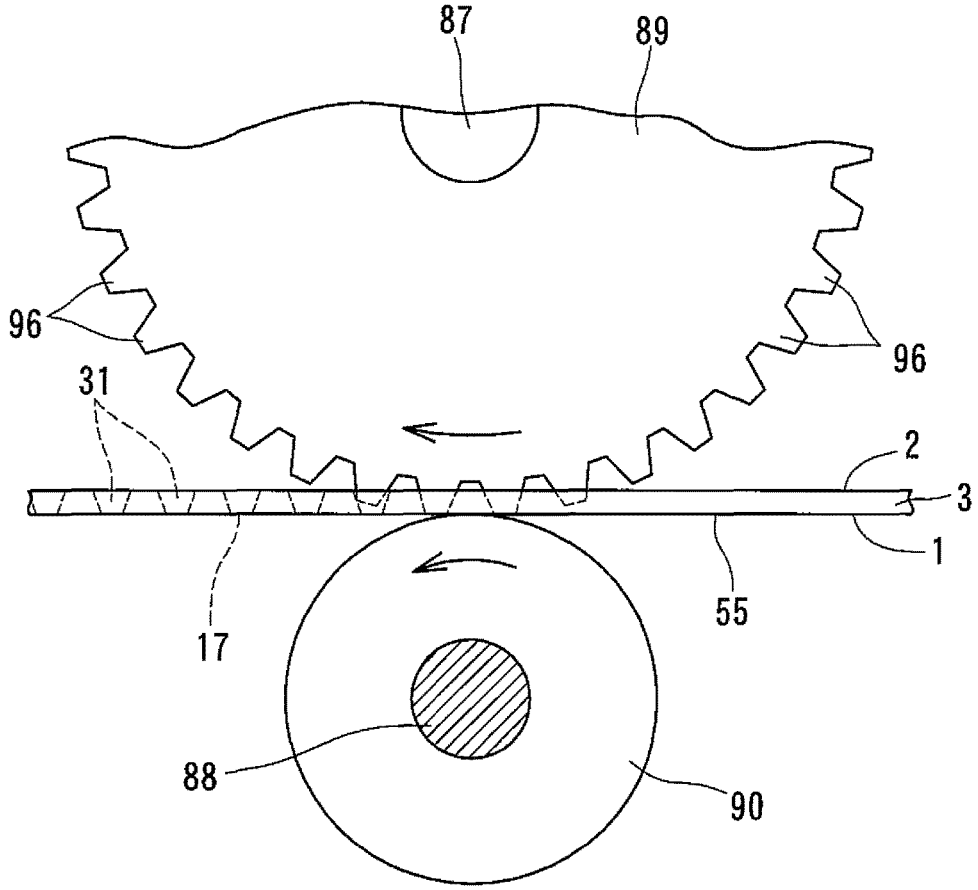
FIG. 50 is an enlarged sectional view illustrating the vicinity of the perforation forming knives of the perforation forming device illustrated in FIG. 49.

As illustrated in FIG. 50, each perforation forming knife 89 is formed on its outer periphery with a plurality of cutting portions 96 protruding radially outwardly, and circumferentially spaced apart from each other. The cutting portions 96 are each formed such that the circumferential width of the cutting portion 96 gradually decreases from the radially inner side of the cutting portion 96 toward the radially outer side thereof. This shape enables the perforation forming knife 89 to form the perforated line 17 in the corrugated paperboard sheet 55 such that as illustrated in FIG. 41, the lengths of the joint portions between the adjacent pairs of cut portions 31*a* on the side of the outer linerboard 1 are larger than those of the joint portions between the adjacent pairs of cut portions 31*b* on the side of the inner linerboard 2.

Figure 51:
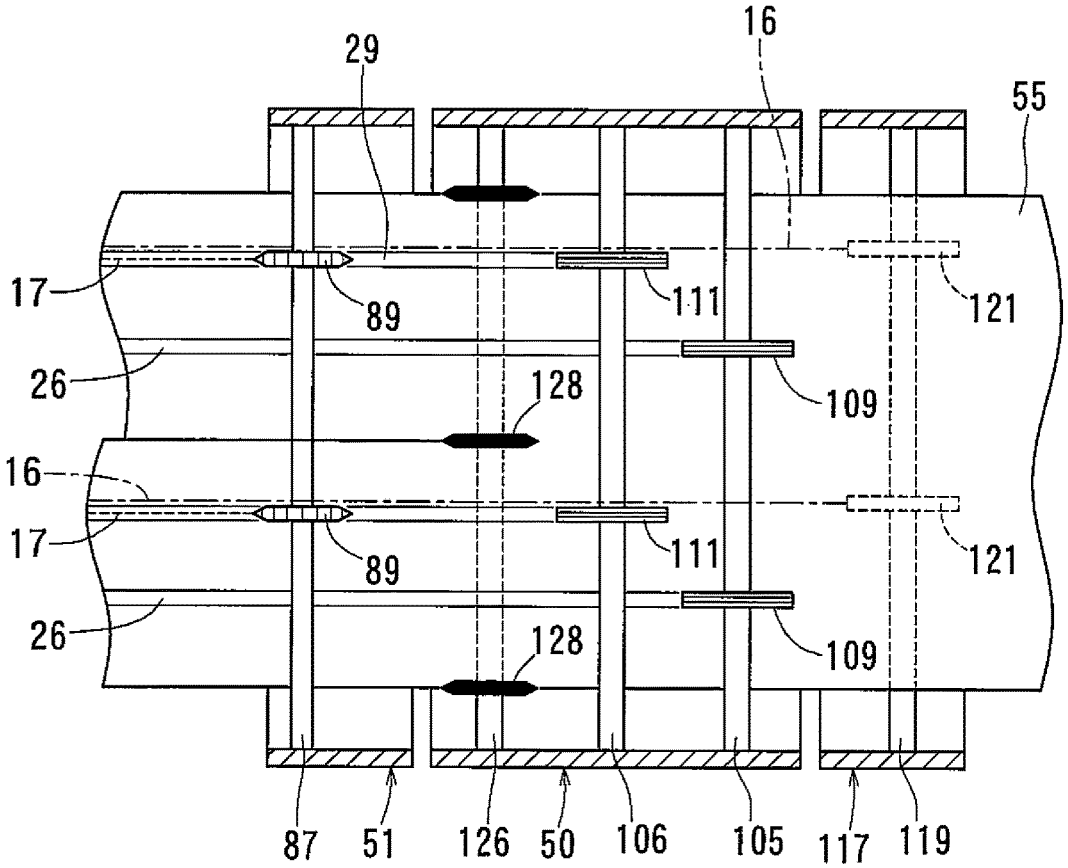
FIG. 51 is a plan view schematically illustrating, as one example, the arrangement of the reverse scoreline rings, the normal scoreline rings, the slitter knives, and the perforation forming knives illustrated in FIG. 49.

When this corrugator is used to manufacture the corrugated paperboard sheet 55, since as illustrated in FIGS. 49 and 51, the normal scorelines 29 are first formed by the normal scoreline rings 111 and 112, and then the perforated lines 17 are formed by the perforation forming knives 89, arranged on the downstream side of the normal scoreline rings 111 and 112, it is possible to prevent the inner linerboard 2 from breaking along the perforated lines 17 due to the pressing force applied when the normal scorelines 29 are formed. Namely, if the perforation forming knives 89 were arranged on the upstream side of the normal scoreline rings 111 and 112, the perforated lines 17 would be first formed by the perforation forming knives 89, and then the normal scorelines 29 would be formed on the perforated lines 17 by the normal scoreline rings 111 and 112, so that the inner linerboard 2 might break along the perforated lines 17 due to the pressing force applied when the normal scorelines 29 are formed. In contrast thereto, by arranging the perforation forming knives 89 on the downstream side of the normal scoreline rings 111 and 112 as in the above corrugator, it is possible to prevent the breakage of the inner linerboard 2 when forming the normal scorelines 29 and the perforated lines 17 such that the latter is located within the former.

When this corrugator is used to manufacture the corrugated paperboard sheet 55, since the reverse scorelines 16 are first formed by the reverse scoreline rings 120 and 121, and then the perforated lines 17 are formed by the perforation forming knives 89, arranged on the downstream side of the reverse scoreline rings 120 and 121, it is possible to prevent the outer linerboard 1 from breaking along the perforated lines 17 due to the tension applied to the outer linerboard 1 when the reverse scorelines 16 are formed. Namely, if the perforation forming knives 89 were arranged on the upstream side of the reverse scoreline rings 120 and 121, the perforated lines 17 would be first formed by the perforation forming knives 89, and then the reverse scorelines 16 would be formed by the reverse scoreline rings 120 and 121, so that the outer linerboard 1 might break along the perforated lines 17 due to the tension applied to the outer linerboard 1 when the reverse scorelines 16 are formed. In contrast thereto, by arranging the perforation forming knife 89 on the downstream side of the reverse scoreline rings 120 and 121 as in the above corrugator, it is possible to form the reverse scoreline 16 and the perforated line 17 without the possibility of the breakage of the outer linerboard 1.

While the reverse scoreline forming device 117 is arranged on the upstream side of the slitter scorer 50 in FIG. 49, the reverse scoreline forming device 117 may be arranged on the downstream side of the slitter scorer 50 and on the upstream side of the perforation forming device 51.

Figure 52:
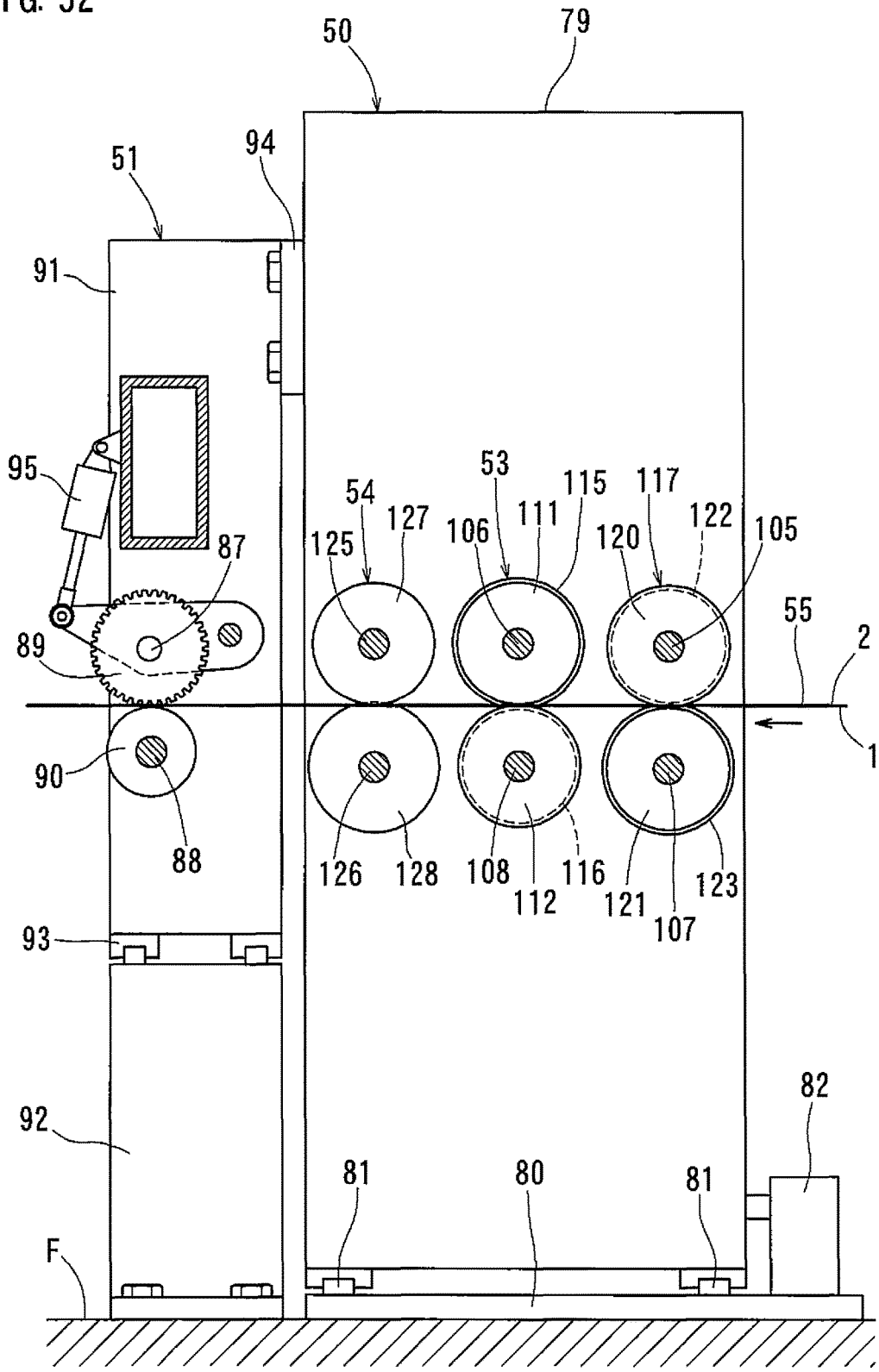
FIG. 52 is a sectional view illustrating the reverse scoreline rings of FIG. 49 arranged coaxially with the normal scoreline rings or the scoreline rings.
Figure 53:
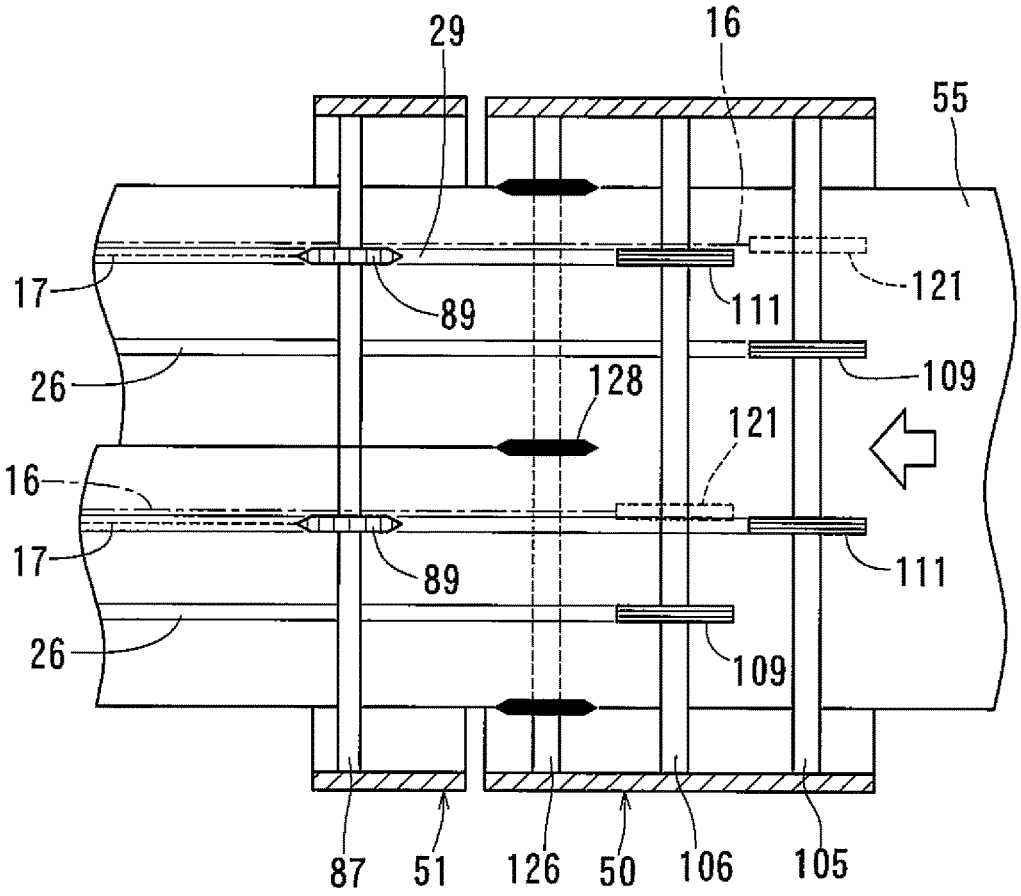
FIG. 53 is a plan view schematically illustrating, as one example, the arrangement of the reverse scoreline rings, the normal scoreline rings, the slitter knives, and the perforation forming knives illustrated in FIG. 52.

While, in FIG. 49, the upper and lower reverse scoreline rings 120 and 121 are fixed to the upper and lower rotary shafts 118 and 119, provided separately from the rotary shafts 105, 106, 107 and 108, to which the scoreline rings 109, 110, 111 and 112 are fixed, as illustrated in FIGS. 52 and 53, the upper and lower reverse scoreline rings 120 and 121 may be each fixed to one of the rotary shafts 105, 106, 107 and 108.

Figure 54:
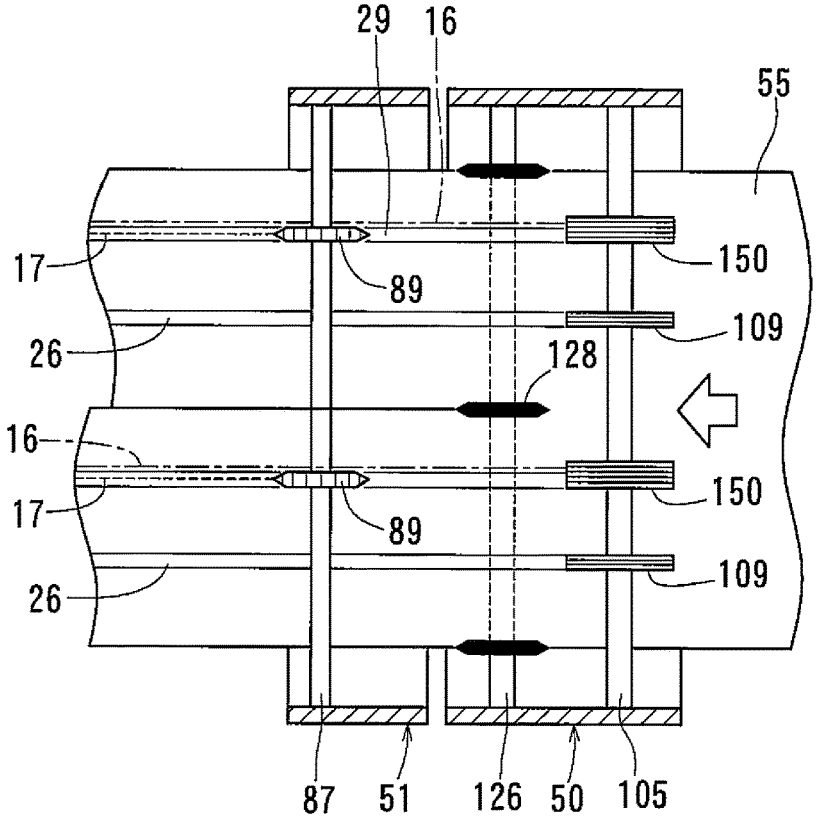
FIG. 54 is a plan view schematically illustrating, as one example, the arrangement in which special scoreline rings are used which are each a combination of the reverse scoreline ring and the normal scoreline ring illustrated in FIG. 53.
Figure 55:
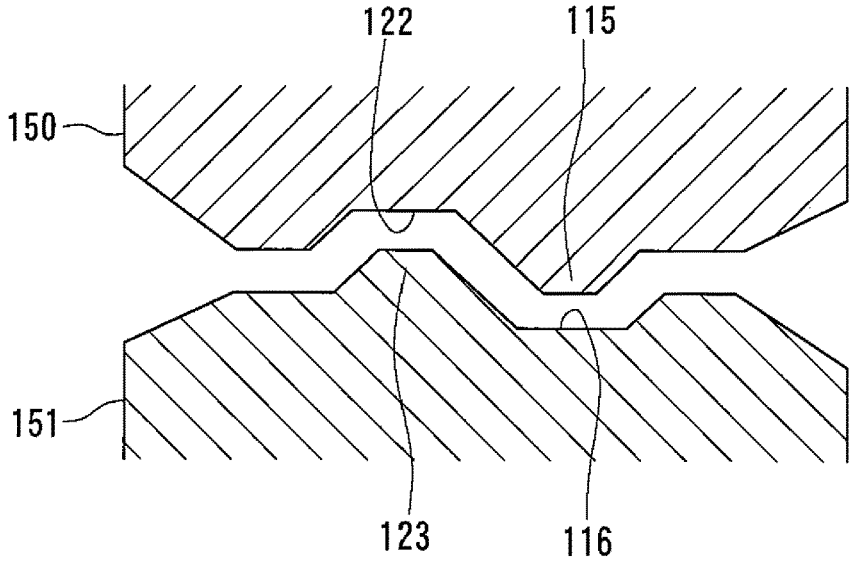
FIG. 55 is a partially enlarged sectional view schematically illustrating the shape of the special scoreline rings illustrated in FIG. 54.

As illustrated in FIGS. 54 and 55, the normal scorelines 29 and the reverse scorelines 16 may be formed by upper special scoreline rings 150 which are each a combination of the upper reverse scoreline ring 120 (FIG. 52) and the upper normal scoreline ring 111 (FIG. 52), and lower special scoreline rings 151 which are each a combination of the lower reverse scoreline ring 121 (FIG. 52) and the lower normal scoreline ring 112 (FIG. 52). In particular, the upper special scoreline rings 150 are each formed with a recess 122 corresponding to the recess 122 of the upper reverse scoreline ring 120 (FIG. 52), and a protrusion 115 corresponding to the protrusion 115 of the upper normal scoreline ring 111 (FIG. 52), and axially adjacent to the recess 122 of the upper special scoreline ring 150, whereas the lower special scoreline rings 151 are each formed with a protrusion 123 corresponding to the protrusion 123 of the lower reverse scoreline ring 121 (FIG. 52), and a recess 116 corresponding to the recess 116 of the lower normal scoreline ring 112 (FIG. 52), and axially adjacent to the protrusion 123 of the lower special scoreline ring 151.

The perforation forming device 51 may not be arranged on the downstream side of the slitter scorer 50 as shown in FIG. 49 if the perforation forming device 51 is arranged on the downstream side of the scorer 53. For example, the perforation forming device may be arranged in the frame 79 of the slitter scorer 50 (in the portion of the frame 79 located on the downstream side of the scorer 53). Also, the perforation forming device 51 may be constituted by arranging the perforation forming knives 89 coaxially with the upper rotary shaft 125 of the slitter 54.

While, in FIG. 49, the corrugator performs both the scoreline forming step, i.e., the step of forming the normal scorelines 29 (see FIG. 37) and the reverse scorelines 16 (see FIG. 37), and the perforation forming step, i.e., the step of forming, subsequent to the scoreline forming step, the perforated lines 17 (see FIG. 37) so as to be located within the normal scorelines 29 (see FIG. 37), both of the former and latter steps, or only the latter step may be carried out in a station downstream of the corrugator. (For example, in this station, a cut sheet 55 cut off from the corrugated paperboard sheet 55 is further cut into a plurality of sheet sections, and scorelines are formed on the individual sheet sections by use of a cutting machine; or scorelines are formed on the cut sheet 55 and printing is performed by use of a printer slotter.)

With this alternative arrangement too, it is possible prevent the breakage of the inner linerboard 2 due to the pressing force applied when the normal scorelines 29 are formed. Namely, if the perforated lines 17 were first formed, and then the normal scorelines 29 were formed on the perforated lines 17, the inner linerboard 2 might break due to the pressing force applied when the normal scorelines 29 are formed. In contrast thereto, by forming the normal scorelines 29 first, and then forming the perforated lines 17 in the normal scorelines 29, since the corrugated paperboard is collapsed at the normal scorelines 29 before the perforated lines 17 are formed, it is possible to prevent the breakage of the inner linerboard 2.

In FIG. 49, the perforation forming unit (i.e., the unit including the scoreline forming device configured to form the normal scorelines 29 (see FIG. 37) and the reverse scorelines 16 (see FIG. 37) in the corrugated paperboard sheet 55, and the perforation forming device 51 arranged on the downstream side of the scoreline forming device, and configured to form the perforated lines 17 (see FIG. 37) in the normal scoreline 29*s* (see FIG. 37)) comprises a scorer 53 for forming the normal scorelines 29 (see FIG. 37) and the reverse scorelines 16 (see FIG. 37) in the corrugated paperboard sheet 55, continuously extending in a strip shape in a midway process of the corrugator, and a perforation forming device 51 arranged on the downstream side of the scorer 53 of the corrugator. Alternatively, as illustrated in FIG. 56, a perforation forming unit may be used which is configured to process, one by one, cut sheets cut off from the corrugated paperboard sheet 55 by the corrugator (such a cut sheet is hereinafter simply referred to as the "cut sheet 55" or the "cut corrugated paperboard sheet 55").

Figure 56:
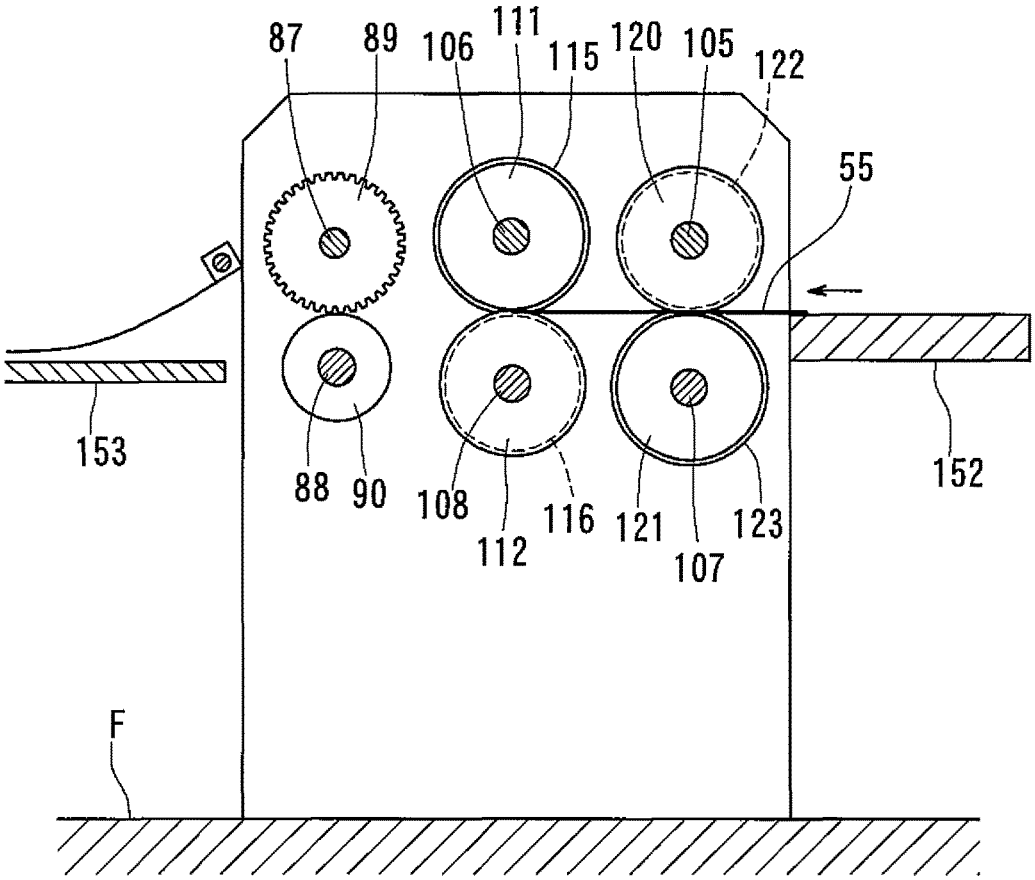
FIG. 56 is a sectional view of a perforation forming unit for cut sheets cut off from the corrugated paperboard sheet.

The perforation forming unit illustrated in FIG. 56 comprises, for example, a unit formed by modifying a cutting machine configured to cut a cut corrugated paperboard sheet 55 to a predetermined width size. As for the elements corresponding to those of the perforation forming unit illustrated in FIG. 49, the same reference numerals as used in the unit of FIG. 49 are used below, and their description is omitted.

This perforation forming unit includes a sheet feed table 152 arranged on the upstream side of the upper and lower reverse scoreline rings 120 and 121, and supporting cut corrugated paperboard sheets 55, and a sheet discharge table 153 arranged on the downstream side of the perforation forming knives 89 and the knife receivers 90.

It is now described how this perforation forming unit is used. First, when a cut corrugated paperboard sheet 55 supported by the sheet feed table 152 is fed into the space between the upper reverse scoreline rings 120 and the lower reverse scoreline rings 121, the reverse scorelines 16 (FIG. 37) are formed in the cut corrugated paperboard sheet 55. Thereafter, when the cut corrugated paperboard sheet 55 is fed into the space between the upper normal scoreline rings 111 and the lower normal scoreline rings 112, the normal scorelines 29 (see FIG. 37) are formed in the cut corrugated paperboard sheet 55. Thereafter, by the perforation forming knives 89, the perforated lines 17 (see FIG. 37) are formed so as to be located within the normal scoreline 29. A slitter knife (not shown) may be attached to the rotary shafts 106 and 108 so as to be axially aligned with the upper and lower normal scoreline rings 111 and 112 to cut the cut corrugated paperboard sheet 55 to a predetermined width size.

While, in FIG. 37, the perforated line 17 is formed to extend through all of the portion of the normal scoreline 29 between the top flap 11 and the peripheral wall 41, the portion of the normal scoreline 29 between the top flap 12 and the peripheral wall 41, the portion of the normal scoreline 29 between the top flap 13 and the peripheral wall 41, and the portion of the normal scoreline 29 between the top flap 14 and the peripheral wall 41, the perforated line 17 may be formed to extend only through one of the above four portions of the normal scoreline 29.

While, in FIG. 38, the perforated line 17 comprises cuts 31 extending in parallel to the direction in which the normal scoreline 29 extends, the perforated line 17 may comprise multiple of cuts 31 inclined with respect to the direction in which the normal scoreline 29 extends, and spaced apart from each other within the width of the normal scoreline 29. Namely, it is only required that the cuts 31 forming the perforated line 17 be located within the width of the normal scoreline 29.

DESCRIPTION OF REFERENCE NUMERALS

1: outer linerboard
2: inner linerboard
3: corrugated medium
11, 12, 13, 14: top flap
16: reverse scoreline
17: perforated line
19*a*, 19*b*: groove-shaped recess
29: normal scoreline
31: cut
31*a*, 31*b*: cut portion
32, 33: peripheral edge portion
41: peripheral wall
$\mathbf{40}_1$, $\mathbf{40}_2$, $\mathbf{40}_3$: corrugated paperboard box
51: perforation forming device
53: scorer
55: corrugated paperboard sheet
64: reverse scoreline forming device
67, 68: reverse scoreline ring
70: protrusion
71: recess
72: groove
73: groove shoulder
89: perforation forming knife
96: cutting portion
97, 98, 99: cutting edge
111, 112: normal scoreline ring
120, 121: reverse scoreline ring
150, 151: special scoreline ring
$W_1$: width of the cut portion 31*a*
$W_2$: width of the cut portion 31*b*
$A_1$: depth of the normal scoreline 29
$A_2$: depth of the reverse scoreline 16
B: distance between the center of the normal scoreline 29 and the center of the reverse scoreline 16

The invention claimed is:

1. A corrugated paperboard box comprising:
corrugated paperboard including:
an outer linerboard,
an inner linerboard, and
a corrugated medium provided between the outer linerboard and the inner linerboard,
wherein the corrugated paperboard box has:
a peripheral wall formed by bending the corrugated paperboard into a tubular shape such that the inner linerboard constitutes an inner surface of the corrugated paperboard box; and
flaps integrally connected to one of two ends of the peripheral wall,
wherein the corrugated paperboard box has a boundary area between the peripheral wall and the flaps, a groove-shaped reverse scoreline recessed on a side of the outer linerboard at the boundary area, and a pair of groove-shaped recesses recessed on a side of the inner linerboard at the boundary area, the pair of groove-shaped recesses extending in parallel to each other so as to sandwich a reverse scoreline area in which the reverse scoreline extends,
wherein the corrugated paperboard box has a perforated line in one of the pair of groove-shaped recesses, the perforated line configured to allow the flaps to be separated from the peripheral wall, and the perforated line comprising a plurality of cuts penetrating through the inner linerboard, the corrugated medium, and the outer linerboard,
wherein the corrugated paperboard is configured to allow the flaps to be bent along the perforated line toward an inner surface of the peripheral wall,
wherein each of the cuts of the perforated line has a first cut portion formed in the outer linerboard, and a second cut portion formed in the inner linerboard, and
wherein the perforated line is formed such that a width of each of the first cut portions in an orthogonal direction relative to a direction in which the perforated line extends is smaller than a width of each of the second cut portions in the orthogonal direction.

2. The corrugated paperboard box according to claim 1, wherein the perforated line is formed such that each of the first cut portions on the side of the outer linerboard includes a peripheral edge portion having a protruding shape, and each of the second cut portions on the side of the inner linerboard includes a peripheral edge portion having a recessed shape.

3. A corrugated paperboard box comprising:

corrugated paperboard including:

an outer linerboard, an inner linerboard, and a corrugated medium provided between the outer linerboard and the inner linerboard, wherein the corrugated paperboard box has:

a peripheral wall formed by bending the corrugated paperboard into a tubular shape such that the inner linerboard constitutes an inner surface of the corrugated paperboard box; and flaps integrally connected to one of two ends of the peripheral wall, wherein the corrugated paperboard box has a boundary area between the peripheral wall and the flaps, a groove-shaped reverse scoreline recessed on a side of the outer linerboard at the boundary area, and a perforated line configured to allow the flaps to be separated from the peripheral wall, and the perforated line comprising a plurality of cuts penetrating through the inner linerboard, the corrugated medium, and the outer linerboard, wherein the perforated line is formed within the reverse scoreline, wherein each of the cuts of the perforated line comprises a first cut portion formed in the outer linerboard, and a second cut portion formed in the inner linerboard, and wherein the perforated line is formed such that a width of each of the first cut portions in an orthogonal direction relative to a direction in which the perforated line extends is smaller than a width of each of the second cut portions in the orthogonal direction.

4. The corrugated paperboard box according to claim 3, wherein the perforated line is formed such that each of the first cut portions on the side of the outer linerboard includes a peripheral edge portion having a protruding shape, and each of the second cut portions on a side of the inner linerboard includes a peripheral edge portion having a recessed shape.

5. A corrugated paperboard box comprising:

corrugated paperboard including:

an outer linerboard, an inner linerboard, and a corrugated medium provided between the outer linerboard and the inner linerboard, wherein the corrugated paperboard box has:

a peripheral wall formed by bending the corrugated paperboard into a tubular shape such that the inner linerboard constitutes an inner surface of the corrugated paperboard box; and flaps integrally connected to one of two ends of the peripheral wall;

wherein the corrugated paperboard box has a groove-shaped normal scoreline between the peripheral wall and the flaps, the groove-shaped normal scoreline being recessed on a side of the inner linerboard so that the flaps can be bent along the normal scoreline toward an inner surface of the peripheral wall, wherein the corrugated paperboard box further has a perforated line located within the normal scoreline, the perforated line being configured to allow the flaps to be separated from the peripheral wall, wherein the corrugated paperboard box further has a groove-shaped reverse scoreline at a position spaced apart from the normal scoreline toward the flaps, the groove-shaped reverse scoreline extending in parallel to the normal scoreline, and the groove-shaped reverse scoreline being recessed on a side of the outer linerboard to allow the flaps to be bent along the reverse scoreline toward an outer surface of the peripheral wall, wherein the perforated line comprises a plurality of cuts penetrating through the inner linerboard, the corrugated medium, and the outer linerboard, each of the cuts of the perforated line having a first cut portion formed in the outer linerboard, and a second cut portion formed in the inner linerboard, and wherein the perforated line is formed such that a width of each of the first cut portions in an orthogonal direction relative to a direction in which the perforated line extends is smaller than a width of each of the second cut portions in the orthogonal direction.

6. The corrugated paperboard box according to claim 5, wherein a depth of the reverse scoreline is equal to or larger than a depth of the normal scoreline.

7. The corrugated paperboard box according to claim 5, wherein the reverse scoreline is arranged such that a distance between a center of the normal scoreline and a center of the reverse scoreline is within a range of 5 mm to 20 mm.

8. The corrugated paperboard box according to claim 1, wherein the perforated line is formed in one of the pair of groove-shaped recesses not forming a hinge for closing the flaps.

* * * * *